US011957246B2

(12) United States Patent
Bisman et al.

(10) Patent No.: US 11,957,246 B2
(45) Date of Patent: Apr. 16, 2024

(54) CHAIR

(71) Applicant: FORMWAY FURNITURE LIMITED, Wellington (NZ)

(72) Inventors: Christopher Warren Bisman, Martinborough (NZ); James Clifford Prier, Wellington (NZ); Fabian David Haarbeck, Wellington (NZ); Paul Michael Wilkinson, Wellington (NZ); Damon Gregory Burwell, Wellington (NZ); Hugh Thomas Mccoshim, Greytown (NZ); Leon Harley Craze, Lower Hutt (NZ); Rachael Jessica Hall, Wellington (NZ)

(73) Assignee: Formway Furniture Limited, Wellngton (NZ)

( * ) Notice: Subject to any disclaimer, the term of this patent is extended or adjusted under 35 U.S.C. 154(b) by 0 days.

(21) Appl. No.: 18/006,238

(22) PCT Filed: Jul. 21, 2021

(86) PCT No.: PCT/IB2021/056567
§ 371 (c)(1),
(2) Date: Jan. 20, 2023

(87) PCT Pub. No.: WO2022/018644
PCT Pub. Date: Jan. 27, 2022

(65) Prior Publication Data

US 2023/0263306 A1 Aug. 24, 2023

(30) Foreign Application Priority Data

Jul. 22, 2020 (NZ) ..... 766462

(51) Int. Cl.
*A47C 1/032* (2006.01)

(52) U.S. Cl.
CPC ..... *A47C 1/03255* (2013.01); *A47C 1/03261* (2013.01)

(58) Field of Classification Search
CPC ..... A47C 1/032
See application file for complete search history.

(56) References Cited

U.S. PATENT DOCUMENTS 3,572,829 A * 3/1971 Malitte ..... B64D 11/06 297/317
3,873,054 A * 3/1975 McKee ..... B60N 2/143 248/371

(Continued)

FOREIGN PATENT DOCUMENTS

WO 2014/036633 A1 3/2014
WO 2015/167205 A1 11/2015

OTHER PUBLICATIONS

International Preliminary Report on Patentability dated Mar. 16, 2022, issued in PCT Application No. PCT/IB2021/056567, filed Jul. 21, 2021.

*Primary Examiner* — Rodney B White
(74) *Attorney, Agent, or Firm* — Workman Nydegger

(57) ABSTRACT

A chair with a transom, a seat support, a back portion, and a combined rock and recline mechanism. The combined rock and recline mechanism has front and rear rocking arrangements configured to enable the seat support and back portion to together rock generally forward and rearward from a neutral position relative to the transom, and a recline arrangement that is configured such that the seat support is in a first at-rest position relative to the back portion when the back portion is in an upright position, and such that reclining the back portion rearwardly from the upright position toward a reclined position moves the seat support upward and rearward from the first at-rest position.

22 Claims, 44 Drawing Sheets

(56) References Cited

U.S. PATENT DOCUMENTS

| | | | | |
|---|---|---|---|---|
| 5,333,368 | A * | 8/1994 | Kriener | A47C 7/444 297/303.3 |
| 6,318,803 | B1 | 11/2001 | Garland | |
| 6,367,876 | B2 | 4/2002 | Caruso et al. | |
| 6,394,549 | B1 | 5/2002 | Dekraker et al. | |
| 6,959,965 | B2 | 1/2005 | Diffrient | |
| 6,945,602 | B2 * | 9/2005 | Fookes | A47C 1/03261 297/300.4 |
| 7,004,543 | B2 | 2/2006 | Caruso et al. | |
| 7,066,538 | B2 | 6/2006 | Machael et al. | |
| 7,114,777 | B2 | 10/2006 | Knoblock et al. | |
| 7,614,697 | B1 * | 11/2009 | Lai | A47C 1/03255 297/301.7 |
| 8,613,482 | B2 * | 12/2013 | Ni | A47C 1/026 297/302.3 |
| 8,662,586 | B2 | 3/2014 | Serber | |
| 8,777,312 | B2 | 7/2014 | Diffrient | |
| 9,241,570 | B2 | 1/2016 | Jones et al. | |
| 9,241,571 | B2 | 1/2016 | Robertson | |
| 9,364,091 | B2 * | 6/2016 | Costaglia | A47C 1/03294 |
| 9,433,296 | B2 * | 9/2016 | Gorgi | A47C 4/021 |
| 9,743,772 | B2 | 8/2017 | Rivera | |
| 10,143,306 | B2 | 12/2018 | Bock | |
| 10,383,445 | B2 | 8/2019 | Serber | |
| 10,470,574 | B2 | 11/2019 | Schneider | |
| 10,881,208 | B2 * | 1/2021 | Yajima | A47C 3/0255 |
| 10,993,536 | B2 * | 5/2021 | Pu | A47C 1/03294 |
| 11,350,750 | B2 * | 6/2022 | Slongo | A47C 1/03294 |
| 2013/0313875 | A1 | 11/2013 | Brncick et al. | |
| 2014/0103689 | A1 | 4/2014 | Birkbeck | |
| 2018/0289159 | A1 | 10/2018 | Bock | |
| 2018/0332967 | A1 | 11/2018 | Jin et al. | |
| 2019/0159596 | A1 | 5/2019 | Desanta | |
| 2019/0223599 | A1 | 7/2019 | Garland | |
| 2019/0313798 | A1 | 10/2019 | Weber et al. | |
| 2022/0248853 | A1 * | 8/2022 | Schmitz | A47C 1/03255 |

* cited by examiner

CHAIR

This application claims priority from New Zealand patent application 766462 filed on 22 Jul. 2020, the entire content of which is incorporated herein by way of reference.

FIELD OF THE INVENTION

This invention relates to a chair. More particularly, the invention relates to a chair with a combined rock and recline mechanism.

BACKGROUND

Many existing rocking and reclining chairs have mechanisms to provide a rocking or reclining motion. These mechanisms may function separately so that the chair may either have a rocking motion or recline motion.

These mechanisms may function upon movement of a user of the chair or may instead require actuators that need to be operated by a user to permit rocking or reclining of the chair. Mechanisms with actuators that need to be operated by a user can result in awkward or clunky movement when transitioning from a rocked position to a recline position or vice versa. Typically, combined rocking and reclining mechanisms are bulky and complex whether they operate upon movement of a user or upon use of an actuator or actuators. Thus, they can often be unsightly and therefore lack aesthetic appeal to a consumer.

Further, complex mechanisms of that type can be prohibitively expensive to apply to chairs that are bought in large numbers such as meeting or office chairs, where the purchase of multiple chairs is necessary and a lower cost is desirable.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

It is an object of at least preferred embodiments of the present invention to provide a chair with a combined rock and recline mechanism. It is an additional or alternative object of at least preferred embodiments of the present invention to at least provide the public with a useful choice.

SUMMARY OF THE INVENTION

In a first aspect of the invention, there is provided a chair comprising: a transom; a seat support; a back portion; and a combined rock and recline mechanism that operatively connects the seat support and the back portion to the transom and the seat support to the back portion, the combined rock and recline mechanism comprising: front and rear rocking arrangements configured to enable the seat support and back portion to together rock generally forward and rearward from a neutral position relative to the transom, and a recline arrangement that is configured such that the seat support is in a first at-rest position relative to the back portion when the back portion is in an upright position, and such that reclining the back portion rearwardly from the upright position toward a reclined position moves the seat support upward and rearward from the first at-rest position.

In an embodiment, the chair comprises a plurality of rocked positions, the back portion being reclinable rearwardly from the upright position toward the reclined position in any of the rocked positions of the chair.

In an embodiment, the front rocking arrangement comprises a front track located on the transom and a front engagement component operatively connected to the seat support and received within the front track for movement of the front engagement component within the front track; and the rear rocking arrangement comprises a rear track located on the transom and a rear engagement component operatively connected to the back portion and received within the rear track for movement of the rear engagement component within the rear track.

In an embodiment, the back portion comprises a rear axle member and the rear engagement component is rotatably mounted on the rear axle member such that the rear axle member defines a substantially horizontal transverse rear pivot axis that is movable relative to the transom upon rocking of the seat support and back portion and about which the back portion can pivot.

In an embodiment, the seat support comprises a front axle member and the front engagement component is rotatably mounted on the front axle member such that the front axle member defines a substantially horizontal transverse front pivot axis that is movable relative to the transom and about which the seat support can pivot.

In an embodiment, the combined rock and recline mechanism comprises a substantially horizontal transverse central pivot axis that is movable relative to the transom, the back portion and the seat support being pivotally coupled to one another at the central pivot axis.

In an embodiment, the front track has a curved path and the rear track has a substantially straight path.

In an embodiment, a rear portion of the front track has a smaller radius of curvature than a front portion of the front track such that the curved path of the front track increases in steepness from the front portion to the rear portion.

In an embodiment, the combined rock and recline mechanism comprises at least one first biasing device fixed to the transom and configured to exert a first biasing force that biases the seat support and back portion toward the neutral position.

In an embodiment, a rear portion of the first biasing device is connected to the rear axle member, wherein a central portion of the first biasing device is connected to the transom, and wherein a front portion of the first biasing device is connected to a front section of the back portion that is located forward of where the central portion of the first biasing device is fixed to the transom.

In an embodiment, the first biasing device comprises an elastomeric device, wherein the front portion of the first biasing device receives a protrusion extending from the front section of the back portion and wherein the rear portion of the first biasing device receives a portion of the rear axle member.

In an embodiment, the combined rock and recline mechanism comprises at least one second biasing device that is configured to exert a second biasing force between the back portion and the seat support to inhibit a change in an angular position of the back portion relative to an angular position of the seat support.

In an embodiment, a first end of the second biasing device is engaged with the back portion, and a second end of the second biasing device is engaged with the seat support.

In an embodiment, the second biasing device is fixed to the back portion at a location between the front section and the central pivot axis.

In an embodiment, the second biasing device comprises a torsion spring with the first end of the second biasing device comprising a rearwardly extending arm engaged with the back portion and the second end of the second biasing device comprising a forwardly extending arm engaged with the seat support.

In an embodiment, the chair comprises a forward rocked position in which the front engagement component is located at a front edge of the front track, the front and rear rocking arrangements configured such that when seat support moves from the neutral position to the forward rocked position, the front pivot axis moves forward and downward relative to the neutral position and the central pivot axis moves forward and upward relative to the neutral position, thereby moving a forward portion of the seat support forward and downward relative to the transom.

In an embodiment, the chair is configured such that when the seat support moves from the neutral position to the forward rocked position, the position of the central pivot axis changes such that the rear engagement component moves to a front edge of the rear track and the rear pivot axis moves forward and upward relative to the neutral position, thereby moving a rear portion of the seat support and back portion forward and upward relative to the transom.

In an embodiment, the chair comprises a rear rocked position in which the front engagement component is located rearward from the front edge of the front track, the front and rear rocking arrangements configured such that when the seat support moves from the neutral position to the rear rocked position, the front pivot axis moves rearward and upward relative to the neutral position and the central pivot axis moves rearward and upward relative to the neutral position, thereby moving a forward portion of the seat support rearward and upward relative to the transom.

In an embodiment, the chair is configured such that when the seat support moves from the neutral position to the rear rocked position, the position of the central pivot axis changes such that the rear engagement component moves to a rear edge of the rear track, and the rear pivot axis moves rearward and downward relative to the neutral position, thereby moving a rear portion of the seat support and the back portion rearward and downward relative to the transom.

In an embodiment, the recline arrangement is configured such that moving the back portion to the reclined position changes the position of the central pivot axis such that the front pivot axis moves rearward and upward and the front engagement component moves towards a rear edge of the front track, the seat support moving rearward and upward relative to the first at-rest position.

In an embodiment, the chair is configured such that moving the back portion from the upright position to the reclined position causes the front pivot axis to travel between about 8 and about 11 millimetres rearward and between about 6 and about 13 millimetres upward relative to the first at-rest position, the neutral position, the forward rocked position, the rear rocked position, or any other rocked position and the central pivot axis to move between about 5 and about 8 millimetres rearward and between about 12 and about 14 millimetres upward relative to the first at-rest position, the neutral position, the rear rocked position, the forward rocked position or any other rocked position.

In an embodiment, the front and rear rocking arrangements are configured to define a virtual rocking path of the seat support and back portion relative to the transom.

In an embodiment, the virtual rocking path comprises a curved path and wherein a lowermost point of the curved path corresponds to the seat support and the back portion being at the neutral position, a rear portion of the virtual rocking path being located rear of the lowermost point and a front portion of the virtual rocking path being located in front of the lowermost point.

In an embodiment, the virtual rocking path increases in steepness from the lowermost point to a frontmost edge of the virtual rocking path, and wherein the virtual rocking path increases in steepness from the lowermost point to a rearmost edge of the virtual rocking path.

In an embodiment, the chair comprises a seat mounted to the seat support.

In an embodiment, the seat is slidably mounted to the seat support.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

This invention may also be said broadly to consist in the parts, elements and features referred to or indicated in the specification of the application, individually or collectively, and any or all combinations of any two or more said parts, elements or features.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

As used herein the term '(5)' following a noun means the plural and/or singular form of that noun.

As used herein the term 'and/or' means 'and' or 'or', or where the context allows both. The invention consists in the foregoing and also envisages constructions of which the following gives examples only.

BRIEF DESCRIPTION OF THE DRAWINGS

The present invention will now be described by way of example only and with reference to the accompanying drawings in which.

DETAILED DESCRIPTION OF EMBODIMENTS

Figure 1:
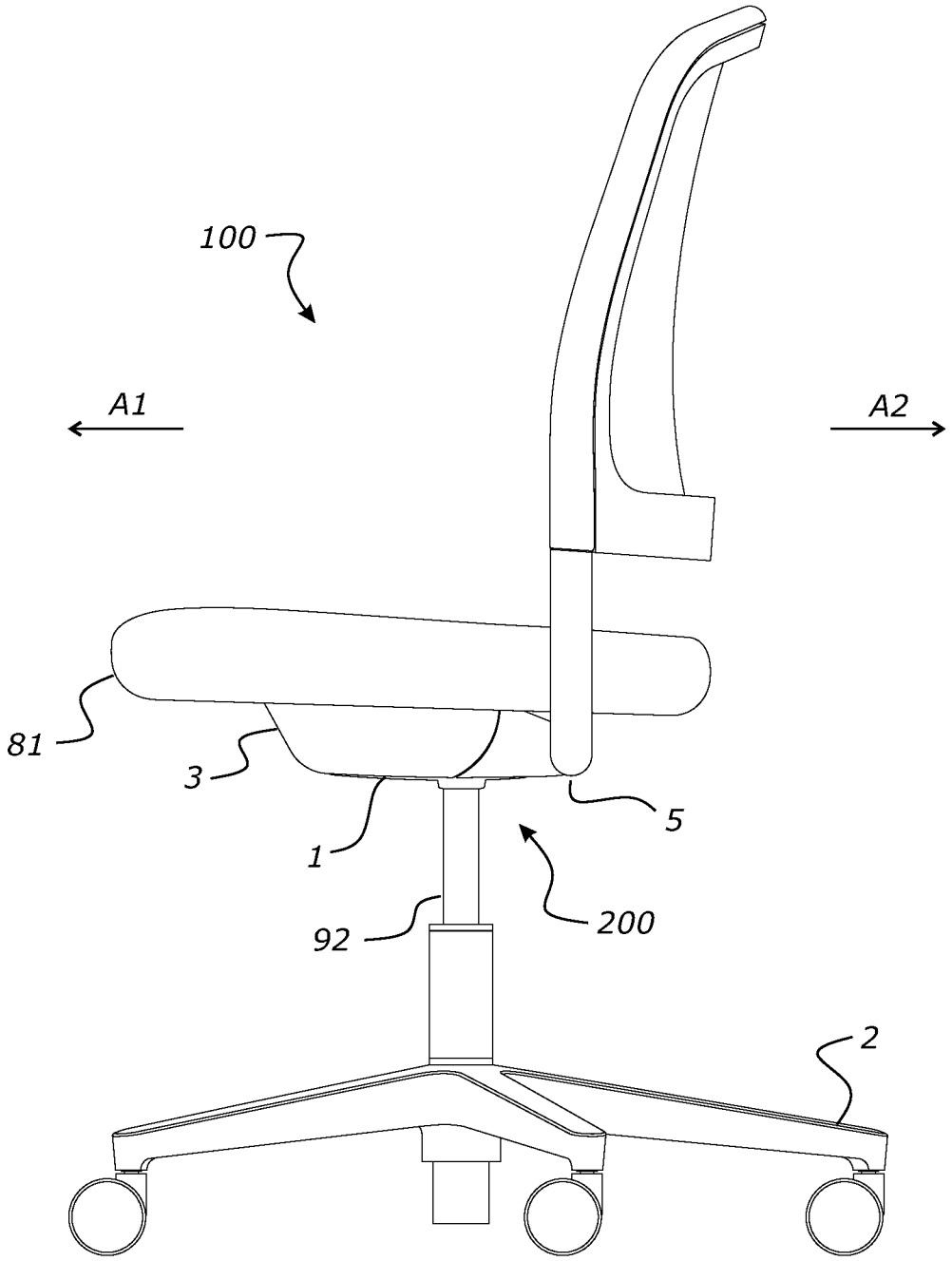
FIG. 1 shows a side view of a chair in its default position.

FIG. 1 shows a chair 100 in its default position, the chair 100 comprising a transom 1, a seat support 3 and a back portion 5. The chair 100 comprises a combined rock and recline mechanism 200 that operatively connects the seat support 3 and the back portion to the transom 1 and the seat support 3 to the back portion 5. The combined rock and recline mechanism 200 is an assembly of components.

The transom 1 is supported above the ground surface by a base 2. The base 2 may be a mobile base with wheels or casters to enable the base 2 to be moved over the ground surface, or may alternatively comprise a plurality of fixed legs that rest on the ground surface. In some embodiments of the chair 100, a height adjustable column 92 may enable a user to selectively adjust the height of the transom 1 above the base 2, and thus the ground surface. Alternatively, the chair may have a fixed height.

The combined rock and recline mechanism assembly 200 itself comprises front and rear rocking arrangements 400*a*, 400*b* shown in FIGS. 15 and 16A-16C that are configured to enable the seat support 3 and back portion 5 to together rock generally forward and rearward from a neutral position relative to the transom 1. Both the seat support 3 and the back portion 5 are shown in their respective neutral positions relative to the transom 1 in FIG. 1.

Figure 13:
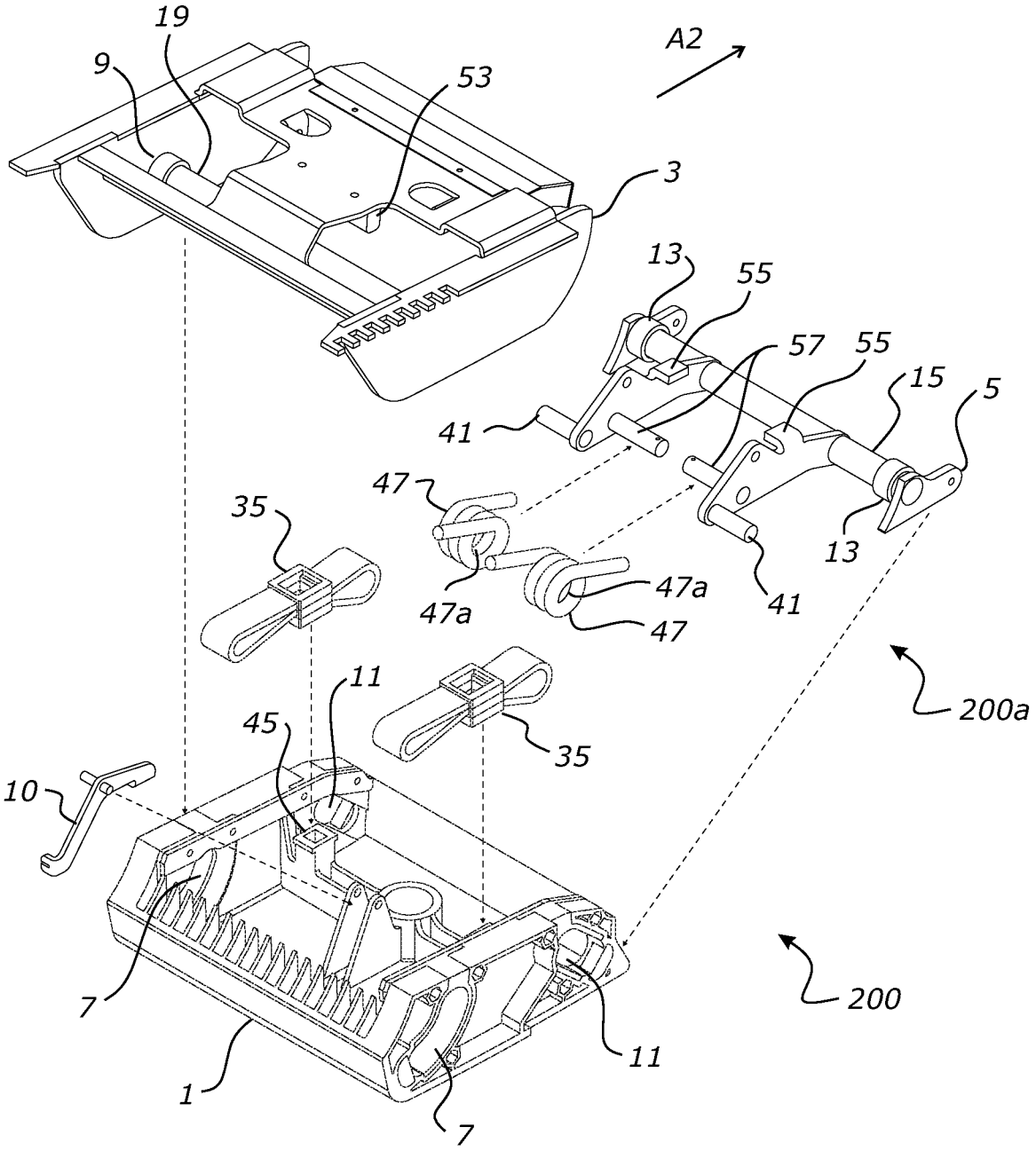
FIG. 13 shows an exploded perspective view of the combined rock and recline mechanism assembly of the chair.

The combined rock and recline mechanism assembly 200 of the chair 100 also comprises a recline arrangement 200*a* shown in FIG. 13 for example that is configured such that the seat support 3 is in a first at-rest position relative to the back portion 5 when the back portion 5 is in an upright position relative to the seat support 3, and such that reclining the back portion 5 rearwardly from the upright position toward a reclined position moves the seat support 3 upward and rearward from the first at-rest position. The back portion 5 is shown in its upright position in FIG. 1.

In the position shown in FIG. 1, the back portion 5 is oriented generally vertically and generally perpendicularly relative to the seat support 3 and thus the seat support 3 is shown in its first at-rest position.

The chair 100 generally comprises a plurality of rocked positions, some of which are shown in FIGS. 2-5, and the back portion 5 is reclinable rearwardly from the upright position toward the reclined position in any of the rocked positions of the chair 100. Therefore, the combined rock and recline mechanism assembly 200 provides rocking functionality to the chair 100 that may occur separately to the reclining functionality of the chair 100 but may also permit the rocking functionality to coincide with the reclining functionality of the chair 100 in a combined, uninterrupted and continuous movement that is comfortable and intuitive to a user of the chair 100.

When a user is sitting in the chair 100, a shift in the user's centre of gravity generally governs the rocking motion of the seat support 3 and back portion 5, and a rearward application of force via a the user's back governs the reclining motion of the back portion 5, such that no actuators need to be operated to provide said combined, uninterrupted and continuous movement of the chair 100.

Arrow A1 in FIG. 1 defines a forward direction of the chair 100, and arrow A2 defines a rearward direction of the chair 100, as used in this specification and claims. These arrows A1, A2 also define a 'front' and 'rear' reference as used in this specification and claims. Similar terms such as 'forward', 'rearward', 'forwardly', 'rearwardly', 'frontmost/rearmost extreme', 'front end/portion' and 'rear end/portion' are to be interpreted in a similar manner with reference to arrows A1 and A2 in that any forward movement of any component described herein moves said component generally in the direction of arrow A1 and any front portion or end of any component described herein is generally closer to arrow A1, or a front end of the chair 100, than it is to arrow A2.

It should also be noted that the movement of a front or rear end/portion of any given component is used herein only as a reference for the direction of movement (e.g. angular rotation or tilting) of said component in that the movement applies equally to the entire component as it does to the front or rear end/portion of said component. Therefore, a front end/portion of a component moving downwardly or a rear end/portion of a component moving upwardly can be interpreted as a counter-clockwise rotation of the entire component with reference to FIG. 1. Likewise, a front end/portion of a component moving upwardly or a rear end/portion of a component moving downwardly can be interpreted as a clockwise rotation of the entire component with reference to FIG. 1.

FIGS. 1-7 show the chair 100 in some of its various positions. The exemplary features or components that provide the functionality of the chair 100 are described in more detail below with reference to FIGS. 8-30.

Figure 2:
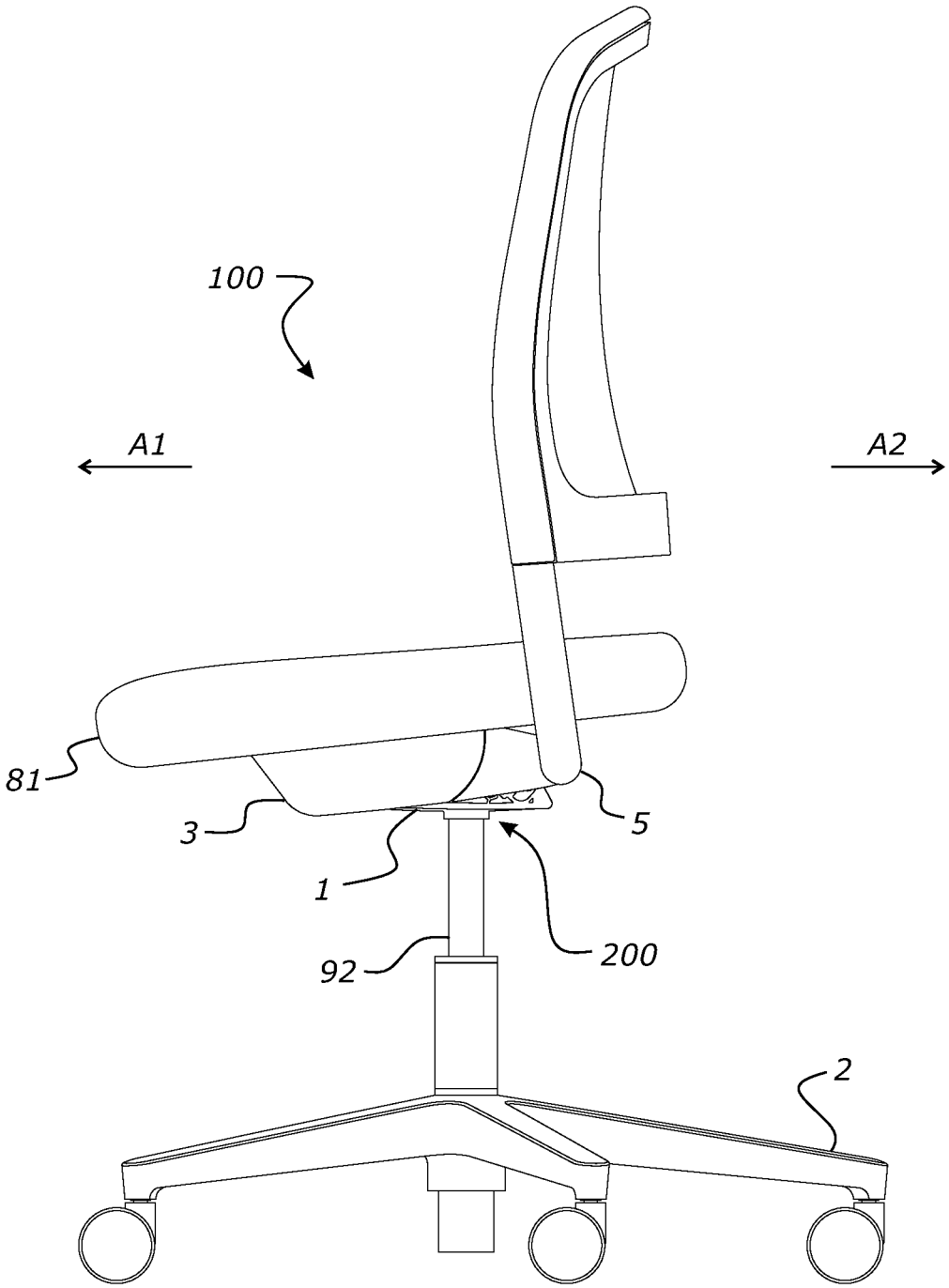
FIG. 2 shows a side view of the chair in its forward rocked position.
Figure 3:
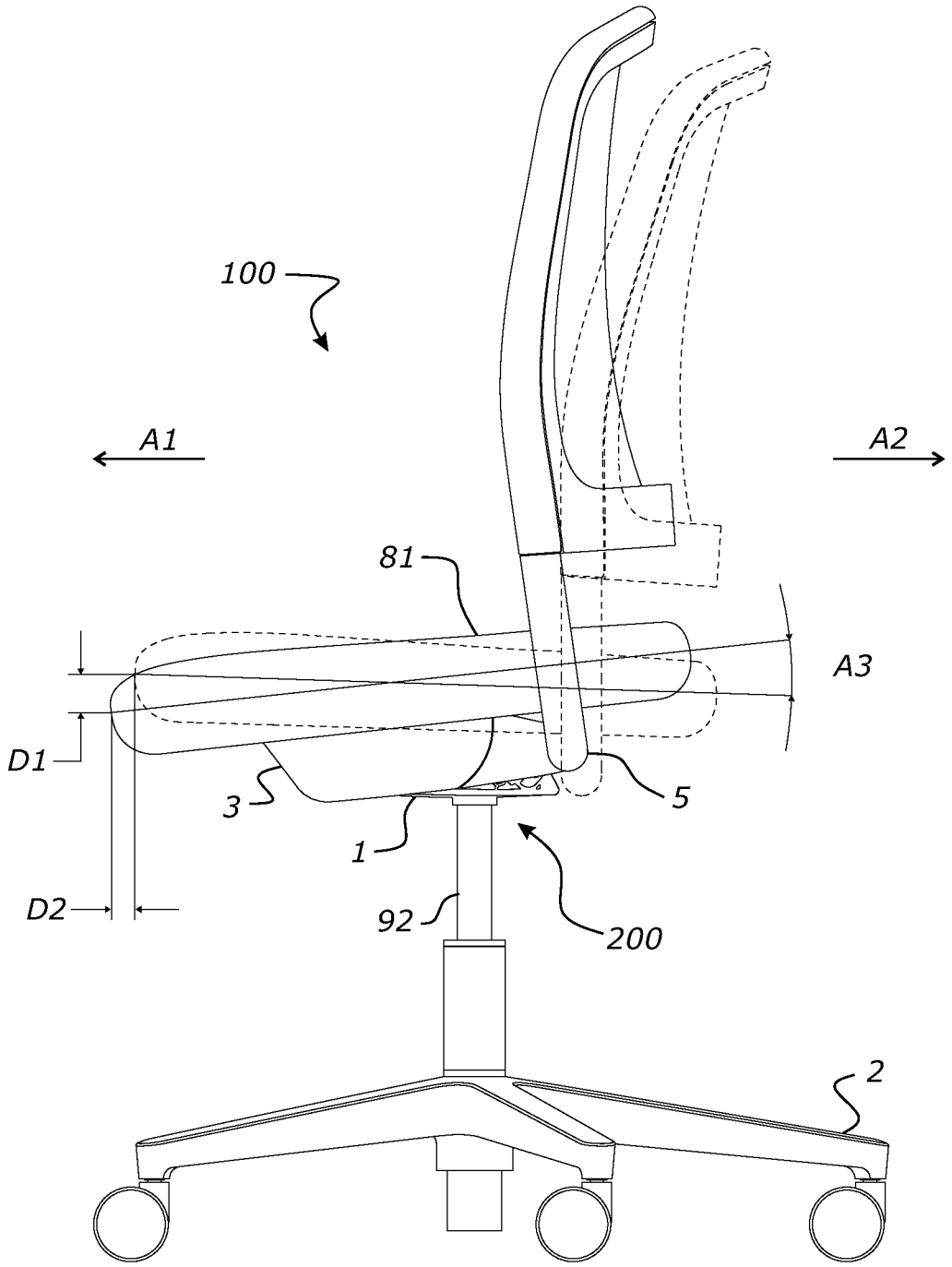
FIG. 3 shows a side view of the chair in its forward rocked position superimposed on a side view of the chair in its default position.

FIG. 2 shows the chair 100 in a forward rocked position and FIG. 3 shows the chair 100 in the forward rocked position superimposed on a 'ghost image' of the chair 100 in its default position of FIG. 1. The chair 100 moving from the default position to the forward rocked position moves a front portion of the seat support 3 downwardly and forwardly relative to its neutral position as shown in FIG. 3.

In one configuration, the chair 100 moving from the default position to the forward rocked position moves a front portion of the seat support 3 about 33 millimetres downwardly relative to its neutral position as indicated by displacement D1, and about 19 millimetres forwardly relative to its neutral position as indicated by displacement D2, as shown in FIG. 3. A front portion of the seat support 3 also tilts about 8 degrees downwardly relative to its neutral position as indicated by displacement A3 in FIG. 3.

Figure 4:
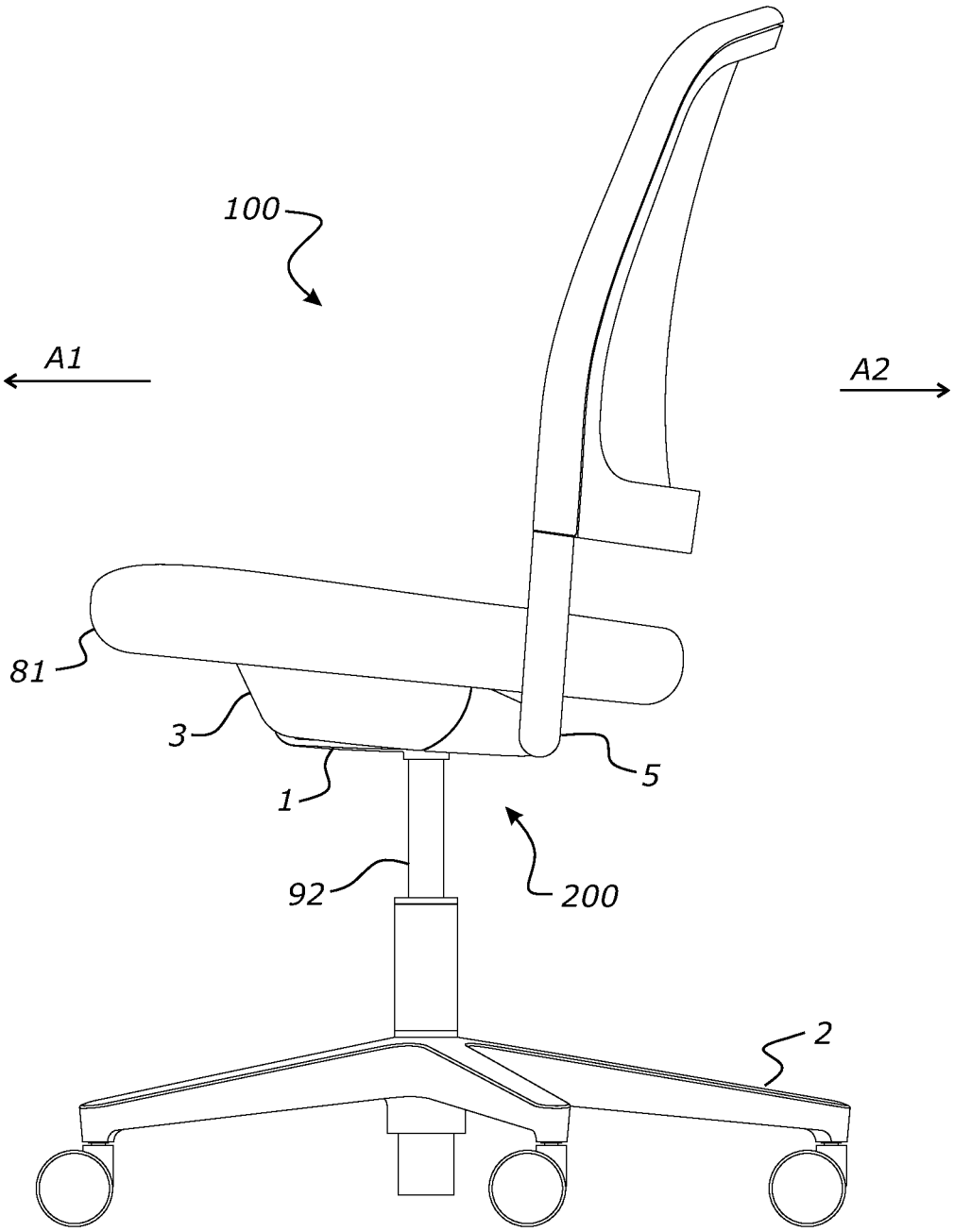
FIG. 4 shows a side view of the chair in its rear rocked position.
Figure 5:
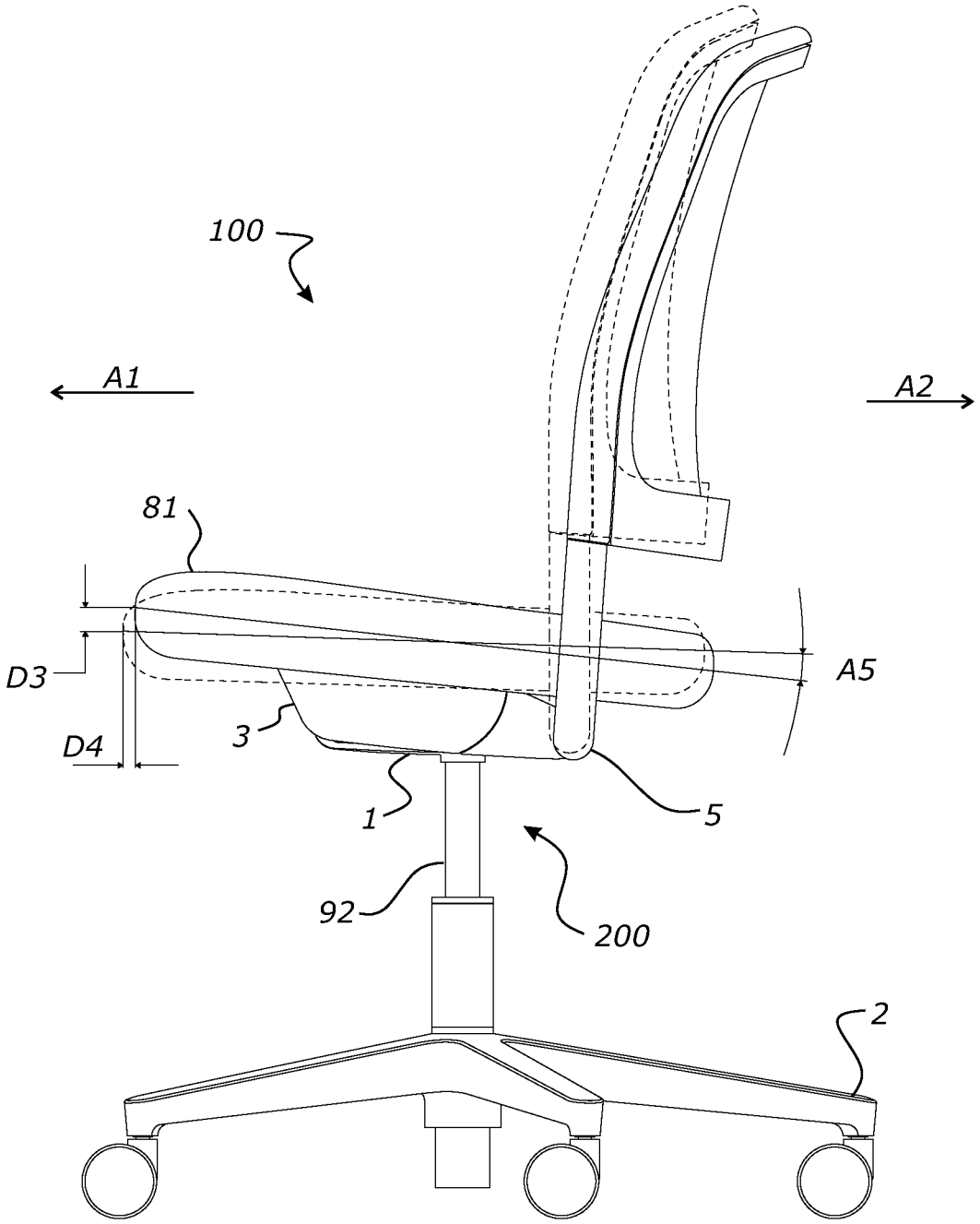
FIG. 5 shows a side view of the chair in its rear rocked position superimposed on a side view of the chair in its default position.

FIG. 4 shows the chair 100 in a rear rocked position and FIG. 5 shows the chair 100 in the rear rocked position superimposed on a 'ghost image' of the chair 100 in its default position of FIG. 1. The chair 100 moving from the default position to the rear rocked position moves a front portion of the seat support 3 upwardly and rearwardly relative to its neutral position as shown in FIG. 5.

In one configuration, the chair 100 moving from the default position to the rear rocked position moves a front portion of the seat support 3 about 17 millimetres upwardly relative to its neutral position as indicated by displacement D3, and about 10 millimetres rearwardly relative to its neutral position as indicated by displacement D4, as shown in FIG. 5. A front portion of the seat support 3 also tilts about 4 degrees upwardly relative to its neutral position as indicated by displacement A5 in FIG. 5.

FIGS. 2-5 show the back portion 5 moving with the seat support 3 such that it remains upright relative to the seat support 3, therefore, the seat support 3 can remain in its first at-rest position while also simultaneously moving to either the forward or rear rocked position or any other rocked position therebetween. However, the back portion 5 may not necessarily move with the seat support 3 and may remain in an upright position relative to the transom 1 during the rocking movement of the seat support 3 from its neutral position to the forward rocked position. In that case, the seat support 3 will not remain in its first at-rest position when moving to the forward rocked position because the back portion 5 has remained in an upright position relative to the transom 1 rather than in a generally vertical and generally perpendicular orientation relative to the seat support 3.

However, the back portion 5 may not remain in an upright position relative to the transom 1 when the seat support 3 moves from the neutral position to the rear rocked position. Instead, during a rocking movement of the seat support 3 from the neutral position to the rear rocked position, the back portion 5 will either remain in a generally vertical and generally perpendicular orientation relative to the seat support 3, or can be reclined rearwardly past a generally vertical and generally perpendicular orientation relative to the seat support 3.

Figure 6:
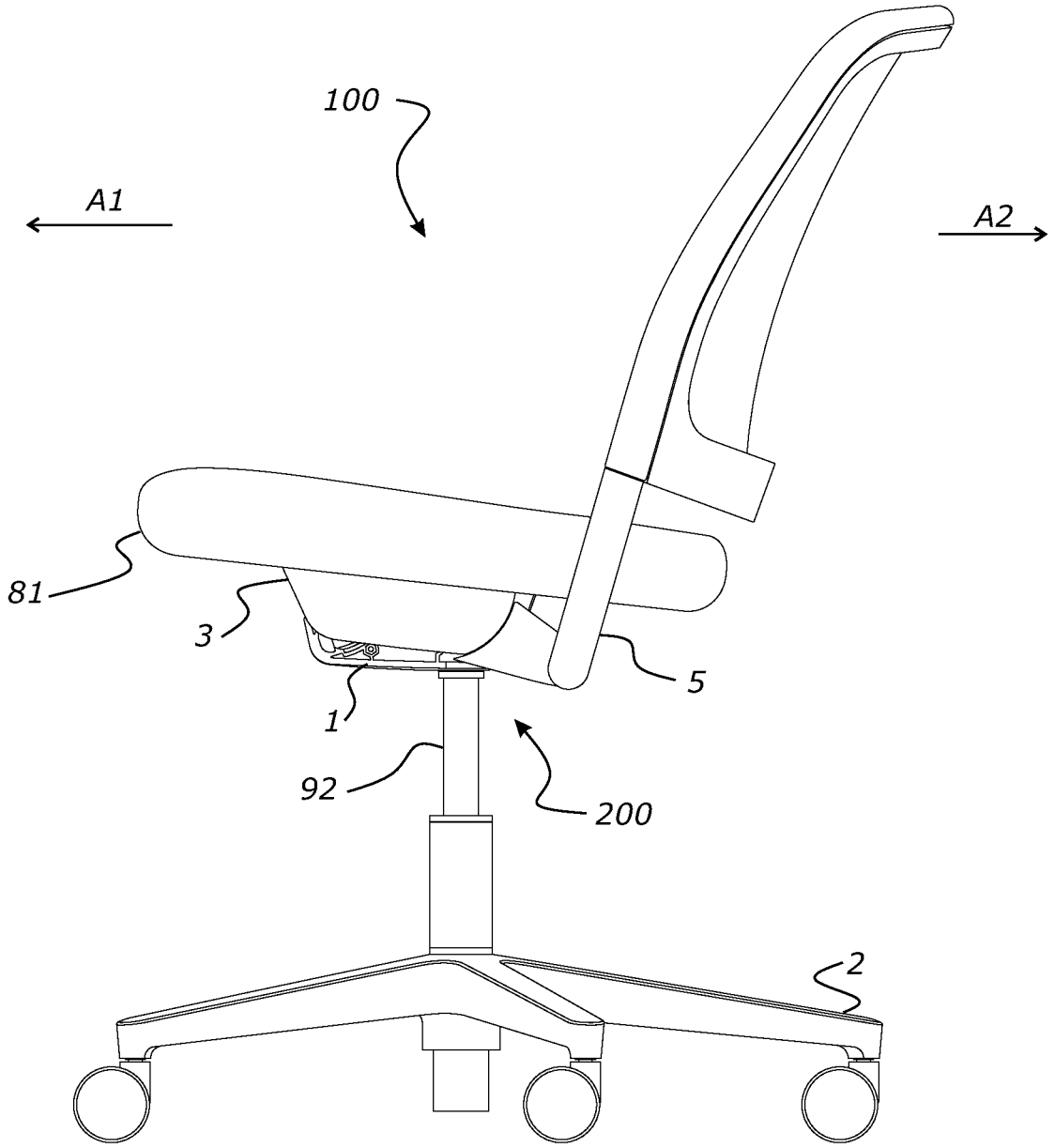
FIG. 6 shows a side view of the chair in its rearmost reclined position.
Figure 7:
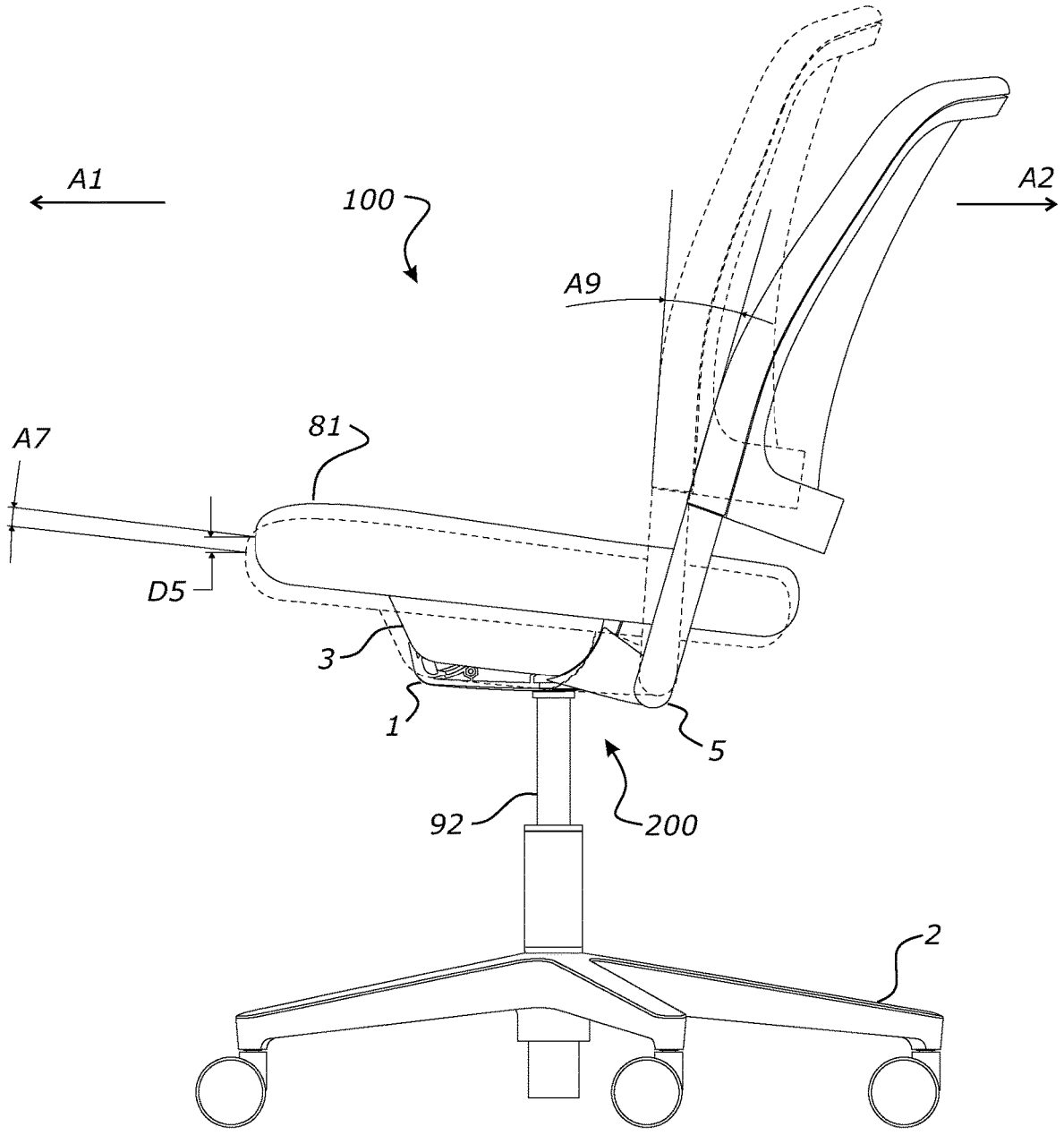
FIG. 7 shows a side view of the chair in its rearmost reclined position superimposed on a side view of the chair in its rear rocked position.

FIG. 6 shows the chair 100 in a rearmost reclined position and FIG. 7 shows the chair 100 the rearmost reclined position superimposed on a 'ghost image' of the chair 100 in its rear rocked position of FIG. 4. The chair 100 moving from the rear rocked position to the rearmost reclined position moves a front portion of the seat support 3 upwardly and tilts the front portion of the seat support 3 upwardly from its rear rocked position as shown in FIG. 7.

In one configuration, the chair 100 moving from the rear rocked position to the rearmost reclined position moves a front portion of the seat support 3 about 14 millimetres upwardly from its rear rocked position as indicated by displacement D5, and tilts the front portion of the seat support 3 about 0.5 degrees upwardly from its rear rocked position as indicated by displacement A7, as shown in FIG. 7. A front portion of the back portion 5 tilts about 12 degrees downwardly/rearwardly relative to the upright position of the back portion 5 relative to the seat support 3 as indicated by displacement A9 shown in FIG. 7.

It should be noted that FIGS. 6 and 7 show the seat support 3 moving with the back portion 5 to its rearmost reclined position from its rear rocked position as the back portion 5 is reclined rearwardly. However, the back portion 5 may be reclined rearwardly, or move to its reclined position, when the seat support 3 is in either of the forward or rear rocked positions or any other rocked position therebetween.

Therefore, if the back portion 5 is in a generally vertical and generally perpendicular orientation relative to the seat support 3, a front portion of the back portion 5 will tilt about 12 degrees downwardly/rearwardly irrespective of the position of the seat support 3. However, in use, a user shifting their weight to cause rearward recline of the back portion 5 will naturally occur in conjunction with a user shifting their weight such that the seat support 3 first moves to its rear rocked position, then shifting their weight further such that the seat support 3 continues to move from the rear rocked position to the rearmost reclined position as the back portion 5 moves to its reclined position. Therefore, the recline motion of the back portion 5 is a weight-compensated motion due to the upward shift in the user's centre of gravity upon the lifting of the seat support 3.

Figure 8:
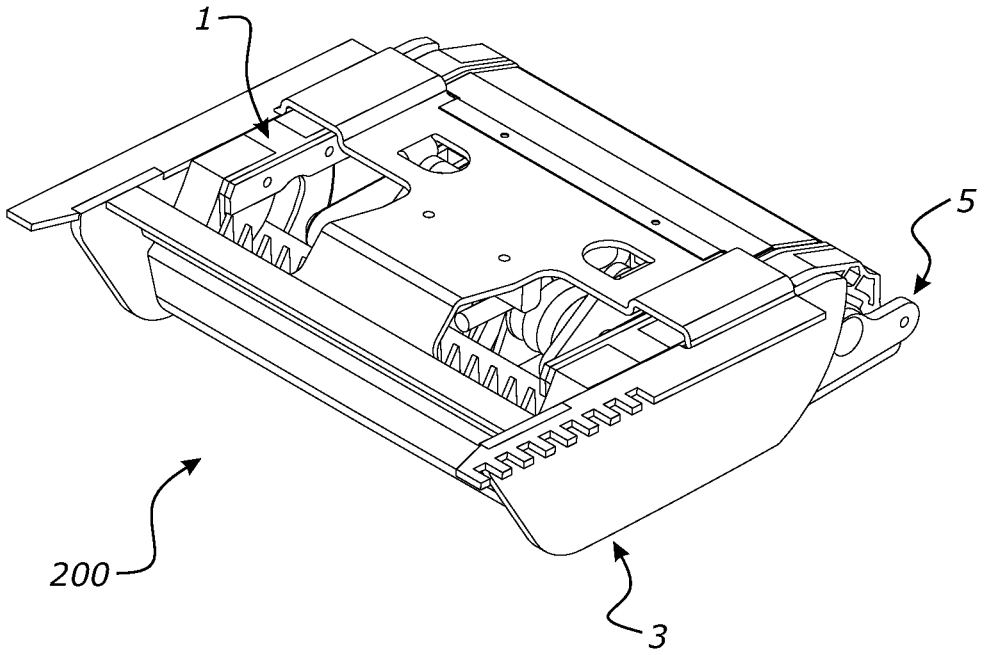
FIG. 8 shows a perspective view of the combined rock and recline mechanism assembly of the chair.

FIG. 8 shows the combined rock and recline mechanism assembly 200 when in its assembled state and default position. The combined rock and recline mechanism assembly 200 comprises the transom 1, the seat support 3, the back portion 5.

Note that for illustrative purposes, the entirety of the transom 1, seat support 3 and back portion 5 may not be shown in FIGS. 8-21C and 31-35.

Figure 9:
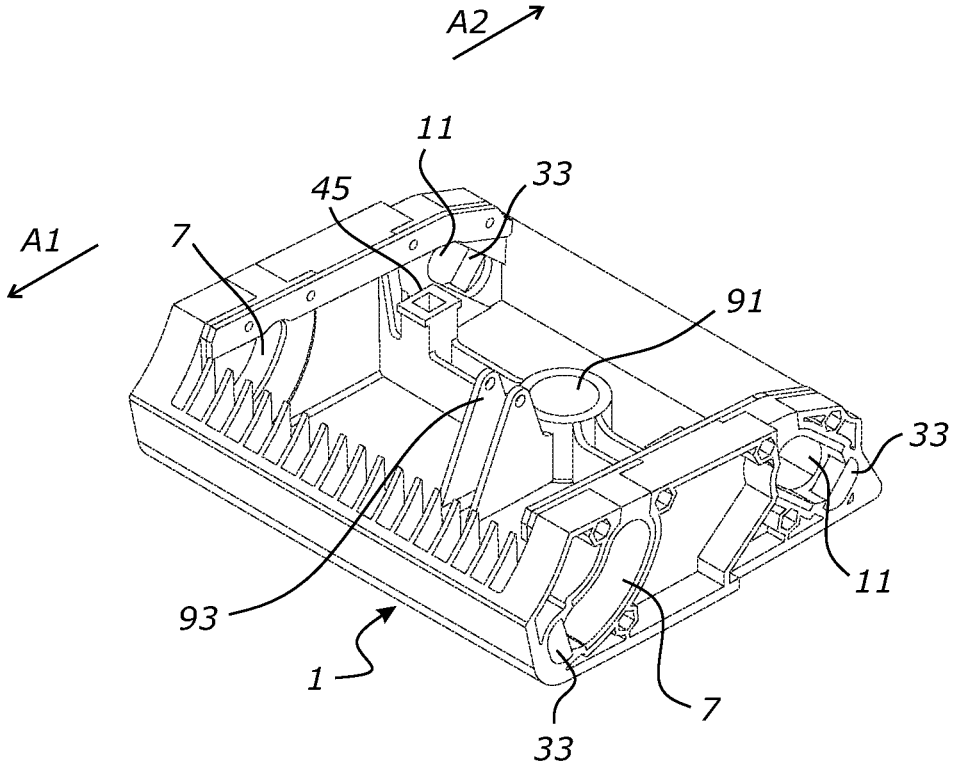
FIG. 9 shows a perspective view of the transom of the combined rock and recline mechanism assembly of the chair.
Figure 10:
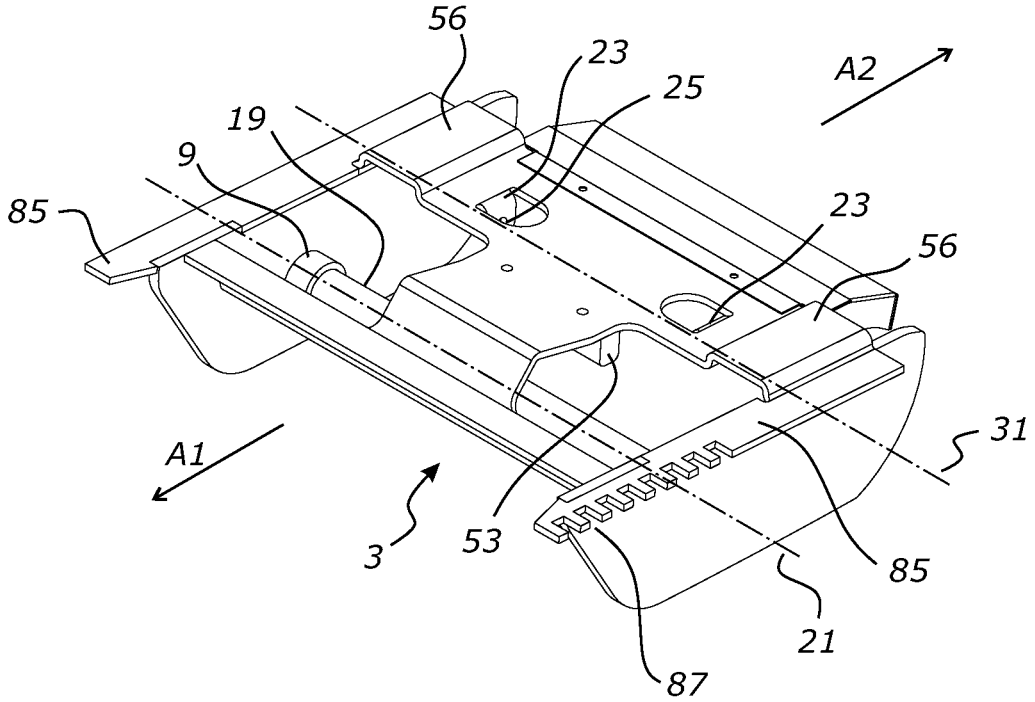
FIG. 10 shows a perspective view of the seat support of the combined rock and recline mechanism assembly of the chair.
Figure 11:
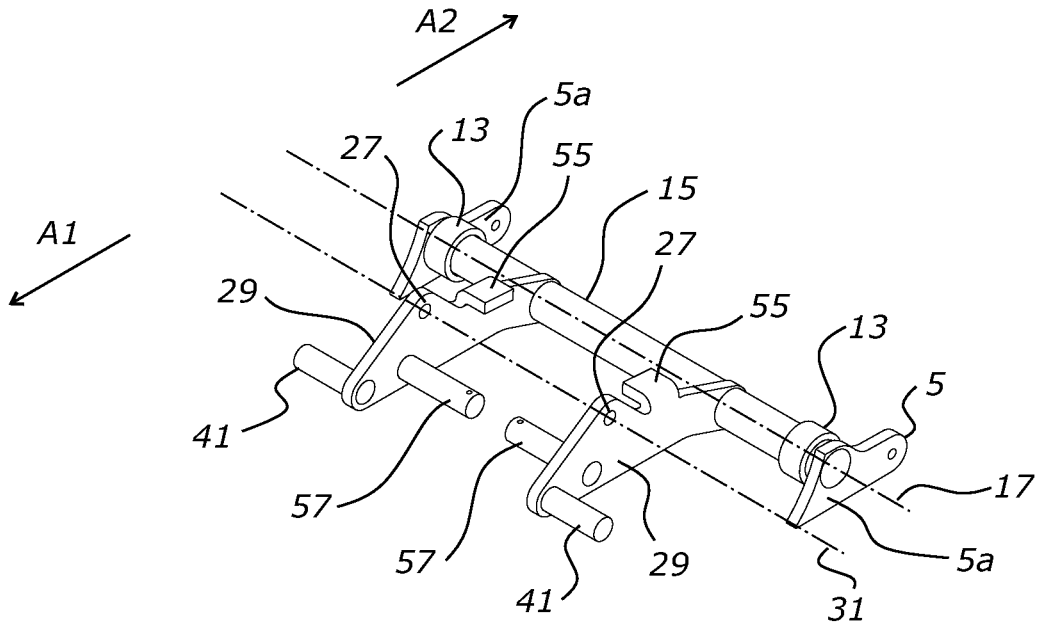
FIG. 11 shows a perspective view of the back portion of the combined rock and recline mechanism assembly of the chair.

FIGS. 9, 10 and 11 respectively show the transom 1, seat support 3 and back portion 5 individually isolated from other components of the combined rock and recline mechanism assembly 200. The combined rock and recline mechanism assembly 200 also comprises a biasing arrangement 300 as well as an optional height-adjust lever 10 shown isolated in FIG. 12 from other components of the combined rock and recline mechanism assembly 200.

Figure 14:
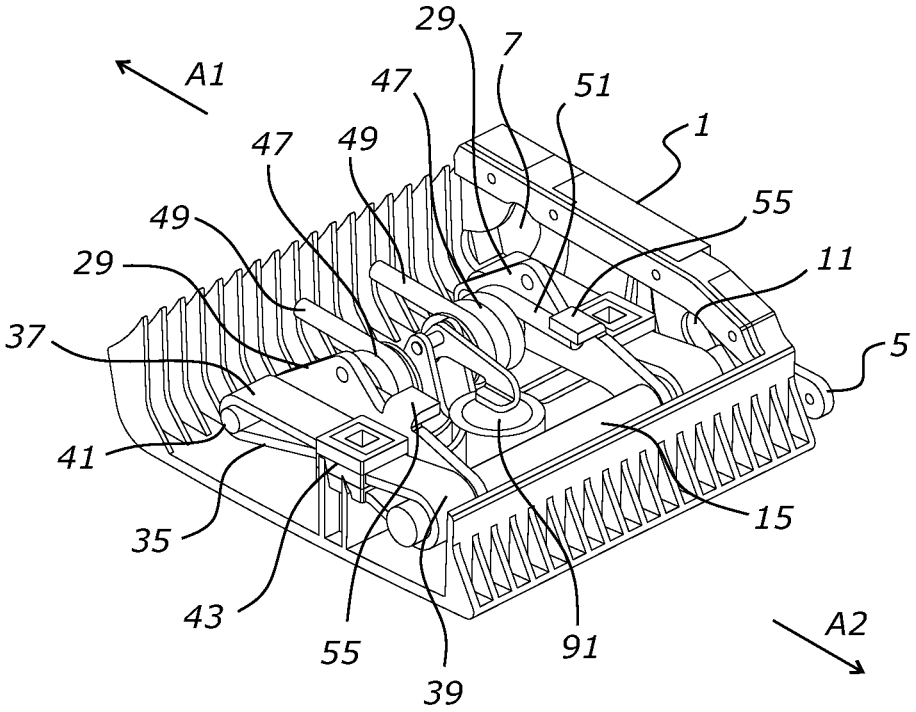
FIG. 14 shows a cross-sectional perspective view of the combined rock and recline mechanism assembly of the chair with the seat support hidden.
Figure 15:
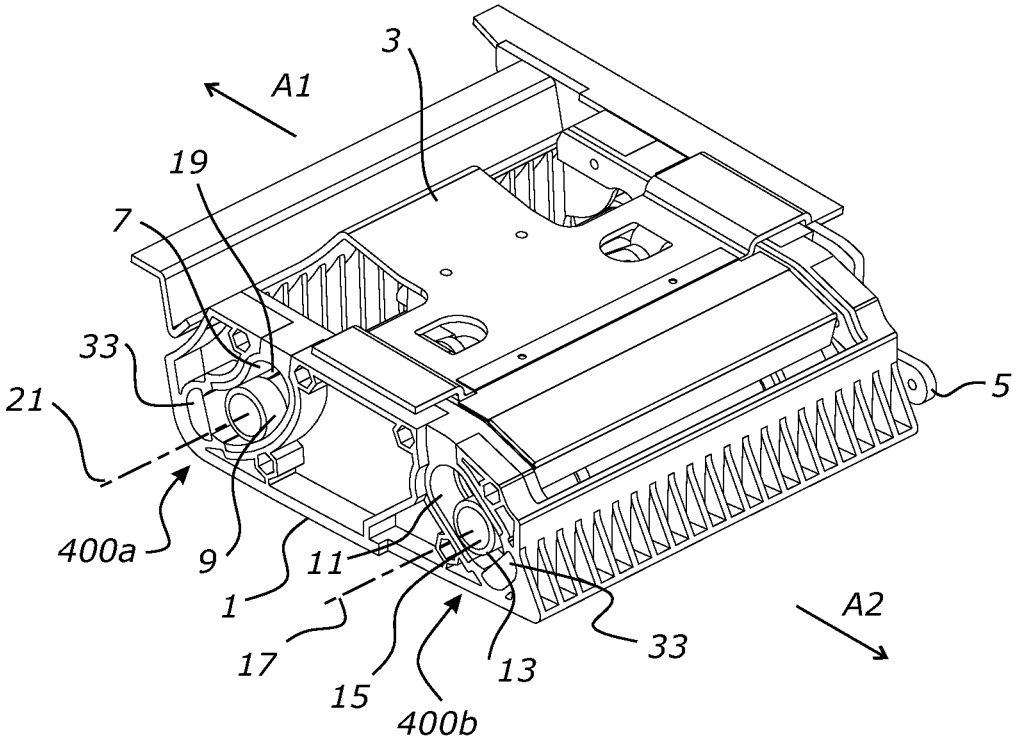
FIG. 15 shows a cross-sectional perspective view of the combined rock and recline mechanism assembly of the chair showing the front and rear rocking arrangements when the chair is in its default position.

FIG. 13 shows an exploded view of the combined rock and recline mechanism assembly 200 and how the various components therein are operatively coupled to or engaged with one another. FIG. 14 shows a cross sectional view of the combined rock and recline mechanism assembly 200 in its assembled state with the seat support 3 hidden. These FIGS. 10-14 will be referred to throughout the below description of the functionality of the combined rock and recline mechanism assembly 200.

FIGS. 15 and 16A-16C shows a cross sectional view of the combined rock and recline mechanism assembly 200 showing the front and rear rocking arrangements 400*a*, 400*b*. The front rocking arrangement 400*a* comprises a front track 7 located on the transom 1 and a front engagement component 9 operatively connected to the seat support 3 and received within the front track 7 for movement of the front engagement component 9 within the front track 7. The rear rocking arrangement 400*b* comprises a rear track 11 located on the transom 1 and a rear engagement component 13 operatively connected to the back portion 5 and received within the rear track 11 for movement of the rear engagement component 13 within the rear track 11.

In the configuration shown in FIGS. 8-21C, and as described in this specification, the front and rear engagement components 9, 13 are shown taking the form of front and rear rollers 9, 13. These front and rear rollers 9, 13 can be any formed of any suitable bearing such as a ball-bearing, needle-roller bearing or plain bearing for example.

The configuration of FIGS. 15 and 16A-16C show the front rocking arrangement 400*a* comprising a pair of front tracks and rollers 7, 9 that are spaced apart along a width of the transom 1 and provided on side walls of the transom 1. The rear rocking arrangement 400*b* is shown comprising a pair of rear tracks and rollers 11, 13 also spaced apart along a width of the transom 1 and provided on side walls of the transom 1. However, in alternative embodiments, the front rocking arrangement 400*a* may comprise only a single front track 7 and single front roller 9 provided on either side wall of the transom 1 or within a central internal wall of the transom 1. Likewise, the rear rocking arrangement 400*b* may comprise only a single rear track 11 and single rear roller 13 provided on either side wall of the transom 1 or within a central internal wall of the transom 1. Alternatively, the front and rear rocking arrangements could each have three or more tracks and rollers.

As shown in FIG. 11, the back portion 5 comprises a rear axle member 15 and the rear roller 13 is rotatably mounted on the rear axle member 15 such that the rear axle member 15 defines a substantially horizontal transverse rear pivot axis 17 that is movable relative to the transom 1 upon rocking of the seat support 3 and back portion 5 and about which the back portion 5 can pivot.

Spaced apart back arms 5*a* are provided at or adjacent each end of the rear axle member 15.

As shown in FIG. 10, the seat support 3 comprises a front axle member 19 and the front roller 9 is rotatably mounted on the front axle member 19 such that the front axle member 19 defines a substantially horizontal transverse front pivot axis 21 that is movable relative to the transom 1 and about which the seat support 3 can pivot.

In some configurations the front and rear engagement components 9, 13 may not comprise rollers but may instead comprise axle member liner components that are received by the front and rear tracks 7, 11. The axle member liner components may be fixedly mounted to the front and rear axle members 19, 15 and may be self-lubricating so as to provide a smooth translational and rotational movement of the front and rear engagement components 9, 13, and thus front and rear axle members 19, 15, within the front and rear tracks 7, 11.

Alternatively, the front and rear engagement components 9, 13 may be integrally formed with the front and rear axle members 19, 15 such that the front and rear axle members 19, 15 comprise a smooth surface that is received by the front and rear tracks 7, 11 for smooth translational and rotational movement of the front and rear axle members 19, 15, within the front and rear tracks 7, 11. The smooth surface of the front and rear members 19, 15 may be self-lubricating.

In some configurations, the front and rear tracks 7, 11 may also be provided with liner components along a peripheral internal edge of the front and rear tracks 7, 11 so as to contribute to a smooth translational and rotational movement of the front and rear engagement components 9, 13 and front and rear axle members 19, 15, within the front and rear tracks 7, 11.

With reference to FIG. 10, the seat support 3 comprises a pair of spaced-apart downwardly extending flanges 23 with apertures 25 that, when the combined rock and recline mechanism assembly 200 is in its assembled state, coincide and align with apertures 27 provided on spaced apart flanges 29 of the back portion 5 such that separate bolts, rivets or any other suitable connecting components (not shown) pass through the apertures 25, 27 to define a substantially horizontal transverse central pivot axis 31 that is movable relative to the transom 1. Therefore, the connecting components (not shown) allow the back portion 5 and the seat support 3 to be pivotally coupled to one another at the central pivot axis 31 without being physically connected to one another. The spaced apart flanges 29 of the back portion 5 are shown extending from the rear axle member 15 in FIG. 11.

Movement of the back portion 5 relative to the transom 1 is defined or constrained by pivoting of the back portion 5 about both the rear and central pivot axes 17, 31 together with translational movement of the rear axle member 15 and rear roller 13 (and thus rear pivot axis 17) in the rear track 11. Likewise, movement of the seat support 3 relative to the transom 1 is defined or constrained by pivoting of the seat support 3 about both the front and central pivot axes 21, 31 together with translational movement of the front axle member 19 and front roller 9 (and thus front pivot axis 21) in the front track 7. As such, any change in position of either of the seat support 3 or the back portion 5 causes a change in position of the central pivot axis 31 relative to the transom 1 thereby causing a corresponding change in position of the other of the seat support 3 or the back portion 5.

Figure 16A:
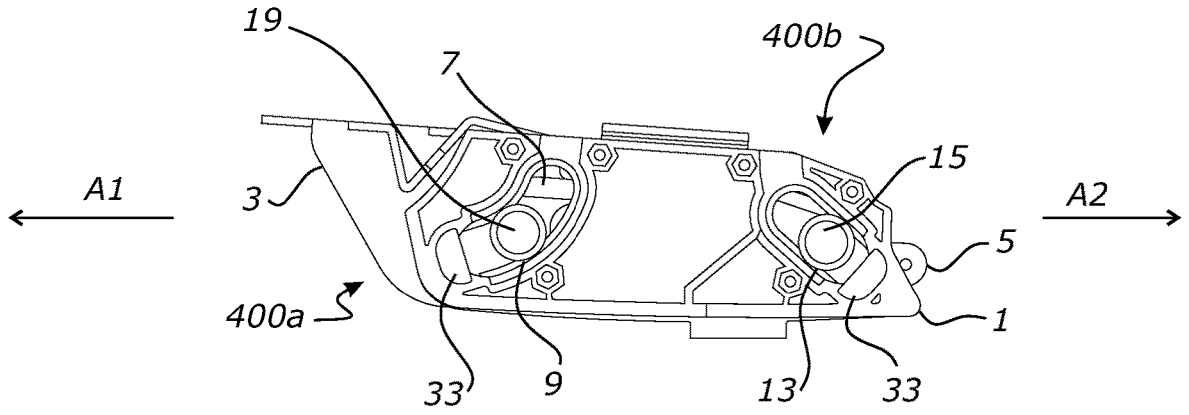
FIG. 16A shows a cross-sectional side view of the combined rock and recline mechanism assembly of the chair showing the front and rear rocking arrangements when the chair is in its default position.
Figure 16B:
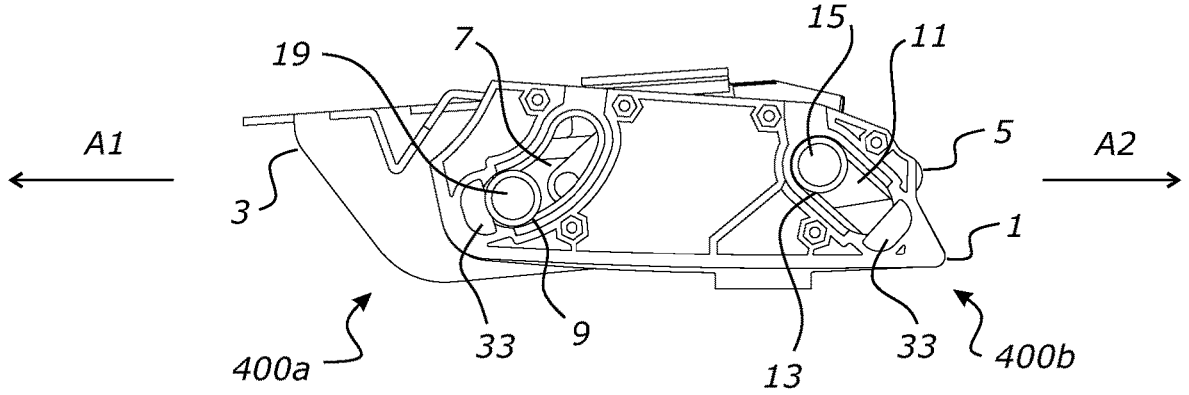
FIG. 16B shows a cross-sectional side view of the combined rock and recline mechanism assembly of the chair showing the front and rear rocking arrangements when the chair is in its forward rocked position.
Figure 16C:
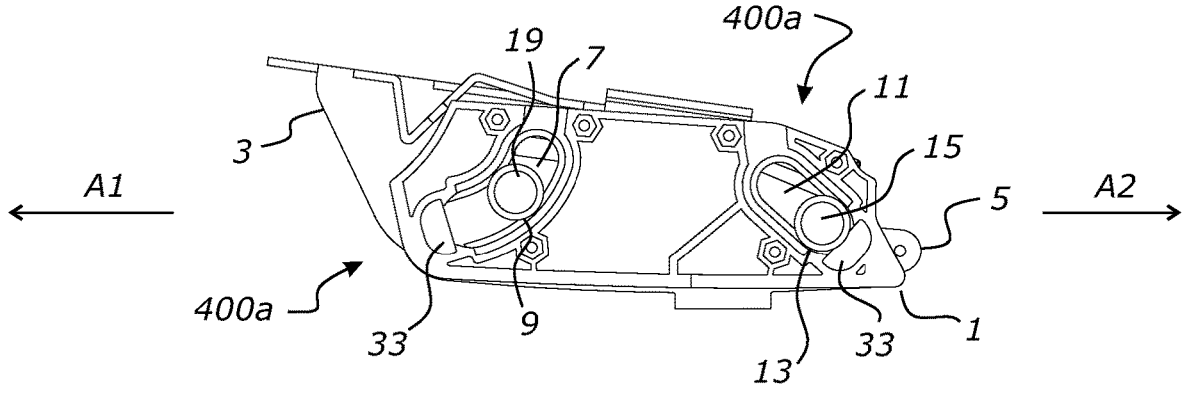
FIG. 16C shows a cross-sectional side view of the combined rock and recline mechanism assembly of the chair showing the front and rear rocking arrangements when the chair is in its rear rocked position.

This is shown in FIGS. 16A-16C in which the change in position of the front and rear rollers and axle members 9, 13, 15, 19 is shown for the forward rocked, rear rocked and neutral positions.

In FIG. 16A, both the seat support 3 and back portion 5 are in their neutral positions relative to the transom 1, therefore, the front and rear rollers and axle members 9, 13, 15, 19 are positioned relatively centrally within the front and rear tracks 7, 11.

FIG. 16B shows both the seat support 3 and back portion 5 in the forward rocked position in which the front and rear rollers and axle members 9, 13, 15, 19 are positioned at the frontmost extremes of the front and rear tracks 7, 11.

Figure 17:
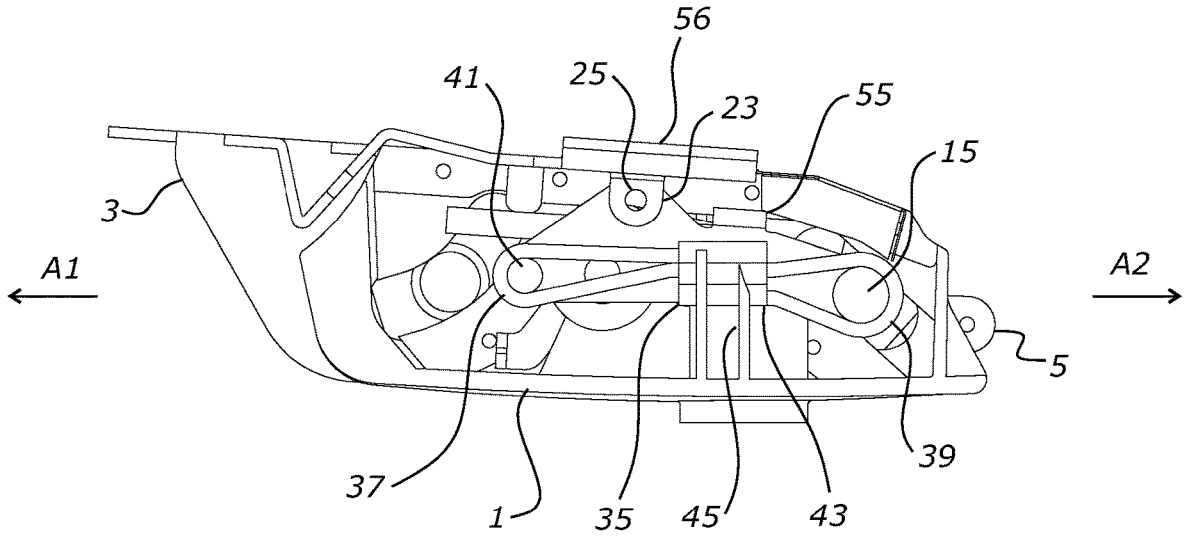
FIG. 17 shows a cross-sectional side view of the combined rock and recline mechanism assembly of the chair showing the at least one first biasing device when the chair is in its default position.

Finally, FIG. 16C shows both the seat support 3 and back portion 5 in their rear rocked positions in which the rear roller and axle member 13, 19 are positioned at the rearmost extremes of the rear track 11 and the front roller and axle member 9, 15 are positioned rearward of their neutral position shown in FIG. 17, proximal to the rearmost extreme of the front track 7.

FIGS. 9, 15 and 16A-16C also show compliant stops 33 positioned at the frontmost extreme of the front track 7 and at the rearmost extreme of the rear track 11 such that when a user shifts the chair 100 to either of the frontmost or rearmost rocked position they do not experience a harsh or sudden impact.

The compliant stops may comprise an elastomeric material such as natural or synthetic rubber for example.

To assist in proving a smooth and comfortable rocking action, the biasing arrangement 300 comprises at least one first biasing device fixed to the transom 1 and configured to exert a first biasing force that biases the seat support 3 and back portion 5 to return towards their neutral positions of FIG. 16A.

Figure 12:
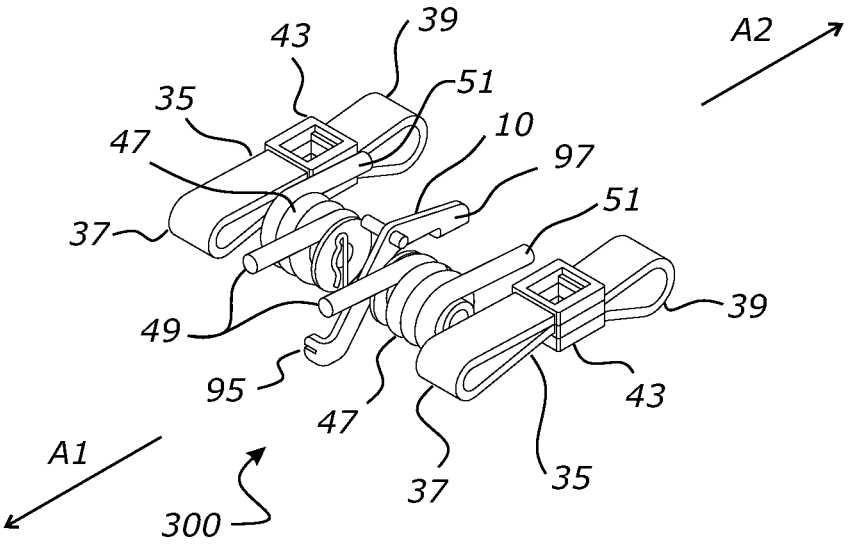
FIG. 12 shows a perspective view of the biasing arrangement of the combined rock and recline mechanism assembly of the chair.

This at least one first biasing device is shown in FIGS. 12-14 and, in the form shown, comprises a pair of rocking springs 35. There could, alternatively, be one rocking spring 35. The rocking spring(s) 35 is/are composed of a single uniform piece of any suitable elastomeric or resilient material having a front portion 37 and a rear portion 39.

The rear portion(s) 39 of the rocking spring(s) 35 loop(s) around or receive(s) the rear axle member 15 of the back portion 5, and the front portion(s) 37 of the rocking spring(s) 35 loop(s) around or receive(s) front protrusion(s) 41 that extend from the spaced apart flanges 29 of the back portion 5. Central portion(s) 43 of the rocking spring(s) 35 is/are fixedly mounted upon spring post(s) 45 that extend(s) upwardly from a lower surface of the transom 1, as shown in FIGS. 9, 13 and 14. Generally, the front protrusion(s) 41 of the back portion 5 are located forward of the spring post(s) 45 of the transom 1.

This is best shown in FIG. 17, in which the chair 100 is in its default position and thus the seat support 3 and back portion 5 are in their neutral positions relative to the transom 1. In this state, the rocking spring(s) 35 do not exert a first biasing force as neither the front nor rear portion(s) 37, 39 of the spring(s) 35 are stretched from their resting state. Instead, the rocking spring(s) 35 may only exert a pre-load biasing force that maintains the neutral positions of the seat support 3 and back portion 5 relative to the transom 1.

Figure 18:
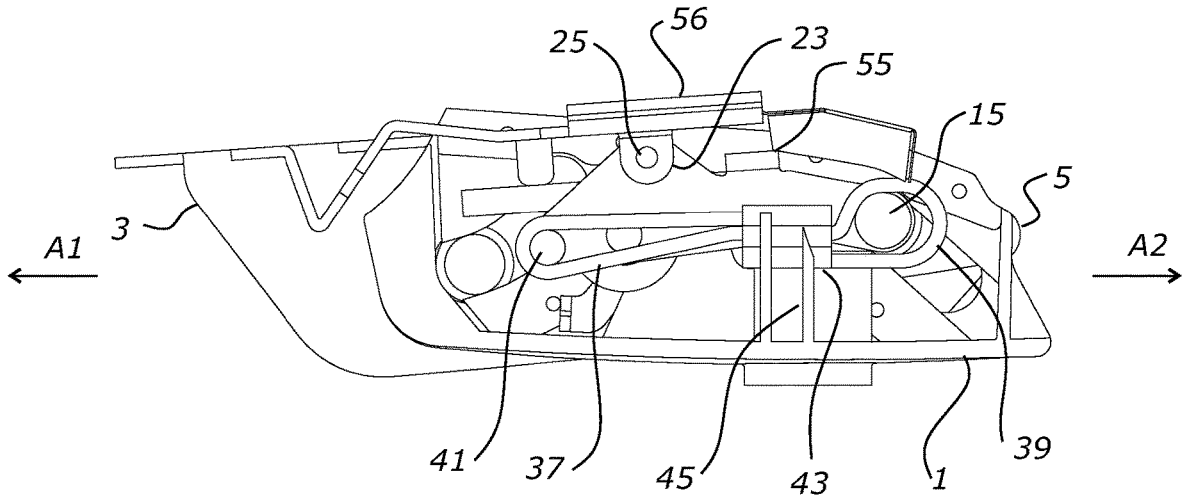
FIG. 18 shows a cross-sectional side view of the combined rock and recline mechanism assembly of the chair showing the at least one first biasing device when the chair is in its forward rocked position.

However, when the chair 100 is rocked forward from its default position, say towards the forward rocked position as shown in FIG. 18, the front portion(s) 37 of the rocking spring(s) 35 will extend or stretch forwardly as the front protrusion(s) 41 move forward relative to the transom 1, whereas the rear portion(s) 39 of the rocking springs 35 slacken. The forward stretching of the front portion(s) 37 naturally causes an opposite and equal reaction which produces a first biasing force in a rearward direction that causes the back portion 5, and thus the seat support 3, to be biased rearwardly back to the neutral position.

Figure 19:
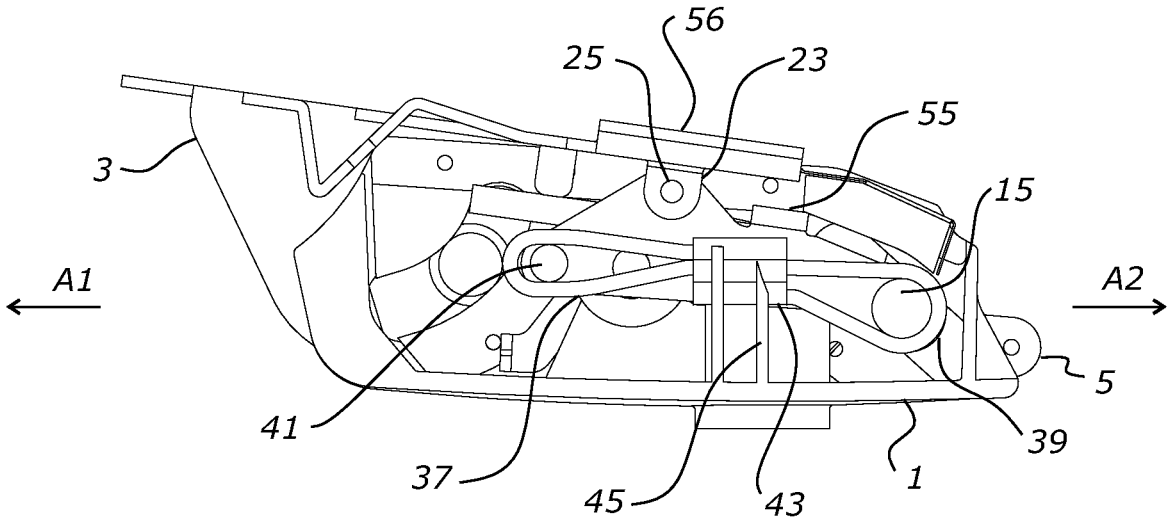
FIG. 19 shows a cross-sectional side view of the combined rock and recline mechanism assembly of the chair showing the at least one first biasing device when the chair is in its rear rocked position.

The opposite occurs when the chair 100 is rocked rearward from its default position, say towards the rear rocked position as shown in FIG. 19. The rear portion(s) 39 of the rocking spring(s) 35 will extend or stretch rearwardly as the rear axle member 15 moves rearward relative to the transom 1, whereas the front portion(s) 37 of the rocking spring(s) 35 goes slack. The rearward stretching of the rear portion(s) 39 naturally causes an opposite and equal reaction which produces a first biasing force in a forward direction that causes the back portion 5, and thus the seat support 3, to be biased forwardly back to the neutral position.

Thus, any rocking motion of the chair 100 requires a user to overcome this first biasing force, thereby providing an intuitive and comfortable rocking motion to the user.

Figure 20:
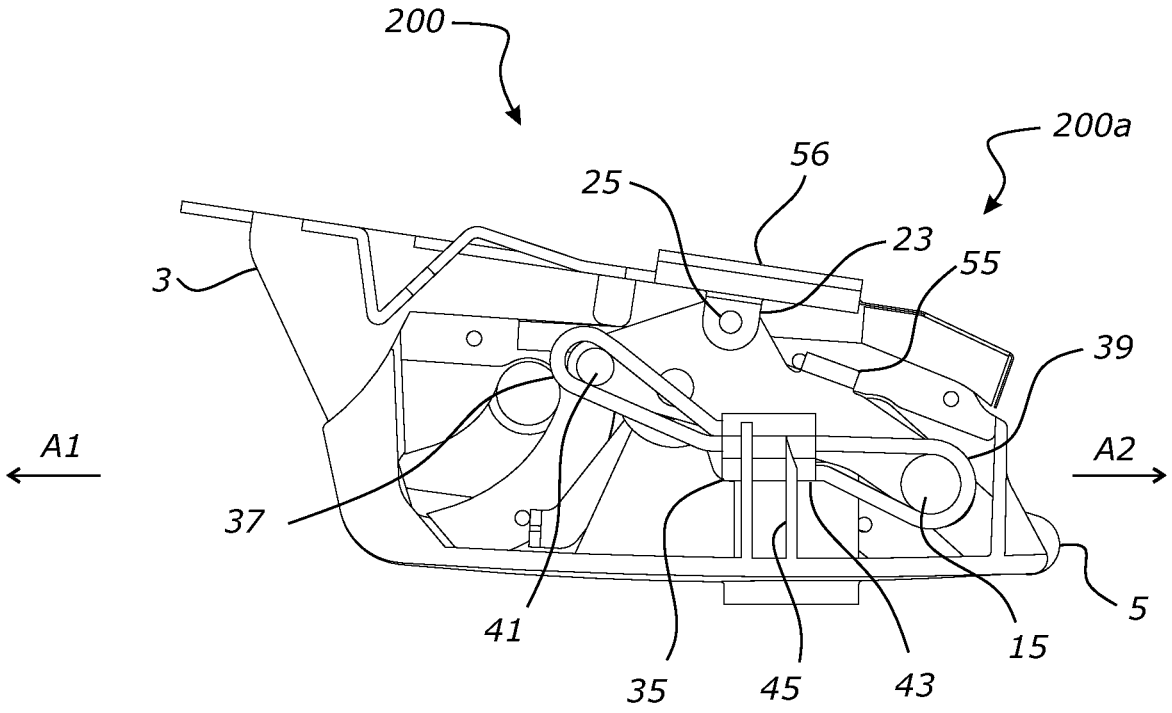
FIG. 20 shows a cross-sectional side view of the combined rock and recline mechanism assembly of the chair showing the at least one first biasing device when the chair is in its rearmost reclined position.

FIG. 20 shows the combined rock and recline mechanism 200 when the chair 100 in its rearmost reclined position. Because the rear axle member 15 is already at the rearmost extreme of the rear track 11 when in the rear rocked position, the rear portion(s) 39 of the rocking spring(s) 35 will not stretch any further when the chair 100 moves from the rear rocked position to the rearmost reclined position. Therefore, the rocking spring(s) is/are generally unaffected by a recline of the back portion 5 if the rocked position of the seat support 3 and back portion 5 are not changed.

In some embodiments, the rocking spring(s) 35 may have front and rear portion(s) that do not loop around or receive the front protrusion(s) 41 or rear axle member 15 but may instead be simply coupled to the front protrusion(s) 41 or rear axle member 15 by any suitable fastening arrangement. Further, the front and rear portion(s) may not connect to the front protrusion(s) 41 or rear axle member 15 but may instead connect to any other suitable portions of the back portion 5 in substantially the same position or proximal to the front protrusion(s) 41 or rear axle member 15.

Thus, the at least one first biasing device is intended to assist in providing a smooth and comfortable rocking action as described above, rather than to act against a recline motion of the chair 100.

Instead, to assist in a smooth and comfortable reclining action, the biasing arrangement 300 comprises at least one second biasing device that is configured to exert a second biasing force between the back portion 5 and the seat support 3 to inhibit a change in an angular position of the back portion 5 relative to an angular position of the seat support 3 such that the back portion 5 is biased towards the upright position relative to the seat support 3 thereby biasing the seat support 3 to its first at-rest position.

The at least one second biasing device is shown in FIGS. 12-14 and comprises a pair of torsion springs 47. There could, alternatively, be one torsion spring 47 or three or more torsion springs 47. The torsion spring(s) 47 is/are essentially composed of a single uniform winding of any suitable spring material such as spring steel having a forwardly extending arm 49 and a rearwardly extending arm 51.

The forwardly extending arm(s) 49 contacts and engages with a downwardly extending protrusion 53 of the seat support 3. The rearwardly extending arm(s) 51 contacts and engages with a pair of inwardly extending flange(s) 55 of the back portion 5. The torsion spring(s) 47 are fixedly mounted to the back portion 5 such that the internal void(s) 47*a*, shown in FIG. 13, formed by the winding(s) of the torsion spring(s) 47 receive a pair of inwardly extending protrusion(s) 57. These protrusion(s) 57 extend inwardly from the spaced apart flanges 29 of the back portion 5 at a location between the front protrusion(s) 41 and the central pivot axis 31.

Figure 21A:
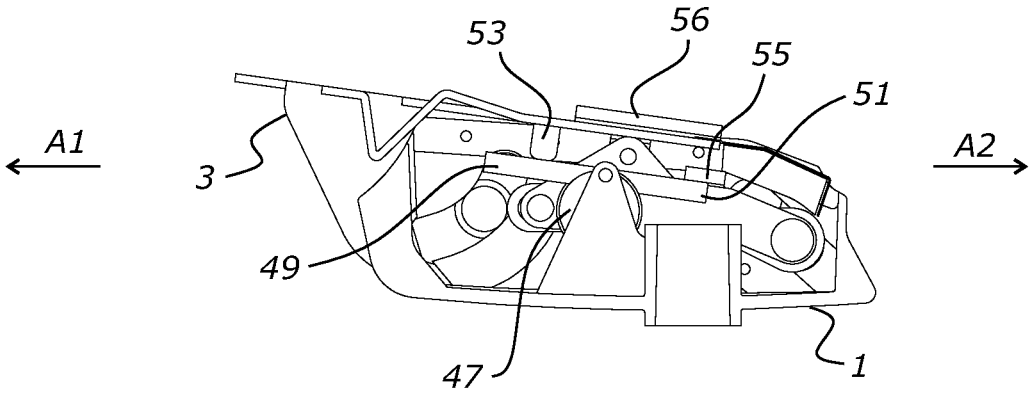
FIG. 21A shows a cross-sectional side view of the combined rock and recline mechanism assembly of the chair showing the at least one second biasing device when the chair is in its rear rocked position.

This is best shown in FIG. 21A, in which the chair 100 is in its rear rocked position and the back portion 5 is in an upright orientation relative to the seat support 3. In this state, the torsion spring(s) 47 do not exert any second biasing force as neither the forwardly or rearwardly extending arms 49, 51 are bent away from their resting state in which they are substantially aligned along a horizontal axis relative to the torsion spring(s) 47. Instead, the torsion spring(s) 47 may only exert a pre-load biasing force that maintains the back portion 5 in its upright position relative to the seat support 3 and thus maintains the seat support 3 in its first at-rest position.

Figure 21B:
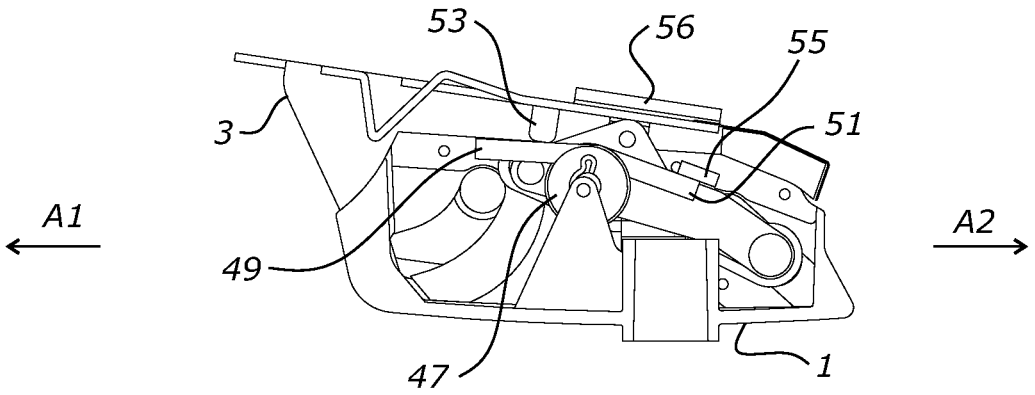
FIG. 21B shows a cross-sectional side view of the combined rock and recline mechanism assembly of the chair showing the at least one second biasing device when the chair is in its rearmost reclined position.

However, when the back portion 5 is reclined, for instance, when the chair 100 is moved from the rear rocked position to the rearmost reclined position as shown in FIG. 21B, a front end of the forwardly extending arm(s) 49 bend/s downwardly and a rear end of the rearwardly extending arm(s) 51 bend/s downwardly as the angular position of the back portion 5 relative to an angular position of the seat support 3 changes. This bending causes an opposite reaction in the torsion spring(s) 47 which produces a second biasing force that works to return the forwardly and rearwardly extending arms 49, 51 to their resting state and thus works to undo the change in angular position of the back portion 5 relative to the angular position of the seat support 3.

Soft stop(s) (not shown) may be provided between an upper surface of the inwardly extending flange(s) 55 of the back portion 5 and a lower surface of stop plates 56 of the seat support 3. The soft stop(s) is/are configured to limit movement of the back portion relative to the seat support 3. In particular, when the seat support 3 is in the first at-rest position, the angular position of the seat support 3 and back portion 5 cannot be adjusted so as to cause a forward portion of the back portion 5 to tilt downwardly past its upright-related position relative to the seat support 3 and a forward portion of the seat support 3 to tilt upwardly past its first at-rest position thereby impinging on a user of the chair 100. The soft stop(s) may be made on any suitable elastomeric or resilient material such as natural or synthetic rubber.

Thus, any reclining motion of the back portion 5 requires a user to overcome this second biasing force, in addition to the pre-load biasing force, thereby providing an intuitive and comfortable reclining motion to the user.

Figure 21C:
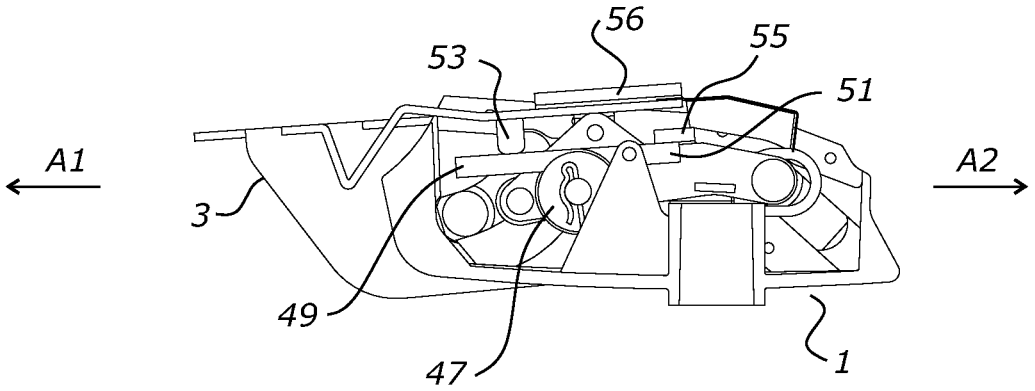
FIG. 21C shows a cross-sectional side view of the combined rock and recline mechanism assembly of the chair showing the at least one second biasing device when the chair is in its forward rocked position.

FIG. 21C shows the chair 100 in its forward rocked position. Because the back portion is upright relative to the seat support 3, or in other words, because the back portion 5 has not been reclined in this position, the forwardly and rearwardly extending arms 49, 51 are not bent and remain in their resting state. Therefore, no second biasing force is produced by the torsion spring(s) 47. Thus, the torsion spring(s) 47 are generally unaffected by a rocking of the seat support 3 as long as the angular position of the back portion 5 relative to an angular position of the seat support 3 remains the same, or in other words, as long as the back portion 5 is not reclined from the upright orientation relative to the seat support and thus the forwardly and rearwardly extending arms 49, 51 remain in their resting state.

Thus, the at least one second biasing device is namely intended to assist in providing a smooth and comfortable reclining action as described above, rather than to act against a rocking motion of the chair 100.

Next, the shape of the front and rear tracks 7, 11, the change in position of the rear, front and central pivot axes 17, 21, 31 during rocking and recline movements, and the ensuing virtual rocking path 63 will be described with reference to FIGS. 22-30.

Figure 22:
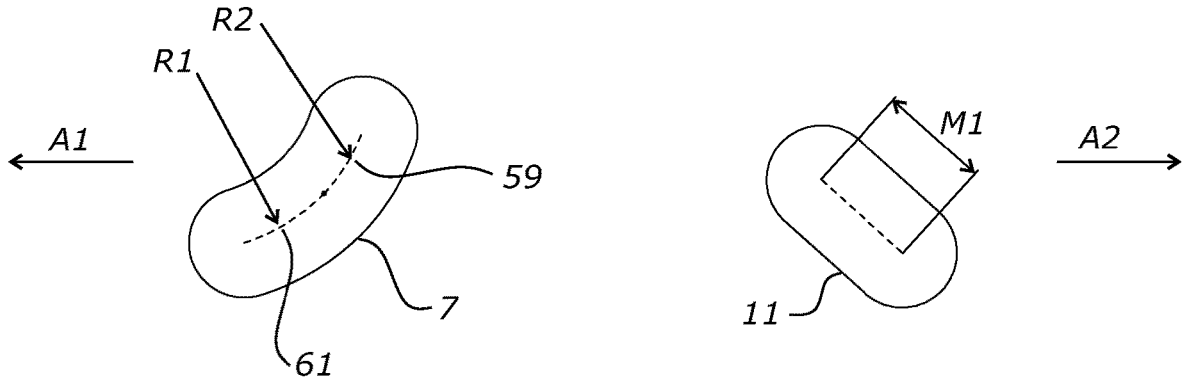
FIG. 22 shows a schematic side view of the front and rear tracks of the chair.

FIG. 22 shows the front track 7 and the rear track 11. A forward end of the front track 7 is positioned forward of, and lower than, a rear end of the front track 7. A forward end of the rear track 11 is positioned forward of, and higher than, a rear end of the rear track 11.

In the form shown, the front track has a curved path and the rear track 11 having a substantially straight path.

The curvature of the front track 7 may take any suitable form; however, a rear portion 59 of the front track 7 generally has a smaller radius of curvature than a front portion 61 of the front track 7 such that the curved path of the front track 7 increases in steepness from the front portion 61 to the rear portion 59. This means that movement of the front roller 9 within the front track 7 from the front edge of the rear portion 59 to the rear edge of the front track 7, and thus movement of the seat support 3 rearwardly from the rear rocked position requires more energy or effort from a user than movement of the seat support 3 between the forward and rear rocked positions or any other rocked position therebetween.

In the configuration shown in FIG. 22, the length M1 of the path of the rear track 11 is about 22 millimetres. The radius of curvature R1 of the front portion 61 of the front track 7 is about 38 millimetres, and the radius of curvature R2 of the rear portion 59 of the front track 7 is about 33 millimetres. These radii and lengths combined with the position of the central pivot axis 31 together define the magnitude of translational movement and angular tilting of the seat support 3 and back portion 5 during rocking and reclining movements.

Figure 23:
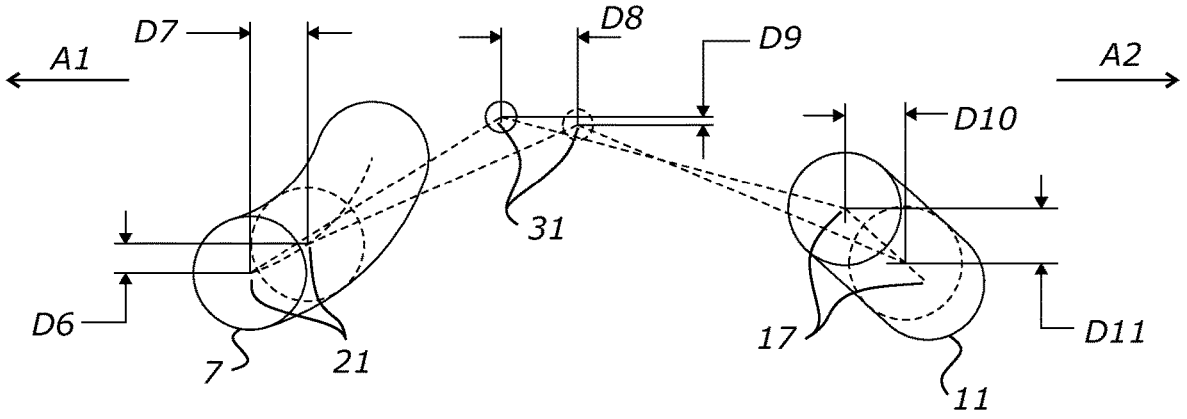
FIG. 23 shows a schematic side view of the front, rear and central pivot axes of the chair when the chair is in its forward rocked position superimposed on a schematic side view of the front, rear and central pivot axes of the chair when the chair is in its default position.

For instance, FIG. 23 shows the position of the rear, front and central pivot axes 17, 21, 31 when the chair 100 is in the forward rocked position superimposed on a 'ghost image' of the rear, front and central pivot axes 17, 21, 31 when the chair 100 is in the default position and thus the rear, front and central pivot axes 17, 21, 31 in their neutral positions.

In this forward rocked position the front pivot axis 21 is located at a frontmost extreme of the front track 7, the combined rock and recline mechanism assembly 200 being configured such that when seat support 3 moves from the neutral position to the forward rocked position, the front pivot axis 21 moves forward and downward relative to the neutral position and the central pivot axis 31 moves forward and upward relative to the neutral position, thereby moving a forward portion of the seat support 3 forward and downward relative to the transom 1.

Thus, when the seat support 3 moves from the neutral position to the forward rocked position, the position of the central pivot axis 31 changes such that the rear roller 13 moves to a frontmost extreme of the rear track 11 and the rear pivot axis 17 moves forward and upward relative to the neutral position, thereby moving a rear portion of the seat support 3 and back portion 5 forward and upward relative to the transom 1.

In one configuration shown in FIG. 23, moving the seat support 3 from the neutral position to the forward rocked position causes the front pivot axis 21 to travel about 6 millimetres downward and about 11 millimetres forward relative to the neutral position, as indicated by displacements D6 and D7 respectively, the central pivot axis 31 to travel about 15 millimetres forward and about 2 millimetres upward relative to the neutral position, as indicated by displacements D8 and D9 respectively, and the rear pivot axis 17 to travel about 12 millimetres forward and about 11 millimetres upward relative to the neutral position, as indicated by displacements D10 and D11 respectively.

As described above in relation to FIG. 3, moving the seat support 3 from the neutral position to the forward rocked position causes the forward portion of the seat support 3 to tilt about 8 degrees downward relative to the neutral position as indicated by displacement A3 in FIG. 3.

Finally, moving the back portion 5 from the neutral position to the forward rocked position causes the rear pivot axis 17 to travel about 12 millimetres forward and about 11 millimetres upward relative to the neutral position, as indicated by displacements D10 and D11 respectively in FIG. 23.

Figure 24:
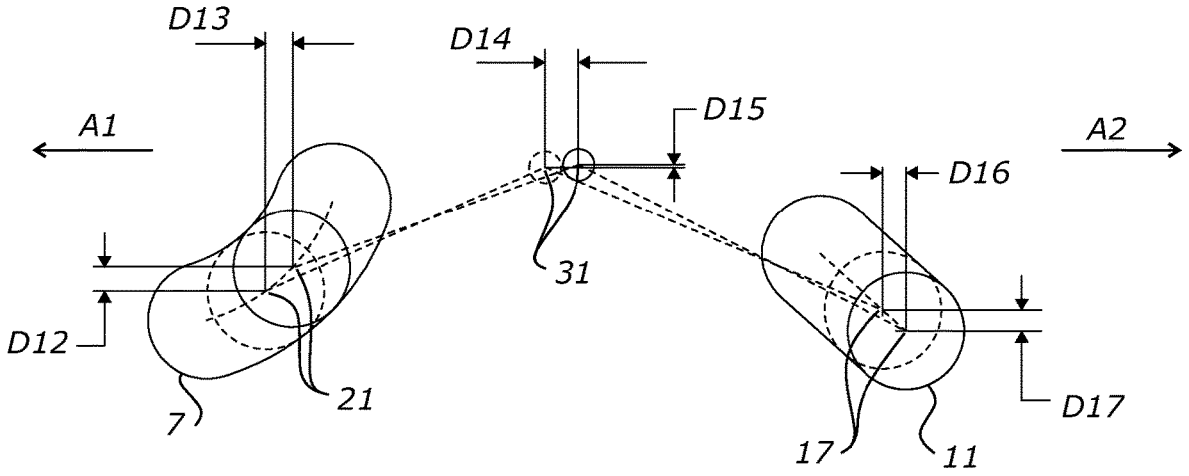
FIG. 24 shows a schematic side view of the front, rear and central pivot axes of the chair when the chair is in its rear rocked position superimposed on a schematic side view of the front, rear and central pivot axes of the chair when the chair is in its default position.

FIG. 24 shows the position of the rear, front and central pivot axes 17, 21, 31 when the chair 100 is in the rear rocked position superimposed on a 'ghost image' of the rear, front and central pivot axes 17, 21, 31 when the chair 100 is in the default position and thus the rear, front and central pivot axes 17, 21, 31 in their neutral positions.

In this rear rocked position, the front pivot axis 21 is located rearward from its neutral position in the front track 7 and thus rearward of the frontmost extreme of the front track 7, the combined rock and recline mechanism assembly 200 being configured such that when the seat support 3 moves from the neutral position to the rear rocked position, the front pivot axis 21 moves rearward and upward relative to the neutral position and the central pivot axis 31 moves rearward and upward relative to the neutral position, thereby moving a forward portion of the seat support 3 rearward and upward relative to the transom 1.

Thus, when the seat support 3 moves from the neutral position to the rear rocked position, the position of the central pivot axis 31 changes such that the rear roller 13 moves to a rearmost extreme of the rear track 11, and the rear pivot axis 17 moves rearward and downward relative to the neutral position, thereby moving a rear portion of the seat support 3 and the back portion 5 rearward and downward relative to the transom 1.

In one configuration shown in FIG. 24, moving the seat support 3 from the neutral position to the rear rocked position causes the front pivot axis 21 to travel about 4 millimetres upward and about 5 millimetres rearward relative to the neutral position, as indicated by displacements D12 and D13 respectively, the central pivot axis 31 to travel about 6 millimetres rearward and about 1 millimetres upward relative to the neutral position, as indicated by displacements D14 and D15 respectively, and the rear pivot axis 17 to travel about 4 millimetres rearward and about 4 millimetres downward relative to the neutral position, as indicated by displacements D16 and D17 respectively.

As described above in relation to FIG. 5, moving the seat support 3 from the neutral position to the rear rocked position causes the forward portion of the seat support 3 to tilt about 4 degrees upward relative to the neutral position as indicated by displacement A5 in FIG. 5.

Finally, moving the back portion 5 from the neutral position to the rearmost rocked position causes the rear pivot axis 17 to travel about 4 millimetres rearward and about 4 millimetres downward relative to the neutral position, as indicated by displacements D16 and D17 respectively in FIG. 24.

Figure 25:
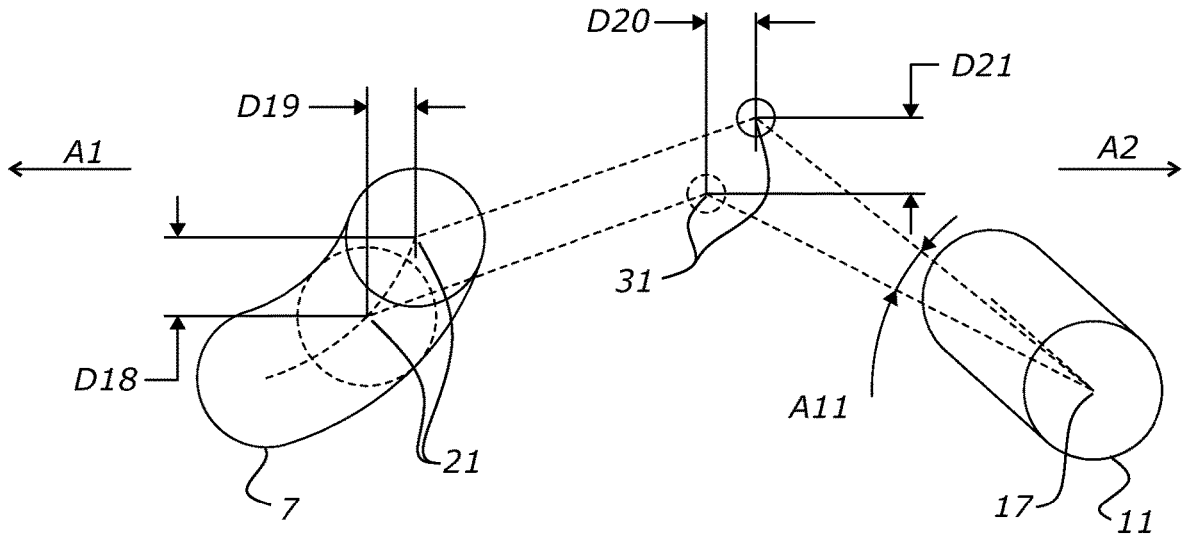
FIG. 25 shows a schematic side view of the front, rear and central pivot axes of the chair when the chair is in its rearmost reclined position superimposed on a schematic side view of the front, rear and central pivot axes of the chair when the chair is in its rear rocked position.

FIG. 25 shows the position of the rear, front and central pivot axes 17, 21, 31 when the chair 100 is in the rearmost reclined position superimposed on a 'ghost image' of the rear, front and central pivot axes 17, 21, 31 when the chair 100 and thus the rear, front and central pivot axes 17, 21, 31 are in the rear rocked position.

In one configuration shown in FIG. 25, when the seat support 3 is in the rear rocked position, moving the back portion 5 from its upright orientation relative to the seat support 3 to the reclined position causes the front pivot axis 21 to travel about 13 millimetres upward and about 8 millimetres rearward relative to the rear rocked position, as indicated by displacements D18 and D19 respectively, and the central pivot axis 31 to move about 8 millimetres rearward and about 12 millimetres upward relative to the rear rocked position, as indicated by displacements D20 and D21 respectively.

The combined rock and recline mechanism assembly 200 being configured such that when the seat support 3 and back portion 5 are in the rear rocked position, moving the back portion 5 from its upright orientation relative to the seat support 3 to the reclined position causes the forward portion of the seat support 3 to tilt about 0.5 degrees upward relative to the rear rocked position as indicated by displacement A7 and as described above in relation to FIG. 7.

Figure 26:
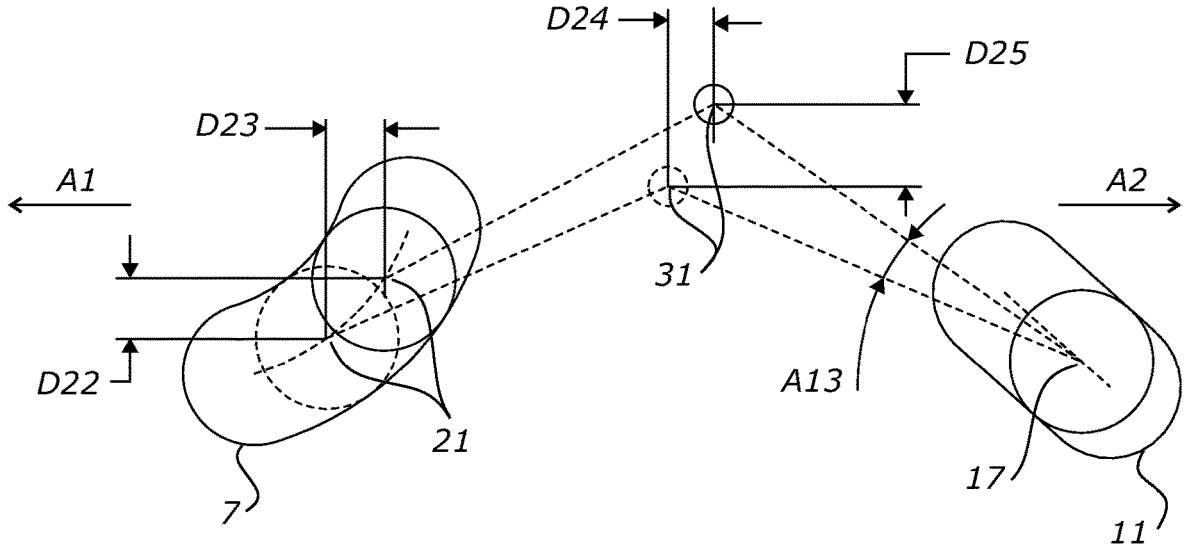
FIG. 26 shows a schematic side view of the front, rear and central pivot axes of the chair when the back portion is in its reclined position superimposed on a schematic side view of the front, rear and central pivot axes of the chair when the chair is in its default position.

FIG. 26 shows the position of the rear, front and central pivot axes 17, 21, 31 when the back portion 5 is moved to a reclined position superimposed on a 'ghost image' of the rear, front and central pivot axes 17, 21, 31 when the chair 100 is in the default position and thus the rear, front and central pivot axes 17, 21, 31 in their neutral positions.

In one configuration shown in FIG. 26, moving the back portion 5 to the reclined position when the seat support 3 is in the first at-rest position causes the front pivot axis 21 to travel about 9 millimetres upward and about 9 millimetres rearward relative to the first at-rest position, as indicated by displacements D22 and D23, and the central pivot axis 31 to move about 7 millimetres rearward and about 13 millimetres upward relative to the first at-rest position, as indicated by displacements D24 and D25; however the position of the rear pivot axis 17 remains the same, as shown in FIG. 26.

Figure 27:
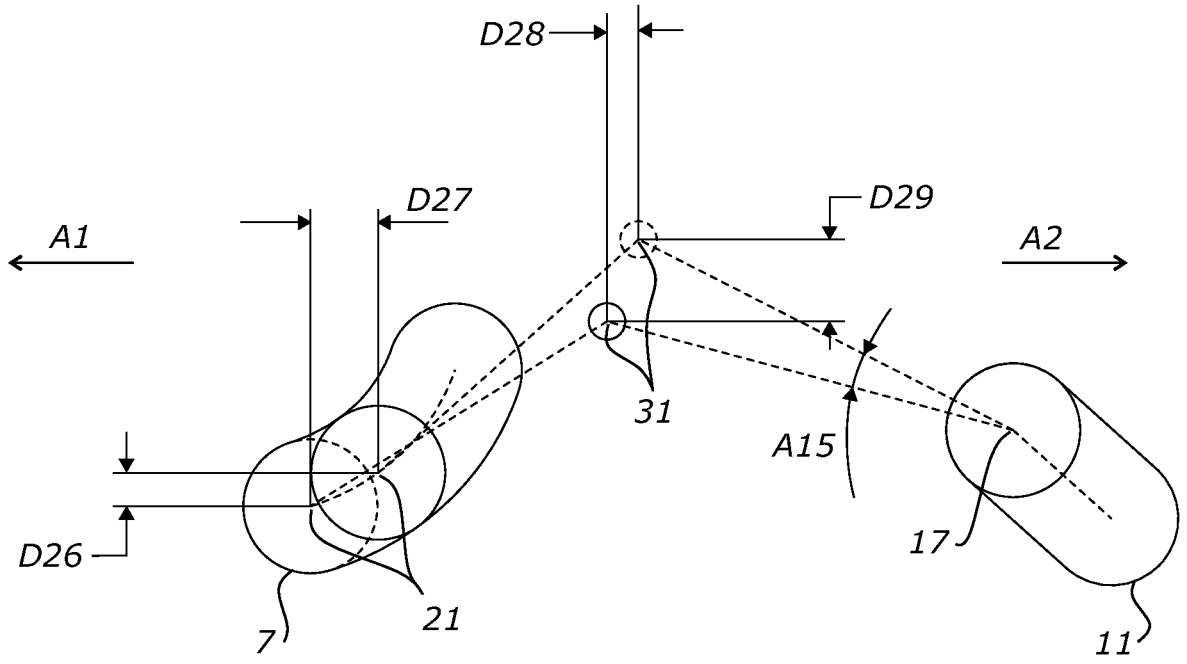
FIG. 27 shows a schematic side view of the front, rear and central pivot axes of the chair when the back portion is in its reclined position superimposed on a schematic side view of the front, rear and central pivot axes of the chair when the chair is in its forward rocked position.

FIG. 27 shows the position of the rear, front and central pivot axes 17, 21, 31 when the back portion 5 is moved to a reclined position superimposed on a 'ghost image' of the rear, front and central pivot axes 17, 21, 31 when the chair 100 and thus the rear, front and central pivot axes 17, 21, 31 are in the forward rocked position.

In one configuration shown in FIG. 27, moving the back portion 5 to the reclined position when the seat support 3 is in the forward rocked position causes the front pivot axis 21 to travel about 6 millimetres upward and about 11 millimetres rearward relative to the forward rocked position, as indicated by displacements D26 and D27, and the central pivot axis 31 to move about 5 millimetres rearward and about 14 millimetres upward relative to the forward rocked position, as indicated by displacements D28 and D29; however, the position of the rear pivot axis 17 remains the same, as shown in FIG. 27.

Generally, the combined rock and recline mechanism assembly 200 is configured such that moving the back portion 5 to the reclined position changes the position of the central pivot axis 31 such that the front pivot axis 21 moves rearward and upward and the front roller 9 moves towards a rear extreme of the front track 7, the seat support 3 moving rearward and upward relative to its first at-rest position.

Therefore, moving the back portion 5 from its upright position relative to the seat support 3 to the reclined position causes a forward portion of the back portion 5 to tilt about 12 degrees upward relative to the upright position irrespective of the position of the seat support 3, as indicated by displacements A11, A13 and A15 shown in FIGS. 25-27, and as indicated by displacement A9 described above in relation to FIG. 7.

Thus, moving the back portion 5 from the upright orientation relative to the seat support 3 to the reclined position causes the front pivot axis 21 to travel between about 8 and about 11 millimetres rearward and between about 6 and about 13 millimetres upward relative to the first at-rest position, the neutral position, the forward rocked position, the rear rocked position, or any other rocked position; and the central pivot axis 31 to move between about 5 and about 8 millimetres rearward and between about 12 and about 14 millimetres upward relative to the first at-rest position, the neutral position, the forward rocked position, the rear rocked position, or any other rocked position. Thus, these movements reflect the change in position of the front and central pivot axes 21, 31 when the back portion 5 is moved to its reclined position irrespective of the initial position of the front and central pivot axes 21, 31.

In various exemplary configurations, the front pivot axis 21 may travel at least about 8 mm, at least about 9 mm, at least about 10 mm, or at least about 11 mm rearward. Additionally or alternatively, the front pivot axis 21 may travel up to about 11 mm, up to about 10 mm, or up to about 9 mm rearward. Additionally or alternatively, the front pivot axis 21 may travel about 8 mm, about 9 mm, about 10 mm, or about 11 mm rearward, or may travel rearward between any two of those distances.

In various exemplary configurations, the front pivot axis 21 may travel at least about 6 mm, at least about 7 mm, at least about 8 mm, or at least about 9 mm upward. Additionally or alternatively, the front pivot axis 21 may travel up to about 13 mm, up to about 12 mm, up to about 11 mm, up to about 10 mm, up to about 9 mm, up to about 8 mm, up to about 7 mm, or up to about 6 mm upward. Additionally or alternatively, the front pivot axis 21 may travel about 6 mm, about 7 mm, about 8 mm, about 9 mm, about 10 mm, about 11 mm, about 12 mm, or about 13 mm upward, or may travel upward between any two of those distances.

In various exemplary configurations, the central pivot axis 31 may travel at least about 5 mm, at least about 6 mm, or at least about 7 mm rearward. Additionally or alternatively, the central pivot axis 31 may travel up to about 8 mm, up to about 7 mm, up to about 6 mm, or up to about 5 mm rearward. Additionally or alternatively, the central pivot axis 31 may travel about 5 mm, about 6 mm, about 7 mm, or about 8 mm rearward, or may travel rearward between any two of those distances.

In various exemplary configurations, the central pivot axis 31 may travel at least about 12 mm, at least about 12.5 mm, at least about 13 mm, at least about 13.5 mm, or at least about 14 mm upward. Additionally or alternatively, the central pivot axis 31 may travel up to about 14 mm, up to about 13.5 mm, or up to about 13 mm upward. Additionally or alternatively, the central pivot axis 31 may travel about 12 mm, about 12.5 mm, about 13 mm, about 13.5 mm, or about 14 mm upward, or may travel upward between any two of those distances.

As described above, the radii and lengths M1, R1, R2 of the front and rear tracks 7, 11 combined with the position of the central pivot axis 31 together define the magnitude of translational movement and angular tilting of the seat support 3 and back portion 5 during rocking and reclining movements.

Figure 28:
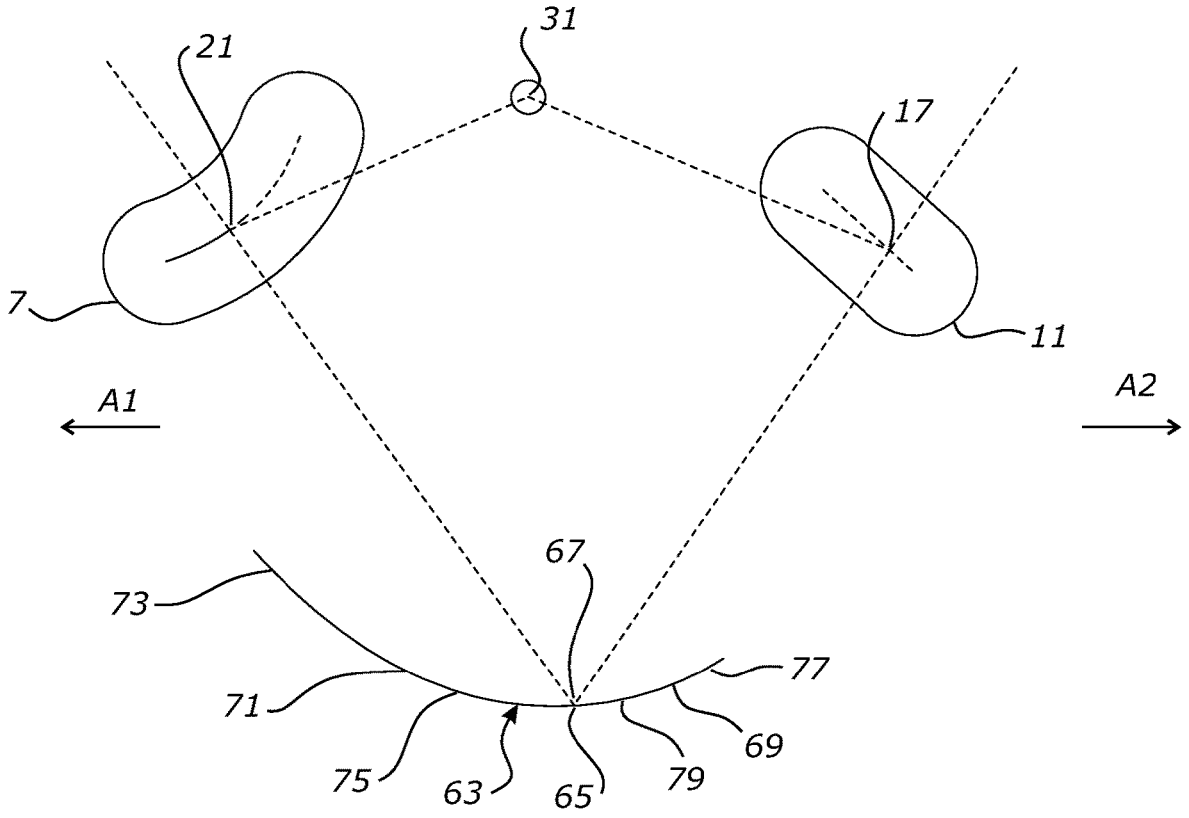
FIG. 28 shows a schematic side view of the virtual rocking path of the chair when the chair is in its default position.
Figure 29:
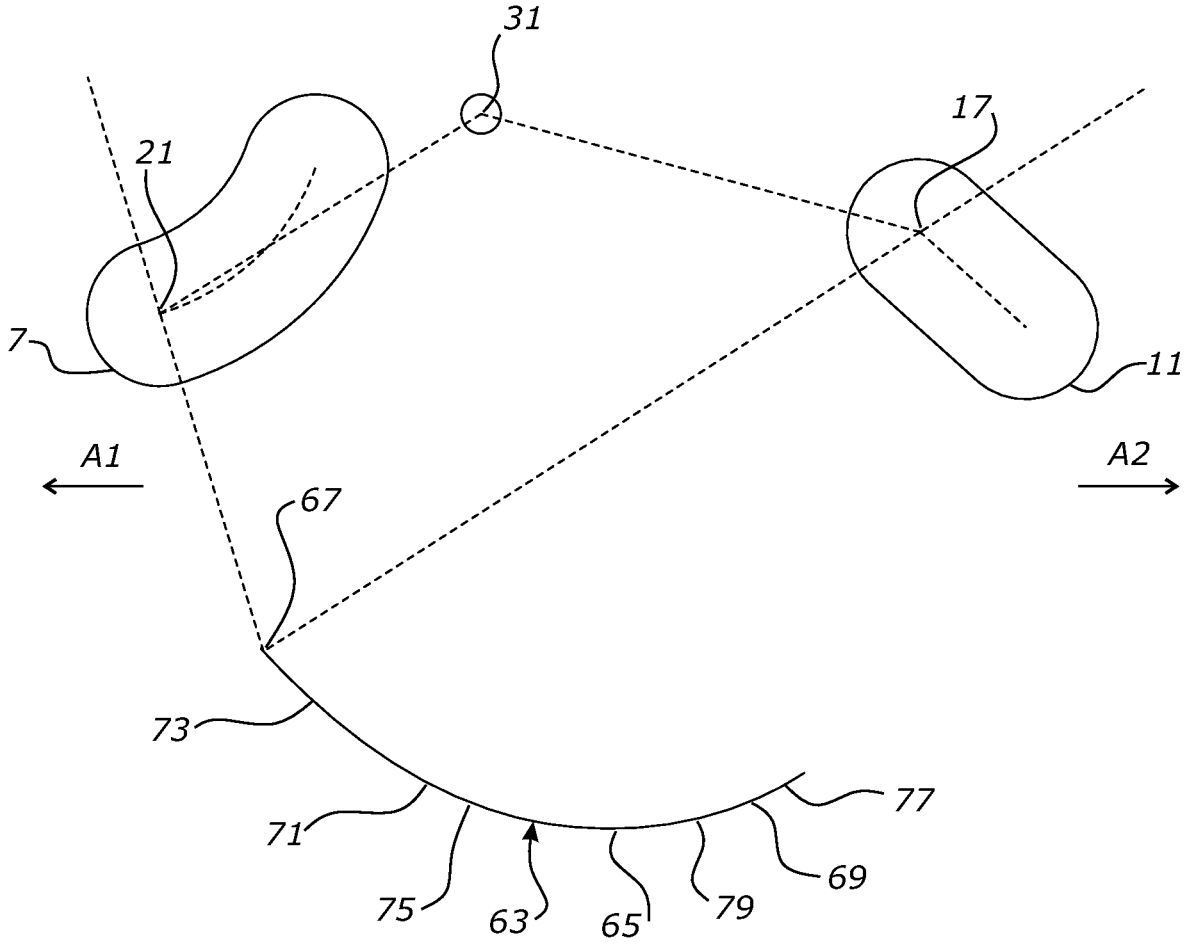
FIG. 29 shows a schematic side view of the virtual rocking path of the chair when the chair is in its forward rocked position.
Figure 30:
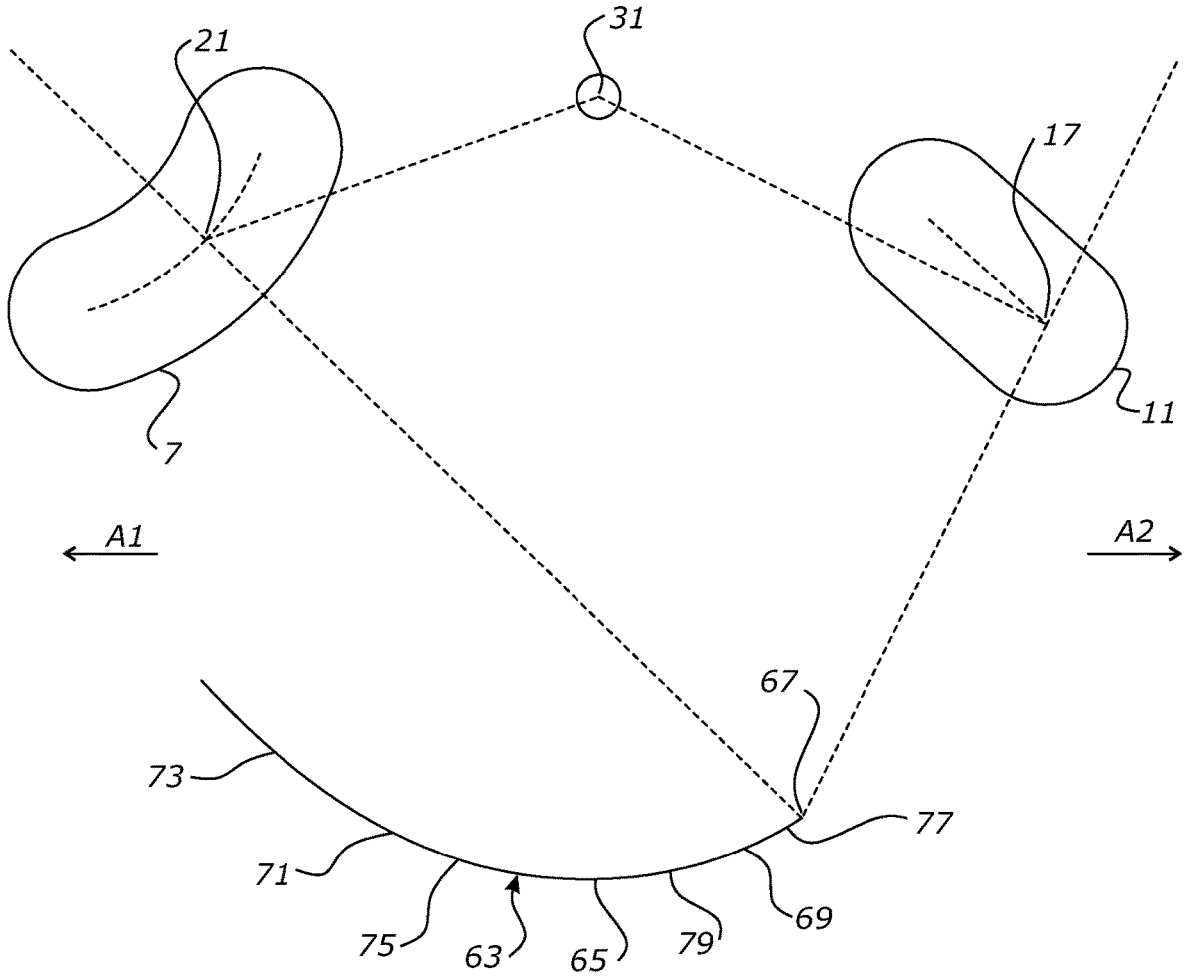
FIG. 30 shows a schematic side view of the virtual rocking path of the chair when the chair is in its rear rocked position.

FIGS. 28-30 show how these features of the combined rock and recline mechanism assembly 200 combine to create a virtual rocking path 63 of the seat support 3 and back portion 5 relative to the transom 1.

In FIG. 28, the chair 100 is in its default position and thus the seat support 3 and back portion 5 are in their neutral positions. The virtual rocking path 63 is shown having a curved shape wherein a lowermost point 65 of the path corresponds to the seat support 3 and the back portion 5 being at the neutral position, as indicated by the virtual intersection 67 of the seat support 3 and back portion 5 along the virtual rocking path 63.

The virtual rocking path 63 also has a rear portion 69 being located rearward of the lowermost point 65 and a front portion 71 being located forward of the lowermost point 65.

In FIG. 29, the chair 100 is in its frontmost rocked position, and so a frontmost extreme of the virtual rocking path 63 is reached by the virtual intersection 67 of the seat support 3 and back portion 5.

In FIG. 30, the chair 100 is in the rearmost rocked position, and so a rearmost extreme of the virtual rocking path 63 is reached by the virtual intersection 67 of the seat support 3 and back portion 5.

A front end 73 of the front portion 71 of the virtual rocking path 63 has a larger radius than a rear end 75 of the front portion 71 of the virtual rocking path 63. Alternatively, the front end 73 of the front portion 71 may have a smaller radius than the rear end 75 of the front portion 71, or the front end 73 and the rear end 75 of the front portion 71 may have a constant radius. The virtual rocking path 63 increases in steepness from the lowermost point 65 to a frontmost extreme or frontmost edge of the virtual rocking path 63, because of the upward curvature of the virtual rocking path.

Further, a rear end 77 of the rear portion 69 of the virtual rocking path 63 has a smaller radius than a front end 79 of the rear portion 69 of the virtual rocking path 63. Alternatively, the rear end 77 of the rear portion 69 may have a larger radius than the front end 79 of the rear portion 69, or the rear end 77 and the front end 79 of the rear portion 69 may have a constant radius. The virtual rocking path 63 increases in steepness from the lowermost point 65 to the rearmost extreme or rearmost edge of the virtual rocking path 63, because of the upward curvature of the virtual rocking path.

Thus, moving the chair 100 to either the forward or rear rocked position requires increasing energy input by a user in addition to the energy required to overcome the first biasing force of the at least one first biasing device, due to the increasing steepness of the virtual rocking path 63 when moving the chair 100 either towards the forward rocked or rear rocked position.

In some embodiments, the path, radii and/or lengths of the front and rear tracks 7, 11 and/or the position of the central pivot axis 31 may be altered to change the virtual rocking path 63 so as to provide different increasing, decreasing, or constant resistance as the chair 100 rocks from a rear rocked position to a forward rocked position and/or vice versa.

Figure 31:
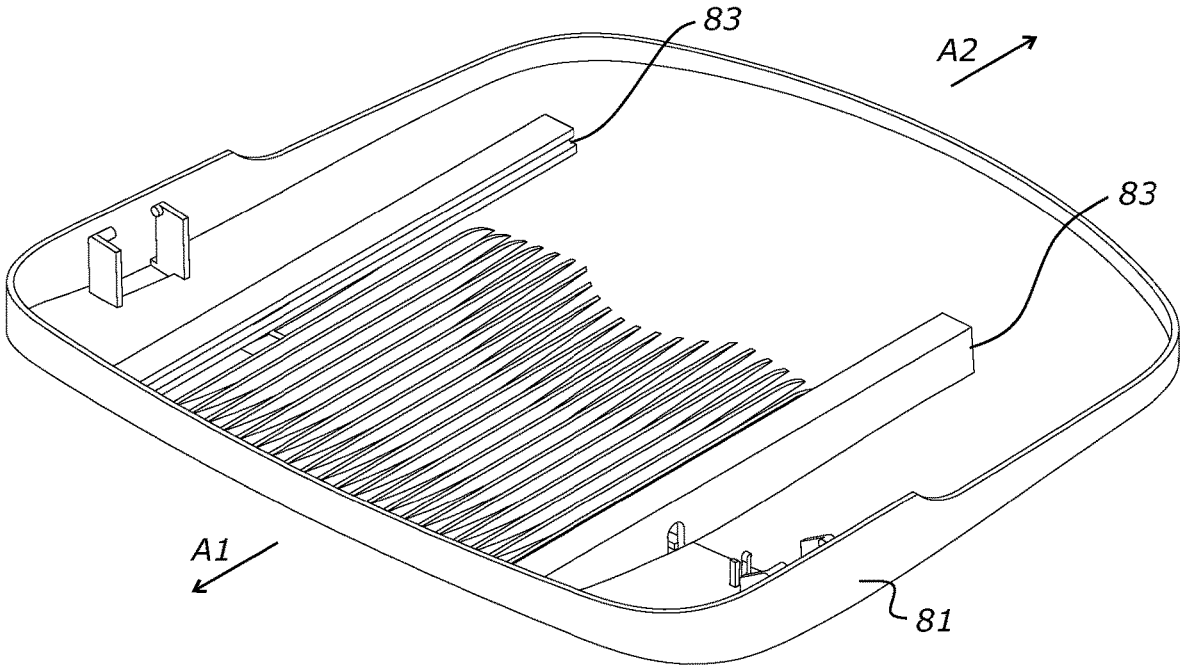
FIG. 31 shows a perspective view of a seat of an embodiment of the chair.

FIG. 31 shows an underside of a seat 81. The seat 81 is fixedly mountable to or integrally formed with the seat support 3, or is movably mounted to the seat support 3. A seat cushion or other compliant surface or structure may be fixedly attached to an upper side (not shown) of the seat 81.

Figure 32:
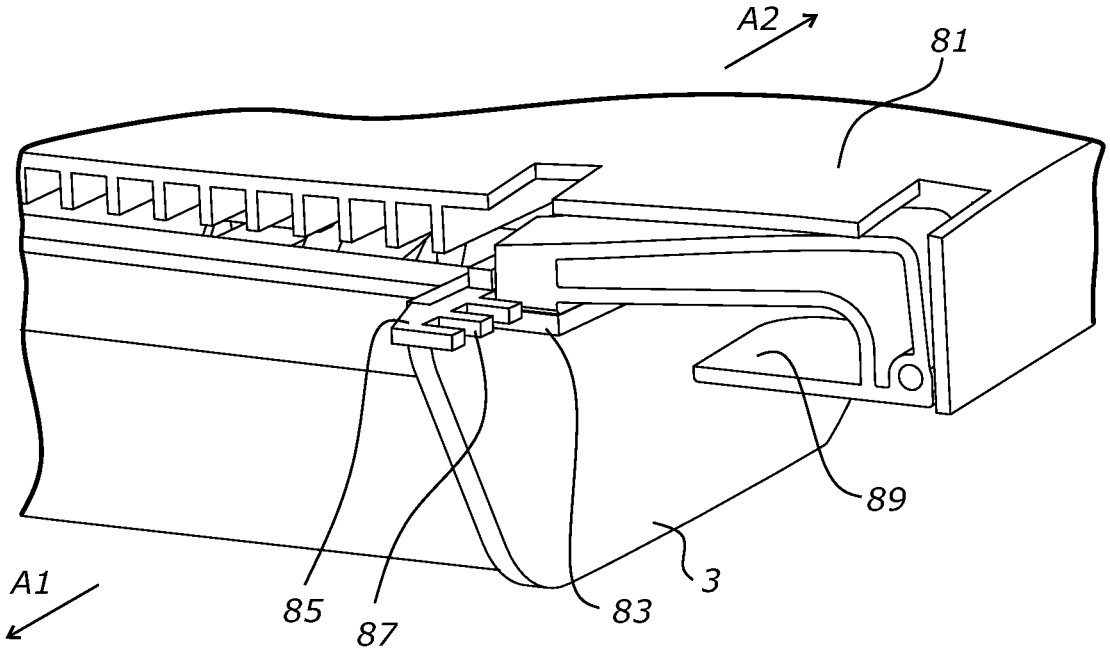
FIG. 32 shows a cross sectional perspective view of part of the seat and seat support of an embodiment of the chair.

In some embodiments, the seat 81 is slidably mounted to the seat support 3. The seat 81 comprises slide channels 83 that receive and slide along a pair of slide flanges 85 of the seat support 3 of FIG. 10. Provided along a length of at least one of the pair of slide flanges 85 is a plurality of slide apertures 87. A seat depth actuator 89 shown in FIG. 32 is operably connected to the underside of the seat 81 and passes through a portion of one of the slide channels 83 to protrude into one of the plurality of slide apertures 87. The seat depth actuator 89 is biased to engage with one of the plurality of slide apertures 87 to lock a translational sliding position of the seat 81 relative to the seat support 3. When depressed by a user of the chair 100, the seat depth actuator 89 disengages from the one of the plurality of slide apertures 87 thereby permitting translational sliding of the seat 81 relative to the seat support 3.

In some embodiments, the plurality of slide apertures may instead be provided along a length of the underside of the seat 81 or along a length of a flange or flanges extending from the underside of the seat 81 being received by slide channels instead provided along a length of the seat support 3. As such, the working principles of the seat depth actuator 89 apply equally to permit or inhibit translational sliding of the seat 81 relative to the seat support 3 except the apertures, flanges and slide channel positions are swapped.

Figure 33:
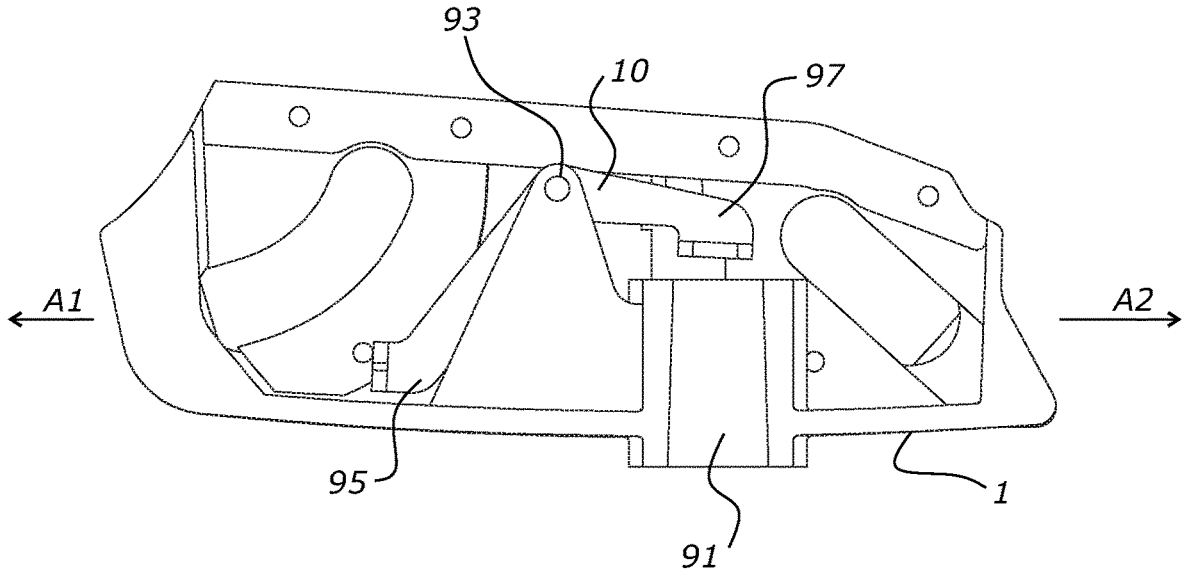
FIG. 33 shows a cross sectional side view of the transom of an embodiment of the chair.

In some embodiments, the transom 1 is provided with a recess 91 as shown in FIGS. 9 and 33 for receipt of a height adjustable column 92 as shown in FIG. 1. The column 92 may house any suitable pneumatic, hydraulic or mechanical telescoping arrangement known in the art of height adjustable chairs.

The height-adjust lever 10 is pivotally coupled to a seat height pivot 93 extending upwardly from a lower surface of the transom 1. A lower end 95 of the height-adjust lever 10 is pulled upon by a cable (not shown) that is grounded to the transom 1. This causes the upper end 97 of the height-adjust lever 10 to pivot downwardly to depress a button (not shown) that then permits adjustment of the height adjustable column 92.

Figure 34:
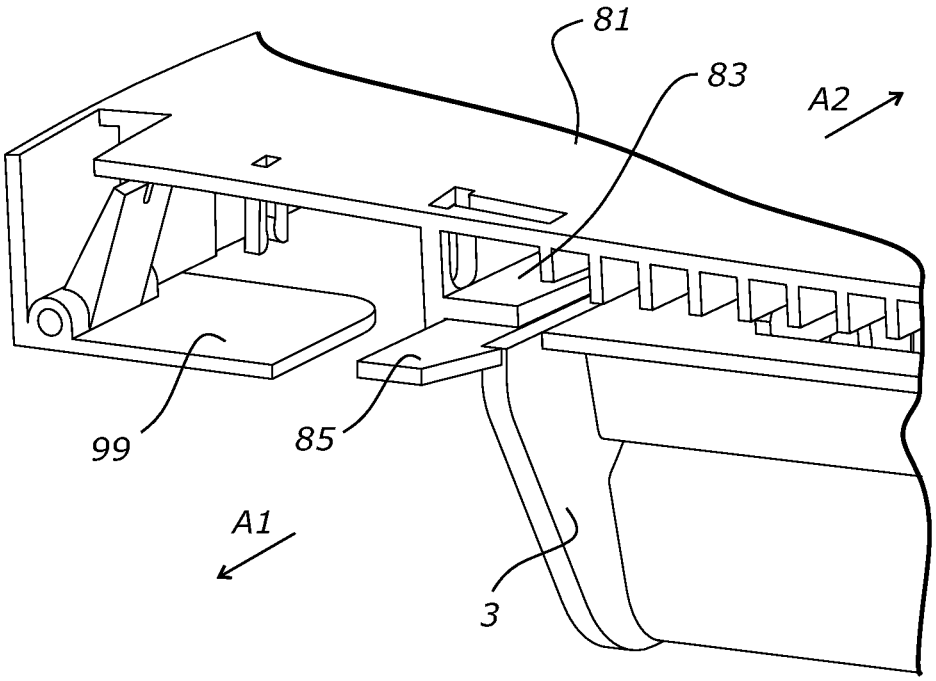
FIG. 34 shows a cross sectional perspective view of the seat and seat support of an embodiment of the chair.

A height actuator 99 shown in FIG. 34 is operably connected to the underside of the seat 81 and engages with the cable (not shown) to pull or release the cable and thus permit or inhibit adjustment of the height adjustable column 91. The seat height actuator 99 is biased in a release position such that it must be depressed by a user of the chair 100 to cause it pull upon the cable and thus permit adjustment of the height adjustable column 91 and thereby the height of the transom 1, seat support 3, and back portion 5 above the ground surface.

Figure 35:
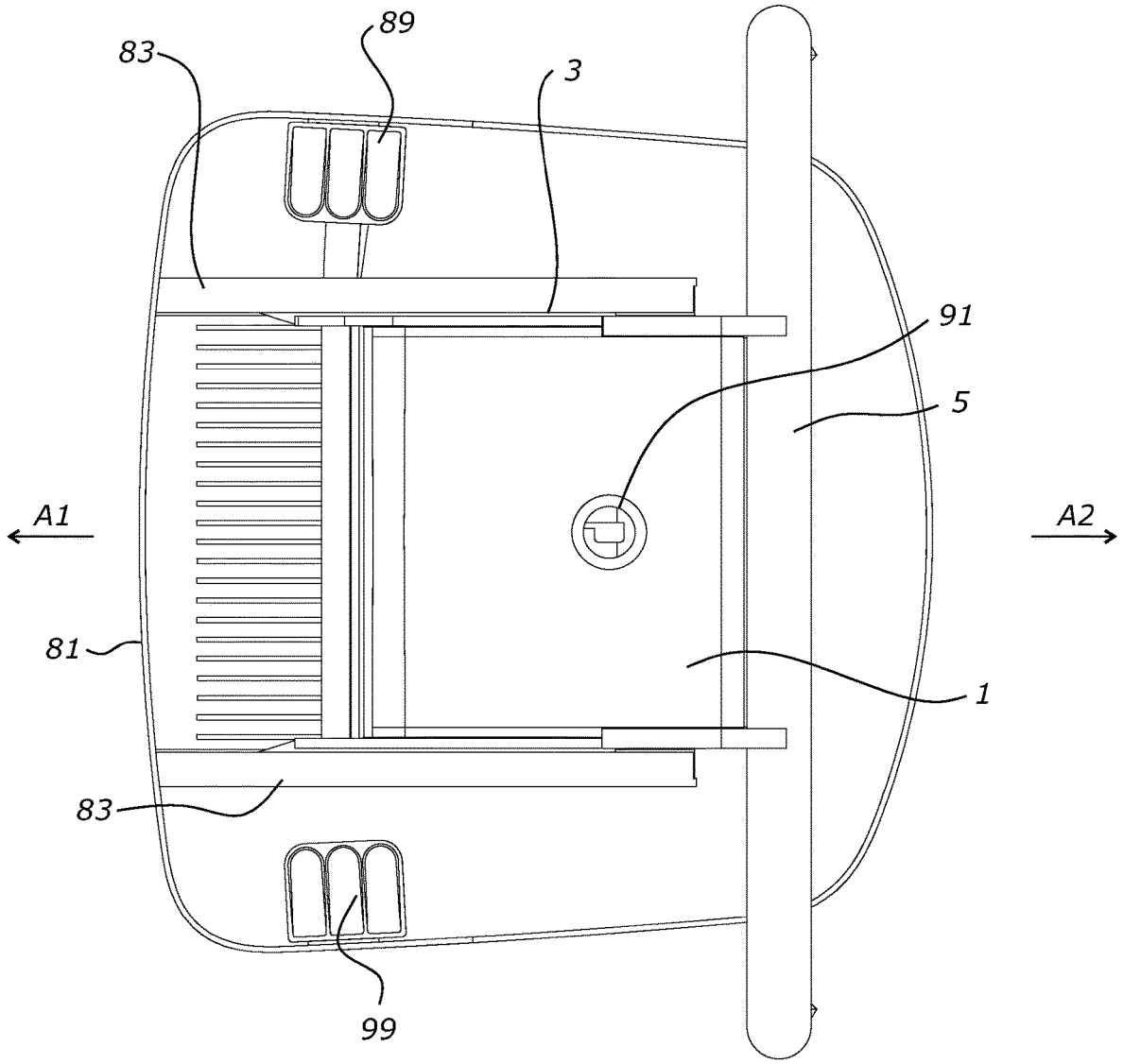
FIG. 35 shows a bottom view of a seat and seat depth and seat height actuators of an embodiment of the chair.

FIG. 35 shows an underside of the of the seat 81 having both the seat depth actuator 89 and height actuator 99. These actuators 89, 99 being provided underneath the seat 81 and adjacent the outer periphery of the seat 81 allow for easy and intuitive adjustment of the seat depth or height by a user of the chair 100 in embodiments of the chair 100 where these features are provided.

The combined rock and recline mechanism assembly 200 is particularly suited to an application on a pedestal type height adjustable base, and/or on a swivel base that enables rotation of the mechanism assembly 200 about a vertical axis, for example in a task or office chair. The features described herein could also be used in any other suitable seating application, including but not limited to dining chairs, multipurpose chairs, cafeteria chairs, restaurant chairs, breakout space chairs, and meeting environment chairs.

Preferred embodiments of the invention have been described by way of example only and modifications may be made thereto without departing from the scope of the invention.

For example, the specific values of displacements D1-D29 and A3-A15 described in this specification with reference to the movement of components of the chair 100 are indicative only of one exemplary configuration of the chair 100. The specific values of displacements are determined in part by the magnitude of the angular tilt of a forward portion the seat support 3 at the forward rocked and rear rocked positions. Thus, these specific values may change in other exemplary configurations of the chair 100 where the magnitudes of the angular tilt of a forward portion the seat support 3 at the forward rocked and/or rear rocked position is different to those described in this specification and claims. This applies equally to the radii and lengths R1, R2, M1 described in relation to the front and rear tracks 7, 11.

For instance, the below Table 1 sets out exemplary ranges of values possible for each of the displacements, radii and lengths D1-D29, A3-A15, R1, R2 and M1 when the angular tilt of a forward part of the seat support 3 at the forward rocked and rear rocked position is increased or decreased by 2 degrees.

The 'lower' values indicate the values when the angular tilt of a forward part of the seat support 3 at the forward rocked and rear rocked positions is decreased by 2 degrees; the 'upper' values indicate the values when the angular tilt of a forward part of the seat support 3 at the forward rocked and rear rocked positions is increased by 2 degrees; and the 'default' values indicate the values when the angular tilt of a forward part of the seat support 3 at the forward rocked and rear rocked positions as described above in this specification and claims.

Any values within these ranges are possible and, indeed, different values outside these ranges are possible for different configurations of the chair.

TABLE 1

| | Lower Values | Default Values | Upper Values |
|---|---|---|---|
| Displacements (mm) | | | |
| D1 | 28 | 33 | 47 |
| D2 | 15 | 19 | 24 |
| D3 | 10 | 17 | 20 |
| D4 | 5 | 10 | 12 |
| D5 | 4 | 14 | 30 |
| D6 | 4 | 6 | 8 |
| D7 | 8 | 11 | 15 |
| D8 | 10 | 15 | 18 |
| D9 | 1 | 2 | 4 |
| D10 | 8 | 12 | 15 |
| D11 | 7 | 11 | 14 |
| D12 | 3 | 4 | 5 |
| D13 | 4 | 5 | 6 |
| D14 | 3 | 6 | 9 |
| D15 | 0 | 1 | 3 |
| D16 | 3 | 4 | 5 |
| D17 | 3 | 4 | 5 |
| D18 | 10 | 13 | 18 |
| D19 | 2 | 8 | 10 |
| D20 | 2 | 8 | 10 |
| D21 | 9 | 12 | 18 |
| D22 | 6 | 9 | 12 |
| D23 | 6 | 9 | 12 |
| D24 | 4 | 7 | 9 |
| D25 | 10 | 13 | 20 |
| D26 | 3 | 6 | 9 |

TABLE 1-continued

| | Lower Values | Default Values | Upper Values |
|---|---|---|---|
| D27 | 7 | 11 | 15 |
| D28 | 2 | 5 | 8 |
| D29 | 10 | 14 | 22 |
| Displacements (degrees) | | | |
| A3 | 6 | 8 | 10 |
| A5 | 2 | 4 | 6 |
| A7 | −1.5 | 0.5 | 3.5 |
| A9 | 10 | 12 | 16 |
| A11 | 10 | 12 | 16 |
| A13 | 10 | 12 | 16 |
| A15 | 10 | 12 | 16 |
| Radii (mm) | | | |
| R1 | 30 | 38 | 45 |
| R2 | 20 | 33 | 40 |
| Length (mm) | | | |
| M1 | 14 | 22 | 26 |

In various exemplary configurations, displacement D1 may be at least about 28 mm, at least about 29 mm, at least about 30 mm, at least about 31 mm, at least about 32 mm, or at least about 33 mm. Additionally or alternatively, displacement D1 may be up to about 47 mm, up to about 46 mm, up to about 45 mm, up to about 44 mm, up to about 43 mm, up to about 42 mm, up to about 41 mm, up to about 40 mm, up to about 39 mm, up to about 38 mm, up to about 37 mm, up to about 36 mm, up to about 35 mm, up to about 34 mm, or up to about 33 mm. Additionally or alternatively, displacement D1 may be about 28 mm, about 29 mm, about 30 mm, about 31 mm, about 32 mm, about 33 mm, about 34 mm, about 35 mm, about 36 mm, about 37 mm, about 38 mm, about 39 mm, about 40 mm, about 41 mm, about 42 mm, about 43 mm, about 44 mm, about 45 mm, about 46 mm, about 47 mm, or between any two of those values.

In various exemplary configurations, displacement D2 may be at least about 15 mm, at least about 16 mm, at least about 17 mm, at least about 18 mm, or at least about 19 mm. Additionally or alternatively, displacement D2 may be up to about 24 mm, up to about 23 mm, up to about 22 mm, up to about 21 mm, up to about 20 mm, or up to about 19 mm. Additionally or alternatively, displacement D2 may be about 15 mm, about 16 mm, about 17 mm, about 18 mm, about 19 mm, about 20 mm, about 21 mm, about 22 mm, about 23 mm, about 24 mm, or between any two of those values.

In various exemplary configurations, displacement D3 may be at least about 10 mm, at least about 11 mm, at least about 12 mm, at least about 13 mm, at least about 14 mm, at least about 15 mm, at least about 16 mm, or at least about 17 mm. Additionally or alternatively, displacement D3 may be up to about 20 mm, up to about 19 mm, up to about 18 mm, or up to about 17 mm. Additionally or alternatively, displacement D3 may be about 10 mm, about 11 mm, about 12 mm, about 13 mm, about 14 mm, about 15 mm, about 16 mm, about 17 mm, about 18 mm, about 19 mm, about 20 mm, or between any two of those values.

In various exemplary configurations, displacement D4 may be at least about 5 mm, at least about 6 mm, at least about 7 mm, at least about 8 mm, at least about 9 mm, or at least about 10 mm. Additionally or alternatively, displacement D4 may be up to about 12 mm, up to about 11 mm, or up to about 10 mm. Additionally or alternatively, displacement D4 may be about 5 mm, about 6 mm, about 7 mm, about 8 mm, about 9 mm, about 10 mm, about 11 mm, about 12 mm, or between any two of those values.

In various exemplary configurations, displacement D5 may be at least about 4 mm, at least about 5 mm, at least about 6 mm, at least about 7 mm, at least about 8 mm, at least about 9 mm, at least about 10 mm, at least about 11 mm, at least about 12 mm, at least about 13 mm, or at least about 14 mm. Additionally or alternatively, displacement D5 may be up to about 30 mm, up to about 29 mm, up to about 28 mm, up to about 27 mm, up to about 26 mm, up to about 25 mm, up to about 24 mm, up to about 23 mm, up to about 22 mm, up to about 21 mm, up to about 20 mm, up to about 19 mm, up to about 18 mm, up to about 17 mm, up to about 16 mm, up to about 15 mm, or up to about 14 mm. Additionally or alternatively, displacement D5 may be about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, about 21 mm, about 22 mm, about 23 mm, about 24 mm, about 25 mm, about 26 mm, about 27 mm, about 28 mm, about 29 mm, about 30 mm, or between any two of those values.

In various exemplary configurations, displacement D6 may be at least about 4 mm, at least about 4.5 mm, at least about 5 mm, at least about 5.5 mm, or at least about 6 mm. Additionally or alternatively, displacement D6 may be up to about 8 mm, up to about 7.5 mm, up to about 7 mm, up to about 6.5 mm, or up to about 6 mm. Additionally or alternatively, displacement D6 may be about 4 mm, about 4.5 mm, about 5 mm, about 5.5 mm, about 6 mm, about 6.5 mm, about 7 mm, about 7.5 mm, about 8 mm, or between any two of those values.

In various exemplary configurations, displacement D7 may be at least about 8 mm, at least about 9 mm, at least about 10 mm, or at least about 11 mm. Additionally or alternatively, displacement D7 may be up to about 15 mm, up to about 14 mm, up to about 13 mm, up to about 12 mm, or up to about 11 mm. Additionally or alternatively, displacement D7 may be about 8 mm, about 9 mm, about 10 mm, about 11 mm, about 12 mm, about 13 mm, about 14 mm, about 15 mm, or between any two of those values.

In various exemplary configurations, displacement D8 may be at least about 10 mm, at least about 11 mm, at least about 12 mm, at least about 13 mm, at least about 14 mm, or at least about 15 mm. Additionally or alternatively, displacement D8 may be up to about 18 mm, up to about 17 mm, up to about 16 mm, or up to about 15 mm. Additionally or alternatively, displacement D8 may be about 10 mm, about 11 mm, about 12 mm, about 13 mm, about 14 mm, about 15 mm, about 16 mm, about 17 mm, about 18 mm, or between any two of those values.

In various exemplary configurations, displacement D9 may be at least about 1 mm, at least about 1.2 mm, at least about 1.4 mm, at least about 1.6 mm, at least about 1.8 mm, or at least about 2 mm. Additionally or alternatively, displacement D9 may be up to about 4 mm, up to about 3.8 mm, up to about 3.6 mm, up to about 3.4 mm, up to about 3.2 mm, up to about 3 mm, up to about 2.8 mm, up to about 2.6 mm, up to about 2.4 mm, up to about 2.2 mm, or up to about 2 mm. Additionally or alternatively, displacement D9 may be about 1 mm, about 1.2 mm, about 1.4 mm, about 1.6 mm, about 1.8 mm, about 2 mm, about 2.2 mm, about 2.4 mm, about 2.6 mm, about 2.8 mm, about 3 mm, about 3.2 mm, about 3.4 mm, about 3.6 mm, about 3.8 mm, about 4 mm, or between any two of those values.

In various exemplary configurations, displacement D10 may be at least about 8 mm, at least about 9 mm, at least about 10 mm, at least about 11 mm, or at least about 12 mm. Additionally or alternatively, displacement D10 may be up to about 15 mm, up to about 14 mm, up to about 13 mm, or up to about 12 mm. Additionally or alternatively, displacement D10 may be about 8 mm, about 9 mm, about 10 mm, about 11 mm, about 12 mm, about 13 mm, about 14 mm, about 15 mm, or between any two of those values.

In various exemplary configurations, displacement D11 may be at least about 7 mm, at least about 9 mm, at least about 10 mm, or at least about 11 mm. Additionally or alternatively, displacement D11 may be up to about 14 mm, up to about 13 mm, up to about 12 mm, or up to about 11 mm. Additionally or alternatively, displacement D11 may be about 7 mm, about 8 mm, about 9 mm, about 10 mm, about 11 mm, about 12 mm, about 13 mm, about 14 mm, or between any two of those values.

In various exemplary configurations, displacement D12 may be at least about 3 mm, at least about 3.1 mm, at least about 3.2 mm, at least about 3.3 mm, at least about 3.4 mm, at least about 3.5 mm, at least about 3.6 mm, at least about 3.7 mm, at least about 3.8 mm, at least about 3.9 mm, or at least about 4 mm. Additionally or alternatively, displacement D12 may be up to about 5 mm, up to about 4.9 mm, up to about 4.8 mm, up to about 4.7 mm, up to about 4.6 mm, up to about 4.5 mm, up to about 4.4 mm, up to about 4.3 mm, up to about 4.2 mm, up to about 4.1 mm, or up to about 4 mm. Additionally or alternatively, displacement D12 may be about 3 mm, about 3.1 mm, about 3.2 mm, about 3.3 mm, about 3.4 mm, about 3.5 mm, about 3.6 mm, about 3.7 mm, about 3.8 mm, about 3.9 mm, about 4 mm, about 4.1 mm, about 4.2 mm, about 4.3 mm, about 4.4 mm, about 4.5 mm, about 4.6 mm, about 4.7 mm, about 4.8 mm, about 4.9 mm, about 5 mm, or between any two of those values.

In various exemplary configurations, displacement D13 may be at least about 4 mm, at least about 4.1 mm, at least about 4.2 mm, at least about 4.3 mm, at least about 4.4 mm, at least about 4.5 mm, at least about 4.6 mm, at least about 4.7 mm, at least about 4.8 mm, at least about 4.9 mm, or at least about 5 mm. Additionally or alternatively, displacement D13 may be up to about 6 mm, up to about 5.9 mm, up to about 5.8 mm, up to about 5.7 mm, up to about 5.6 mm, up to about 5.5 mm, up to about 5.4 mm, up to about 5.3 mm, up to about 5.2 mm, up to about 5.1 mm, or up to about 5 mm. Additionally or alternatively, displacement D13 may be about 4 mm, about 4.1 mm, about 4.2 mm, about 4.3 mm, about 4.4 mm, about 4.5 mm, about 4.6 mm, about 4.7 mm, about 4.8 mm, about 4.9 mm, about 5 mm, about 5.1 mm, about 5.2 mm, about 5.3 mm, about 5.4 mm, about 5.5 mm, about 5.6 mm, about 5.7 mm, about 5.8 mm, about 5.9 mm, about 6 mm, or between any two of those values.

In various exemplary configurations, displacement D14 may be at least about 3 mm, at least about 4 mm, at least about 5 mm, or at least about 6 mm. Additionally or alternatively, displacement D14 may be up to about 9 mm, up to about 8 mm, up to about 7 mm, or up to about 6 mm. Additionally or alternatively, displacement D14 may be about 3 mm, about 4 mm, about 5 mm, about 6 mm, about 7 mm, about 8 mm, about 9 mm, or between any two of those values.

In various exemplary configurations, displacement D15 may be at least about 0 mm, at least about 0.2 mm, at least about 0.4 mm, at least about 0.6 mm, at least about 0.8 mm, or at least about 1 mm. Additionally or alternatively, displacement D15 may be up to about 3 mm, up to about 2.8 mm, up to about 2.6 mm, up to about 2.4 mm, up to about 2.2 mm, up to about 2 mm, up to about 1.8 mm, up to about 1.6 mm, up to about 1.4 mm, up to about 1.2 mm, or up to about 1 mm. Additionally or alternatively, displacement D15 may be about 0 mm, about 0.2 mm, about 0.4 mm, about 0.6 mm, about 0.8 mm, about 1 mm, about 1.2 mm, about 1.4 mm, about 1.6 mm, about 1.8 mm, about 2 mm, about 2.2 mm, about 2.4 mm, about 2.6 mm, about 2.8 mm, about 3 mm, or between any two of those values.

In various exemplary configurations, displacement D16 may be at least about 3 mm, at least about 3.1 mm, at least about 3.2 mm, at least about 3.3 mm, at least about 3.4 mm, at least about 3.5 mm, at least about 3.6 mm, at least about 3.7 mm, at least about 3.8 mm, at least about 3.9 mm, or at least about 4 mm. Additionally or alternatively, displacement D16 may be up to about 5 mm, up to about 4.9 mm, up to about 4.8 mm, up to about 4.7 mm, up to about 4.6 mm, up to about 4.5 mm, up to about 4.4 mm, up to about 4.3 mm, up to about 4.2 mm, up to about 4.1 mm, or up to about 4 mm. Additionally or alternatively, displacement D16 may be about 3 mm, about 3.1 mm, about 3.2 mm, about 3.3 mm, about 3.4 mm, about 3.5 mm, about 3.6 mm, about 3.7 mm, about 3.8 mm, about 3.9 mm, about 4 mm, about 4.1 mm, about 4.2 mm, about 4.3 mm, about 4.4 mm, about 4.5 mm, about 4.6 mm, about 4.7 mm, about 4.8 mm, about 4.9 mm, about 5 mm, or between any two of those values.

In various exemplary configurations, displacement D17 may be at least about 3 mm, at least about 3.1 mm, at least about 3.2 mm, at least about 3.3 mm, at least about 3.4 mm, at least about 3.5 mm, at least about 3.6 mm, at least about 3.7 mm, at least about 3.8 mm, at least about 3.9 mm, or at least about 4 mm. Additionally or alternatively, displacement D17 may be up to about 5 mm, up to about 4.9 mm, up to about 4.8 mm, up to about 4.7 mm, up to about 4.6 mm, up to about 4.5 mm, up to about 4.4 mm, up to about 4.3 mm, up to about 4.2 mm, up to about 4.1 mm, or up to about 4 mm. Additionally or alternatively, displacement D17 may be about 3 mm, about 3.1 mm, about 3.2 mm, about 3.3 mm, about 3.4 mm, about 3.5 mm, about 3.6 mm, about 3.7 mm, about 3.8 mm, about 3.9 mm, about 4 mm, about 4.1 mm, about 4.2 mm, about 4.3 mm, about 4.4 mm, about 4.5 mm, about 4.6 mm, about 4.7 mm, about 4.8 mm, about 4.9 mm, about 5 mm, or between any two of those values.

In various exemplary configurations, displacement D18 may be at least about 10 mm, at least about 11 mm, at least about 12 mm, or at least about 13 mm. Additionally or alternatively, displacement D18 may be up to about 18 mm, up to about 17 mm, up to about 16 mm, up to about 15 mm, up to about 14 mm, or up to about 13 mm. Additionally or alternatively, displacement D18 may be about 10 mm, about 11 mm, about 12 mm, about 13 mm, about 14 mm, about 15 mm, about 16 mm, about 17 mm, about 18 mm, or between any two of those values.

In various exemplary configurations, displacement D19 may be at least about 2 mm, at least about 3 mm, at least about 4 mm, at least about 5 mm, at least about 6 mm, at least about 7 mm, or at least about 8 mm. Additionally or alternatively, displacement D19 may be up to about 10 mm, up to about 9 mm, or up to about 8 mm. Additionally or alternatively, displacement D19 may be about 2 mm, about 3 mm, about 4 mm, about 5 mm, about 6 mm, about 7 mm, about 8 mm, about 9 mm, about 10 mm, or between any two of those values.

In various exemplary configurations, displacement D20 may be at least about 2 mm, at least about 3 mm, at least about 4 mm, at least about 5 mm, at least about 6 mm, at least about 7 mm, or at least about 8 mm. Additionally or alternatively, displacement D20 may be up to about 10 mm, up to about 9 mm, or up to about 8 mm. Additionally or alternatively, displacement D20 may be about 2 mm, about 3 mm, about 4 mm, about 5 mm, about 6 mm, about 7 mm, about 8 mm, about 9 mm, about 10 mm, or between any two of those values.

In various exemplary configurations, displacement D21 may be at least about 9 mm, at least about 10 mm, at least about 11 mm, or at least about 12 mm. Additionally or alternatively, displacement D21 may be up to about 18 mm, up to about 17 mm, up to about 16 mm, up to about 15 mm, up to about 14 mm, up to about 13 mm, or up to about 12 mm. Additionally or alternatively, displacement D21 may be about 9 mm, about 10 mm, about 11 mm, about 12 mm, about 13 mm, about 14 mm, about 15 mm, about 16 mm, about 17 mm, about 18 mm, or between any two of those values.

In various exemplary configurations, displacement D22 may be at least about 6 mm, at least about 7 mm, at least about 8 mm, or at least about 9 mm. Additionally or alternatively, displacement D22 may be up to about 12 mm, up to about 11 mm, up to about 10 mm, or up to about 9 mm. Additionally or alternatively, displacement D22 may be about 6 mm, about 7 mm, about 8 mm, about 9 mm, about 10 mm, about 11 mm, about 12 mm, or between any two of those values.

In various exemplary configurations, displacement D23 may be at least about 6 mm, at least about 7 mm, at least about 8 mm, or at least about 9 mm. Additionally or alternatively, displacement D23 may be up to about 12 mm, up to about 11 mm, up to about 10 mm, or up to about 9 mm. Additionally or alternatively, displacement D23 may be about 6 mm, about 7 mm, about 8 mm, about 9 mm, about 10 mm, about 11 mm, about 12 mm, or between any two of those values.

In various exemplary configurations, displacement D24 may be at least about 4 mm, at least about 5 mm, at least about 6 mm, or at least about 7 mm. Additionally or alternatively, displacement D24 may be up to about 9 mm, up to about 8 mm, or up to about 7 mm. Additionally or alternatively, displacement D23 may be about 4 mm, about 5 mm, about 6 mm, about 7 mm, about 8 mm, about 9 mm, or between any two of those values.

In various exemplary configurations, displacement D25 may be at least about 10 mm, at least about 11 mm, at least about 12 mm, or at least about 13 mm. Additionally or alternatively, displacement D25 may be up to about 20 mm, up to about 19 mm, up to about 18 mm, up to about 17 mm, up to about 16 mm, up to about 15 mm, up to about 14 mm, or up to about 13 mm. Additionally or alternatively, displacement D25 may be about 10 mm, about 11 mm, about 12 mm, about 13 mm, about 14 mm, about 15 mm, about 16 mm, about 17 mm, about 18 mm, about 19 mm, about 20 mm, or between any two of those values.

In various exemplary configurations, displacement D26 may be at least about 3 mm, at least about 4 mm, at least about 5 mm, or at least about 6 mm. Additionally or alternatively, displacement D26 may be up to about 9 mm, up to about 8 mm, up to about 7 mm, or up to about 6 mm. Additionally or alternatively, displacement D26 may be about 3 mm, about 4 mm, about 5 mm, about 6 mm, about 7 mm, about 8 mm, about 9 mm, or between any two of those values.

In various exemplary configurations, displacement D27 may be at least about 7 mm, at least about 8 mm, at least about 9 mm, at least about 10 mm, or at least about 11 mm. Additionally or alternatively, displacement D27 may be up to about 15 mm, up to about 14 mm, up to about 13 mm, up to about 12 mm, or up to about 11 mm. Additionally or alternatively, displacement D27 may be about 7 mm, about 8 mm, about 9 mm, about 10 mm, about 11 mm, about 12 mm, about 13 mm, about 14 mm, about 15 mm, or between any two of those values.

In various exemplary configurations, displacement D28 may be at least about 2 mm, at least about 3 mm, at least about 4 mm, or at least about 5 mm. Additionally or alternatively, displacement D28 may be up to about 8 mm, up to about 7 mm, up to about 6 mm, or up to about 5 mm. Additionally or alternatively, displacement D28 may be about 2 mm, about 3 mm, about 4 mm, about 5 mm, about 6 mm, about 7 mm, about 8 mm, or between any two of those values.

In various exemplary configurations, displacement D29 may be at least about 10 mm, at least about 11 mm, at least about 12 mm, at least about 13 mm, or at least about 14 mm. Additionally or alternatively, displacement D29 may be up to about 22 mm, up to about 21 mm, up to about 20 mm, up to about 19 mm, up to about 18 mm, up to about 17 mm, up to about 16 mm, up to about 15 mm, or up to about 14 mm. Additionally or alternatively, displacement D29 may be about 10 mm, about 11 mm, about 12 mm, about 13 mm, about 14 mm, about 15 mm, about 16 mm, about 17 mm, about 18 mm, about 19 mm, about 20 mm, about 21 mm, about 22 mm, or between any two of those values.

In various exemplary configurations, displacement A3 may be at least about 6 degrees, at least about 6.5 degrees, at least about 7 degrees, at least about 7.5 degrees, or at least about 8 degrees. Additionally or alternatively, displacement A3 may be up to about degrees, up to about 9.5 degrees, up to about 9 degrees, up to about 8.5 degrees, or up to about 8 degrees. Additionally or alternatively, displacement A3 may be about 6 degrees, about 6.5 degrees, about 7 degrees, about 7.5 degrees, about 8 degrees, about 8.5 degrees, about 9 degrees, about 9.5 degrees, about 10 degrees, or between any two of those values.

In various exemplary configurations, displacement A5 may be at least about 2 degrees, at least about 2.2 degrees, at least about 2.4 degrees, at least about 2.6 degrees, at least about 2.8 degrees, at least about 3 degrees, at least about 3.2 degrees, at least about 3.4 degrees, at least about 3.6 degrees, at least about 3.8 degrees, or at least about 4 degrees. Additionally or alternatively, displacement A5 may be up to about 6 degrees, up to about 5.8 degrees, up to about 5.6 degrees, up to about 5.4 degrees, up to about 5.2 degrees, up to about 5 degrees, up to about 4.8 degrees, up to about 4.6 degrees, up to about 4.4 degrees, up to about 4.2 degrees, or up to about 4 degrees. Additionally or alternatively, displacement A5 may be about 2 degrees, about 2.4 degrees, about 2.6 degrees, about 2.8 degrees, about 3 degrees, about 3.2 degrees, about 3.4 degrees, about 3.6 degrees, about 3.8 degrees, about 4 degrees, about 4.2 degrees, about 4.4 degrees, about 4.6 degrees, about 4.8 degrees, about 5 degrees, about 5.2 degrees about 5.4 degrees, about 5.6 degrees, about 5.8 degrees, about 6 degrees, or between any two of those values.

In various exemplary configurations, displacement A7 may be at least about −1.5 degrees, at least about −1 degree, at least about −0.5 degrees, at least about 0 degrees, or at least about 0.5 degrees. Additionally or alternatively, displacement A7 may be up to about 3.5 degrees, up to about 3 degrees, up to about 2.5 degrees, up to about 2 degrees, up to about 1.5 degrees, up to about 1 degrees, or up to about 0.5 degrees. Additionally or alternatively, displacement A7 may be about −1.5 degrees, about −1 degrees, about −0.5 degrees, about 0 degrees, about 0.5 degrees, about 1 degrees, about 1.5 degrees, about 2 degrees, about 2.5 degrees, about 3 degrees, about 3.5 degrees, or between any two of those values.

In various exemplary configurations, displacement A9 may be at least about 10 degrees, at least about 10.5 degrees, at least about 11 degrees, at least about 11.5 degrees, or at least about 12 degrees. Additionally or alternatively, displacement A9 may be up to about 16 degrees, up to about 15.5 degrees, up to about 15 degrees, up to about 14.5 degrees, up to about 14 degrees, up to about 13.5 degrees, up to about 13 degrees, up to about 12.5 degrees, or up to about 12 degrees. Additionally or alternatively, displacement A9 may be about 10 degrees, about 10.5 degrees, about 11 degrees, about 11.5 degrees, about 12 degrees, about 12.5 degrees, about 13 degrees, about 13.5 degrees, about 14 degrees, about 14.5 degrees, about 15 degrees, about 15.5 degrees, about 16 degrees, or between any two of those values.

In various exemplary configurations, displacement A11 may be at least about 10 degrees, at least about 10.5 degrees, at least about 11 degrees, at least about 11.5 degrees, or at least about 12 degrees. Additionally or alternatively, displacement A11 may be up to about 16 degrees, up to about 15.5 degrees, up to about 15 degrees, up to about 14.5 degrees, up to about 14 degrees, up to about 13.5 degrees, up to about 13 degrees, up to about 12.5 degrees, or up to about 12 degrees. Additionally or alternatively, displacement A11 may be about 10 degrees, about 10.5 degrees, about 11 degrees, about 11.5 degrees, about 12 degrees, about 12.5 degrees, about 13 degrees, about 13.5 degrees, about 14 degrees, about 14.5 degrees, about 15 degrees, about 15.5 degrees, about 16 degrees, or between any two of those values.

In various exemplary configurations, displacement A13 may be at least about 10 degrees, at least about 10.5 degrees, at least about 11 degrees, at least about 11.5 degrees, or at least about 12 degrees. Additionally or alternatively, displacement A13 may be up to about 16 degrees, up to about 15.5 degrees, up to about 15 degrees, up to about 14.5 degrees, up to about 14 degrees, up to about 13.5 degrees, up to about 13 degrees, up to about 12.5 degrees, or up to about 12 degrees. Additionally or alternatively, displacement A13 may be about 10 degrees, about 10.5 degrees, about 11 degrees, about 11.5 degrees, about 12 degrees, about 12.5 degrees, about 13 degrees, about 13.5 degrees, about 14 degrees, about 14.5 degrees, about 15 degrees, about 15.5 degrees, about 16 degrees, or between any two of those values.

In various exemplary configurations, displacement A15 may be at least about 10 degrees, at least about 10.5 degrees, at least about 11 degrees, at least about 11.5 degrees, or at least about 12 degrees. Additionally or alternatively, displacement A15 may be up to about 16 degrees, up to about 15.5 degrees, up to about 15 degrees, up to about 14.5 degrees, up to about 14 degrees, up to about 13.5 degrees, up to about 13 degrees, up to about 12.5 degrees, or up to about 12 degrees. Additionally or alternatively, displacement A15 may be about 10 degrees, about 10.5 degrees, about 11 degrees, about 11.5 degrees, about 12 degrees, about 12.5 degrees, about 13 degrees, about 13.5 degrees, about 14 degrees, about 14.5 degrees, about 15 degrees, about 15.5 degrees, about 16 degrees, or between any two of those values.

In various exemplary configurations, radius R1 may be at least about 30 mm, at least about 31 mm, at least about 32 mm, at least about 33 mm, at least about 34 mm, at least about 35 mm, at least about 36 mm, at least about 37 mm, or at least about 38 mm. Additionally or alternatively, radius R1 may be up to about 45 mm, up to about 44 mm, up to about 43 mm, up to about 42 mm, up to about 41 mm, up to about 40 mm, up to about 39 mm, or up to about 38 mm. Additionally or alternatively, radius R1 may be about 30 mm, about 31 mm, about 32 mm, about 33 mm, about 34 mm, about 35 mm, about 36 mm, about 37 mm, about 38 mm, about 39 mm, about 40 mm, about 41 mm, about 42 mm, about 43 mm, about 44 mm, about 45 mm, or between any two of those values.

In various exemplary configurations, radius R2 may be at least about 20 mm, at least about 21 mm, at least about 22 mm, at least about 23 mm, at least about 24 mm, at least about 25 mm, at least about 26 mm, at least about 27 mm, at least about 28 mm, at least about 29 mm, at least about 30 mm, at least about 31 mm, at least about 32 mm, or at least about 33 mm. Additionally or alternatively, radius R2 may be up to about 40 mm, up to about 39 mm, up to about 38 mm, up to about 37 mm, up to about 36 mm, up to about 35 mm, up to about 34 mm, or up to about 33 mm. Additionally or alternatively, radius R2 may be about 20 mm, about 21 mm, about 22 mm, about 23 mm, about 24 mm, about 25 mm, about 26 mm, about 27 mm, about 28 mm, about 29 mm, about 30 mm, about 31 mm, about 32 mm, about 33 mm, about 34 mm, about 35 mm, about 36 mm, about 37 mm, about 38 mm, about 39 mm, about 40 mm, or between any two of those values.

In various exemplary configurations, length M1 may be at least about 14 mm, at least about 15 mm, at least about 16 mm, at least about 17 mm, at least about 18 mm, at least about 19 mm, at least about 20 mm, at least about 21 mm, or at least about 22 mm. Additionally or alternatively, length M1 may be up to about 26 mm, up to about 25 mm, up to about 24 mm, up to about 23 mm, or up to about 22 mm. Additionally or alternatively, length M1 may be about 14 mm, about 15 mm, about 16 mm, about 17 mm, about 18 mm, about 19 mm, about 20 mm, about 21 mm, about 22 mm, about 23 mm, about 24 mm, about 25 mm, about 26 mm, or between any two of those values.

FIGS. 36-43 show an alternative form of the combined rock and recline mechanism for a chair. Unless described below as being different, the features, functionality, and options are the same as outlined herein for the combined rock and recline mechanism 200 of the chair 100. Like reference numerals indicate like parts with the addition of 1000.

It will be understood that any one or more of the features of this combined rock and recline mechanism 1200 can be used in combination with any one or more of the features of the combined rock and recline mechanism 200.

Figure 36:
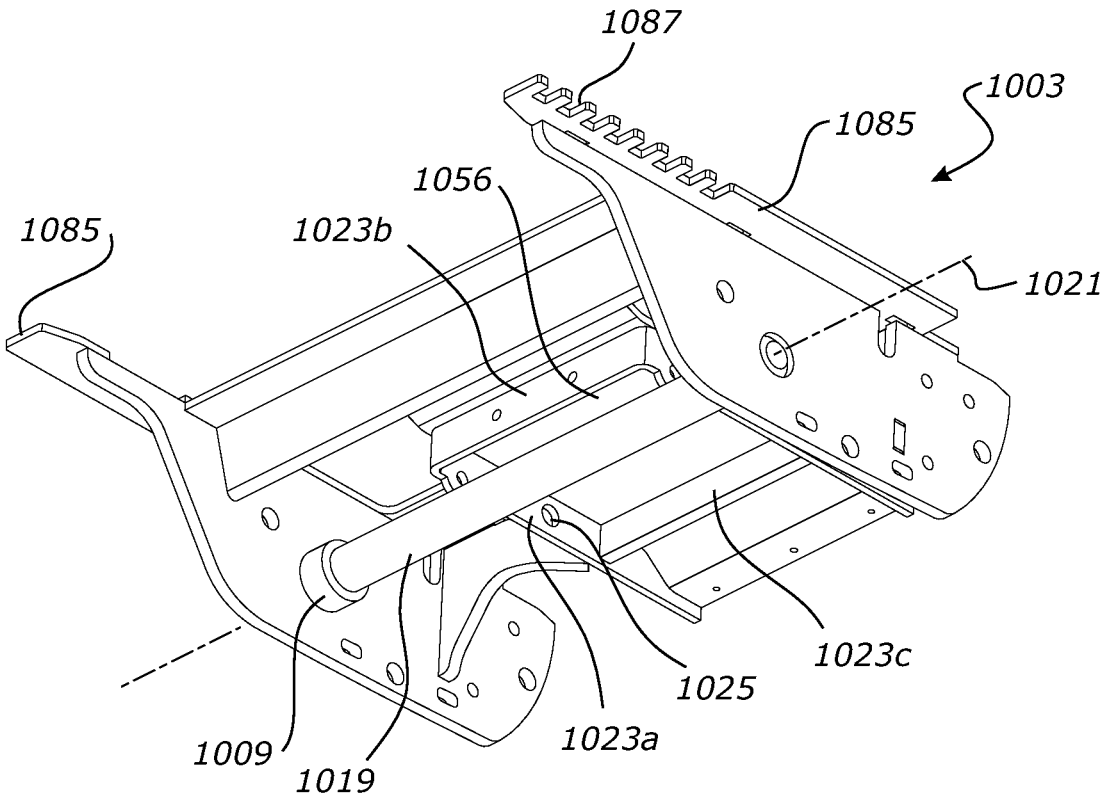
FIG. 36 shows an underside front perspective view of the seat support of an alternative form of the combined rock and recline mechanism.
Figure 37:
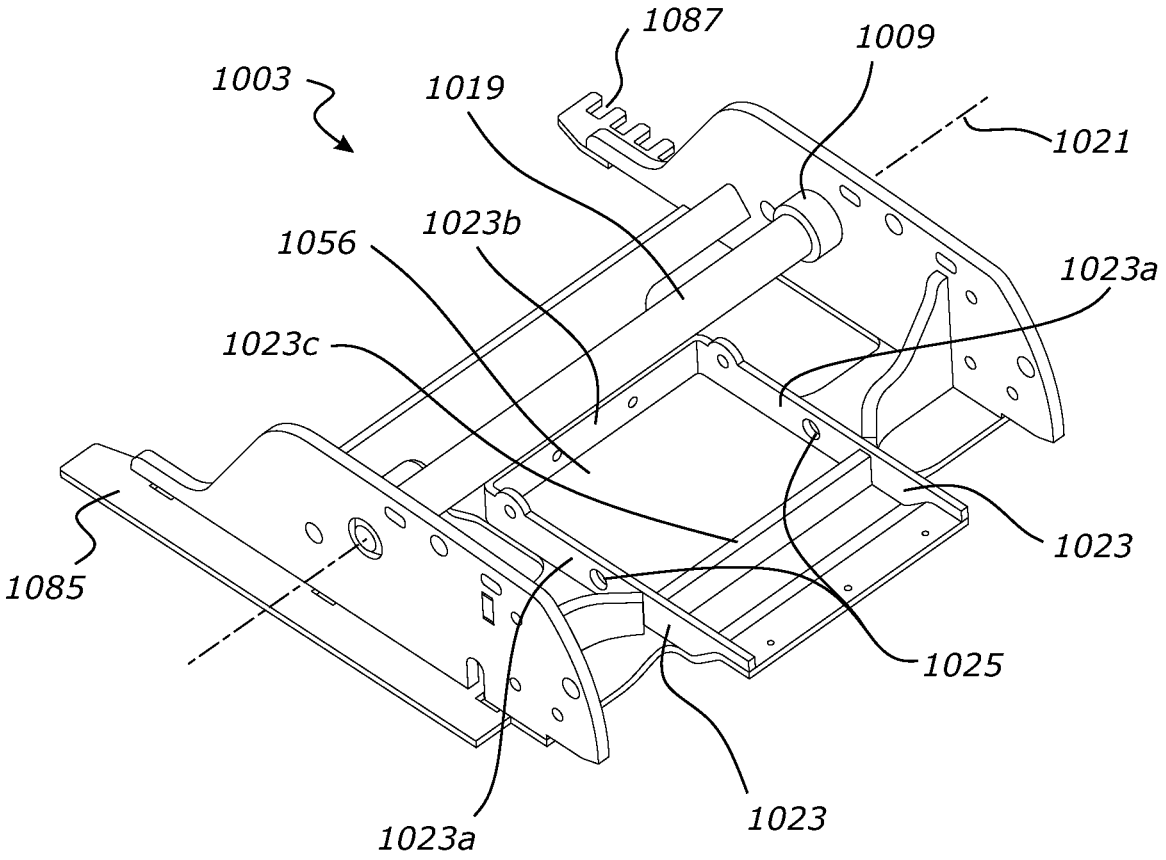
FIG. 37 shows a rear perspective view of the seat support of the alternative form of the combined rock and recline mechanism with the seat support flipped upside down.

With reference to FIGS. 36 and 37, the pair of spaced-apart downwardly extending flanges 1023 with apertures 1025 are provided by a single contiguous downwardly projecting flange. The single downwardly projecting flange has side members 1023*a* that provide the flanges 1023, and a forward transversely extending member 1023*b* that extends between and connects to front ends of the side members 1023*a*. The forwardly transversely extending member 1023*b* and the side members 1023*a* may be a generally U-shaped component.

The flange may be formed as a unitary piece or may comprise a plurality of pieces that are welded to each other. An optional rear transversely extending member 1023*c* extends between rear portions of the side members 1023*a*.

Rather than having stop plates 56, a lower surface 1056 of the seat support rearward of the forward transversely extending member 1023*a* provides a surface for the soft stop(s) (not shown) between the seat support and the inwardly directed flange(s) 1055 of the back portion 1005 to act against. In the configuration shown, the inwardly directed flanges 1055 are provided at forward ends of the spaced apart flanges 1029 of the back portion.

Figure 38A:
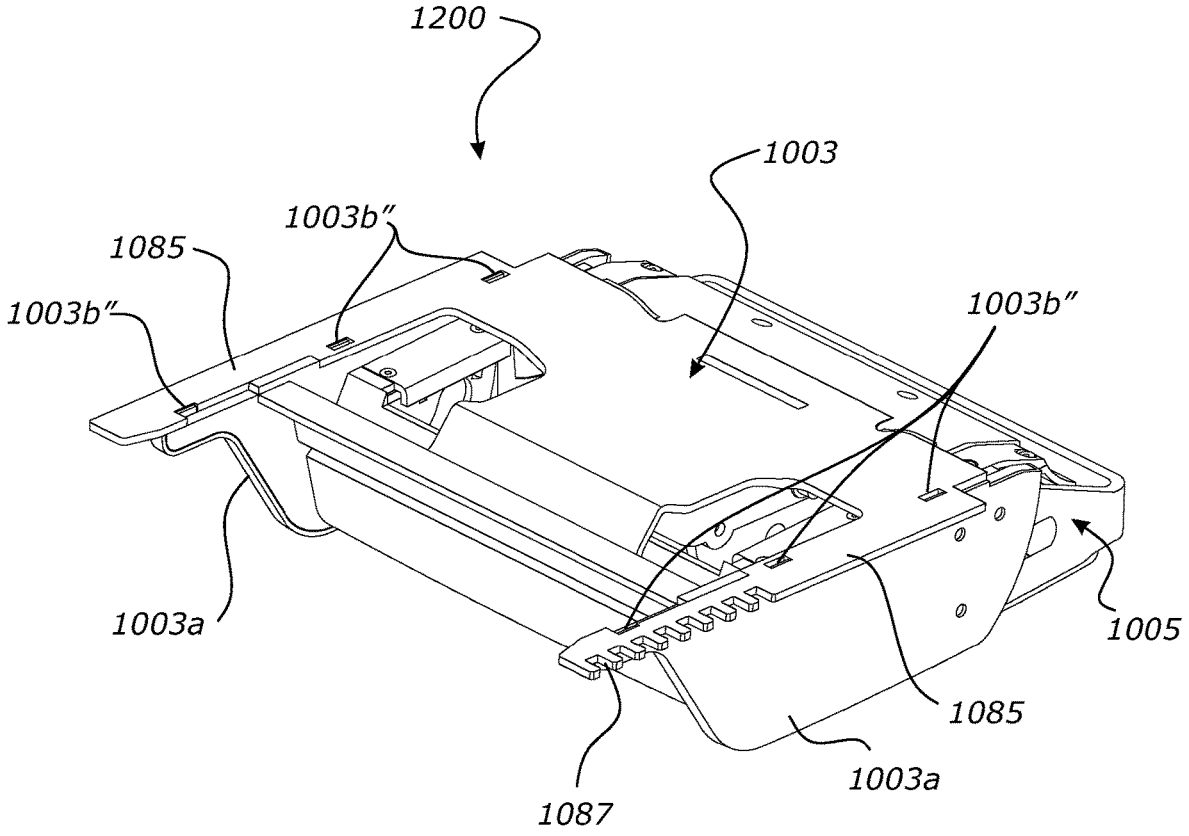
FIG. 38A shows an overhead front perspective view of the alternative form of the combined rock and recline mechanism.
Figure 38B:
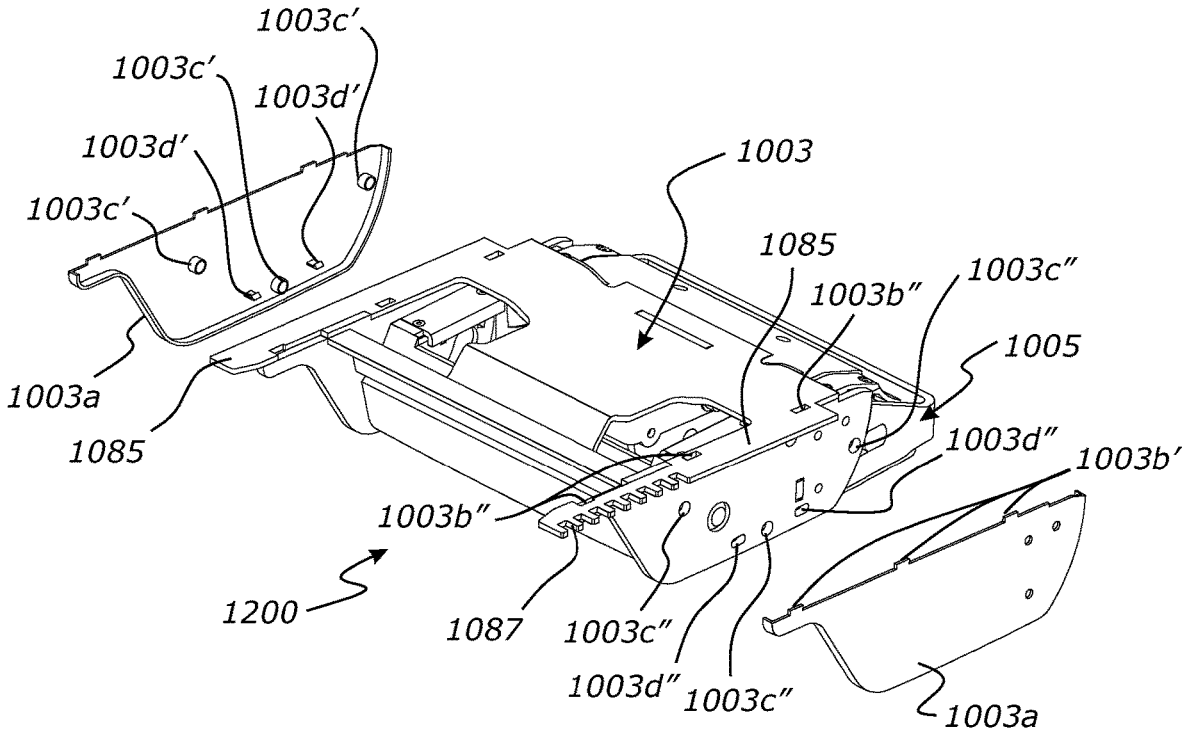
FIG. 38B shows a view similar to FIG. 38A but showing seat slide covers separated from the remainder of the alternative form of the combined rock and recline mechanism.

FIGS. 38A and 38B show detachable side covers 1003*a* for the seat support 1003. The side covers attach to the outside of the seat support 1003 to cover the sides of the seat support. The side covers 1003*a* may serve an aesthetic function to cover apertures and other features in side walls of the seat support. The side covers 1003 may be formed from any suitable material, such as a metal or plastic material for example.

The side covers 1003*a* may be attached to the seat support 1003 in any suitable way. For example, the side covers could be attached to the seat support using any suitable fasteners(s), clip(s), and/or snap(s). In the form shown, the side covers 1003*a* comprise a plurality of upwardly projecting tabs 1003*b*' that are receivable in complementary apertures or recesses 1003*b*" of the seat support, a plurality of alignment pins 1003*c*' that are receivable in complementary apertures 1003*c*" of the seat support, and a plurality of snaps 1003*d*' that are receivable in complementary apertures 1003*d*" of the seat support.

Figure 39:
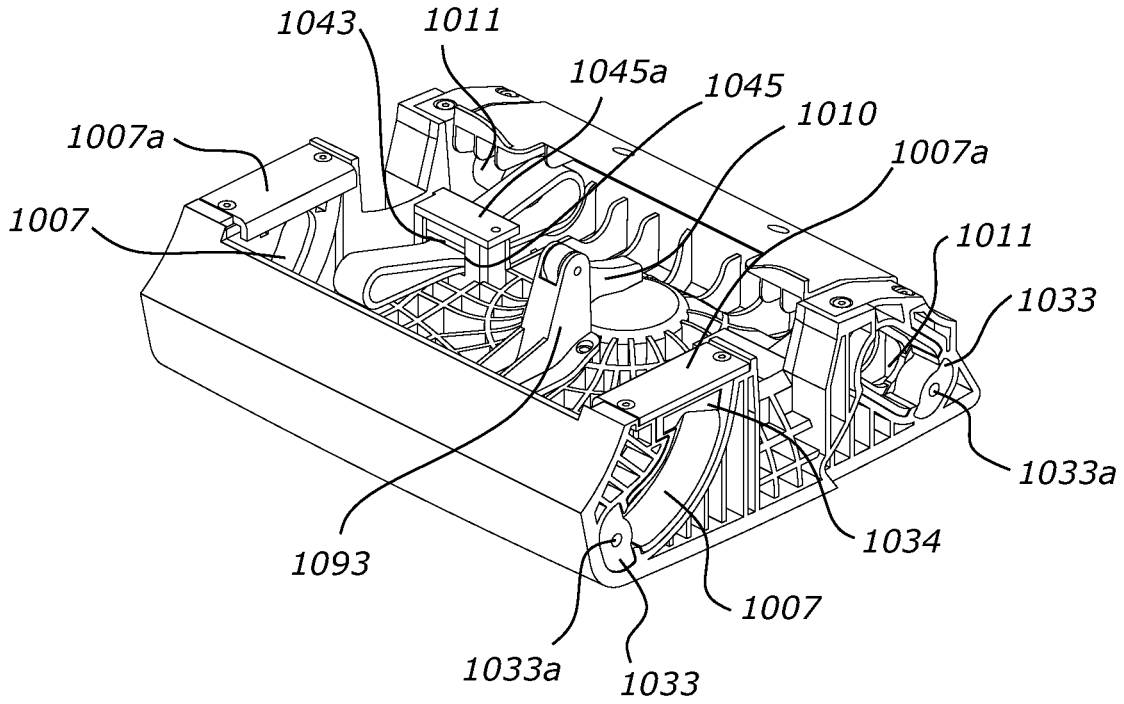
FIG. 39 shows a perspective view of the transom of the alternative form of the combined rock and recline mechanism.

Referring to FIG. 39, in addition to the compliant stops 1033 positioned at the frontmost extreme of the front track(s) 1007 and at the rearmost extreme of the rear track(s) 1011, a compliant stop 1034 is positioned at the rearmost extreme of the or each front track 1007.

The compliant stop(s) 1034 only act when the combined rock and recline mechanism is at a rear rocked and full recline position.

The compliant stops 1033, 1034 may comprise an elastomeric material such as natural or synthetic rubber for example.

The compliant stops 1033 may comprise an aperture 1033*a* therein. The aperture 1033*a* enables the compression of the compliant stops 1033*a* to be tuned, with a larger aperture reducing the resistance to compression and a smaller aperture increasing the resistance to compression. The compliant stops 1034 may also comprise an aperture (not shown).

A brace 1007*a* is provided across an upper rearmost end of the front track(s) 1007.

Figure 40:
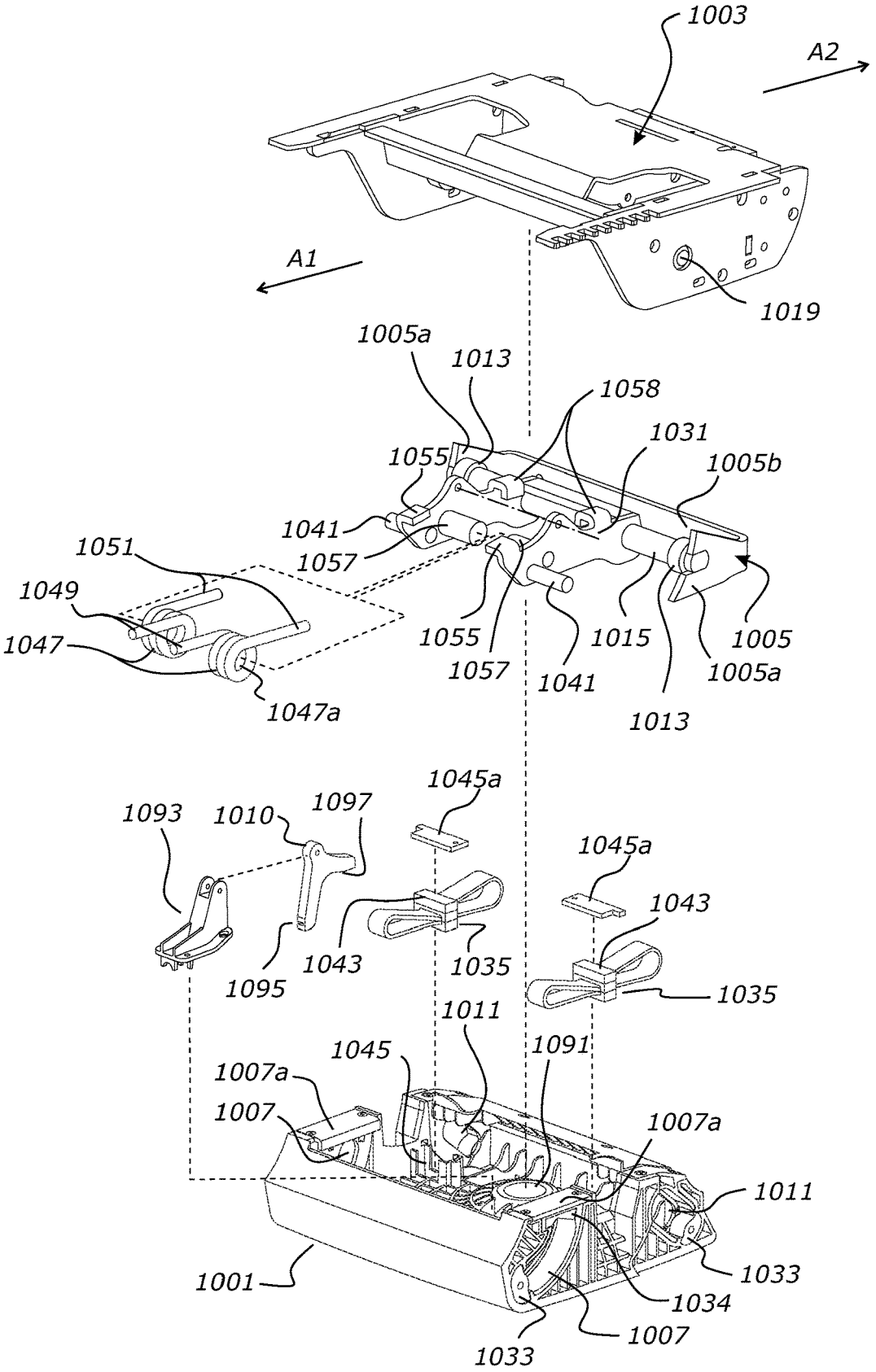
FIG. 40 shows an exploded perspective view of the alternative form of the combined rock and recline mechanism.
Figure 41:
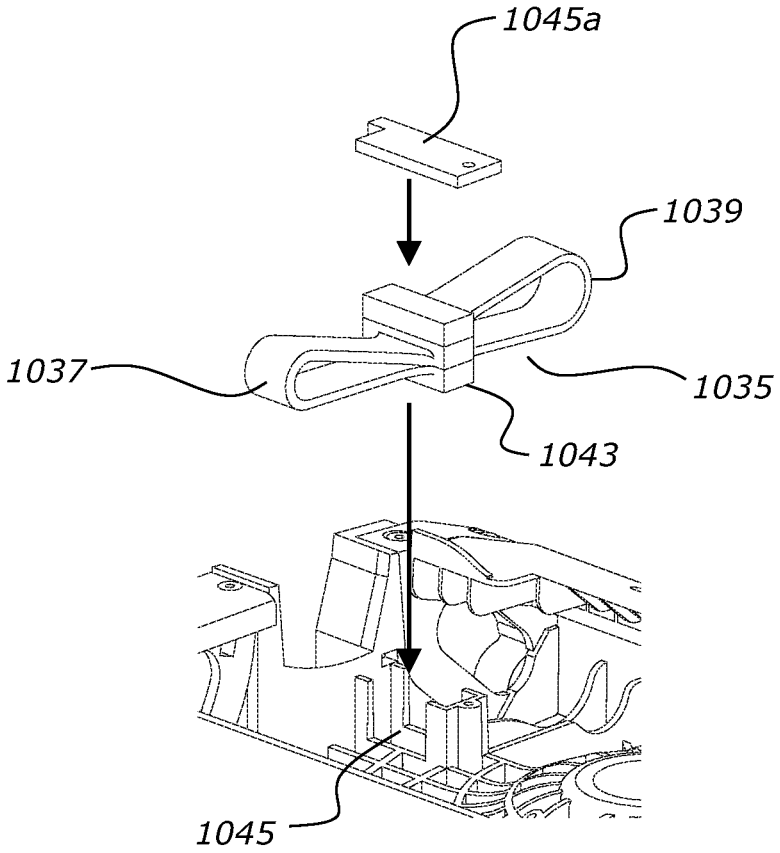
FIG. 41 shows the insertion of the one of the rocking springs into a mount on the transom of the alternative form of the combined rock and recline mechanism.
Figure 42:
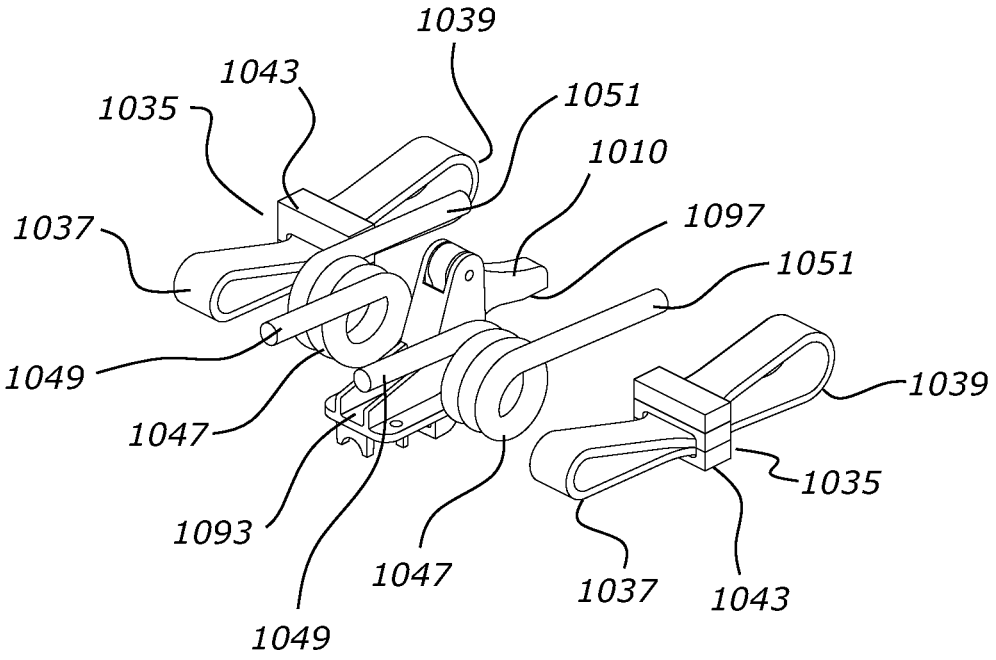
FIG. 42 shows a perspective view of the biasing arrangement of the alternative form of the combined rock and recline mechanism.

Referring to FIGS. 40-42, central body portion(s) 1043 of the rocking spring(s) 1035 are received in upwardly open spring post(s) 1045 to locate the rocking spring(s) relative to the transom 1011. Stop member(s) 1045*a* which, in the form shown is/are a plate but could be in a different form, extend(s) over the central body portion(s) 1043 to hold the rocking spring(s) 1035 in the spring post(s) 1045. The stop member(s) 1045*a* could be connected to the spring post(s) 1045 in any suitable way. For example, using any suitable fasteners(s), clip(s), and/or snap(s).

Also referring to FIG. 40, the height-adjust lever 1010 is pivotally coupled to a seat height pivot 1093 extending upwardly from a lower surface of the transom 1001. The height-adjust lever 1010 acts as a crank, and the seat height pivot acts as a housing for the crank. Rather than being integrally formed with the transom 1001, the seat height pivot 1093 is formed separately from, but connected to, the transom 1001. The seat height pivot 1093 could be connected to the transom 1001 in any suitable way. For example, using any suitable fasteners(s), clip(s), and/or snap(s).

Figure 43:
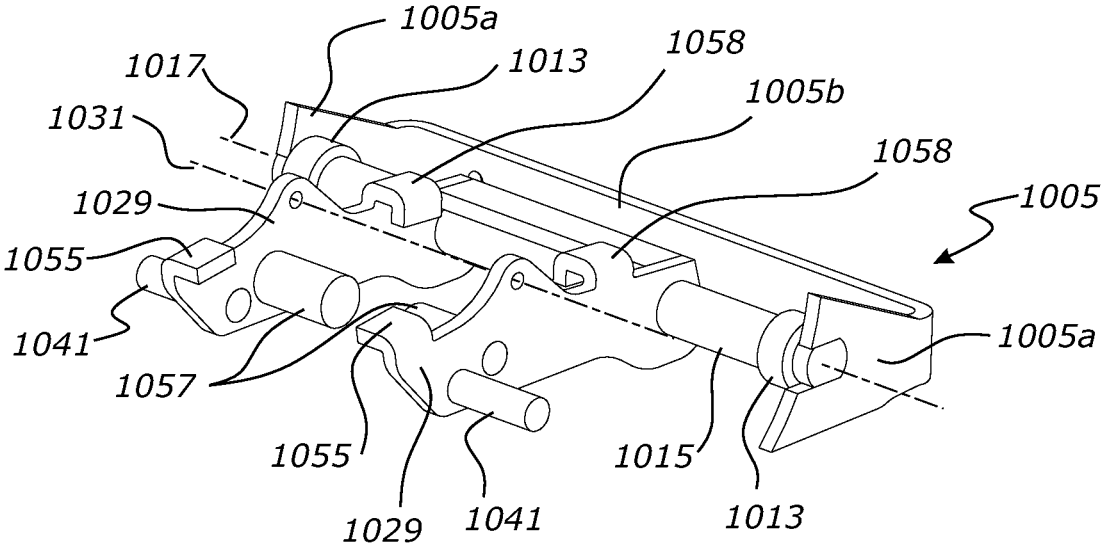
FIG. 43 shows a perspective view of the back portion of the alternative form of the combined rock and recline mechanism.

With reference to FIG. 43, the back portion 1005 comprises a transverse cross member 1005*b* that extends between and connects to rear ends of the spaced apart back arms 1005*a*. The transverse cross member 1005*b* may be integrally formed with the spaced apart back arms 1005 or could be connected thereto by welding or any other suitable technique. The transverse cross-member 1005*b* braces the spaced apart back arms 1005*a* and provides rigidity to the spaced apart back arms 1005*a*.

Also referring to FIG. 43, the spaced apart flanges 1029 of the back portion comprise locators 1058 to hold the torsion springs 1047 in a desired location.

The locators 1058 comprise hooks to receive and hold the rearwardly extending arms 1051 of the torsion springs 1047.

In the configuration shown, the hooks extend inwardly toward a centre of the chair from the spaced apart flanges 1029, and are downwardly open.

The locators 1058 are an alternative way to hold the torsion springs 1047 in position instead of the split pins and washers that are shown in FIG. 12.

The combined rock and recline mechanism 200, 1200 could also be used in a chair without a recline function, with minimal modification. In this configuration, the mechanism would provide a rocking function as described herein but would not provide a recline function. This can be achieved by fastening the seat support 3, 1003 to the back portion 5, 1005 at a location spaced apart from the pivot axis 31, 1031 between the seat support 3, 1003 and the back portion 5, 1005, to prevent pivoting between the seat support 3, 1003 and the back portion 5, 1005.

For example, one or more fasteners may be provided to fasten the seat support 1003 to, for example, one or both of the spaced apart flanges 1029 of the back portion 1005.

Additional aperture(s) may be provided in one or both of the spaced apart flanges 1029 to receive the fasteners, with the additional aperture(s) being spaced apart from the apertures that provide the pivot axis 1031. For example, the additional aperture(s) may be provided at or toward a forward end of the spaced apart flanges 1029.

In that configuration, the torsion spring(s) 47, 1047 would not be required, and any torsion spring-holding features would not be required. The spaced apart flanges 29, 1029 may not have the components 55, 1055, 1058.

The invention claimed is:

1. A chair comprising:

a transom;

a seat support;

a back portion; and a combined rock and recline mechanism that operatively connects the seat support and the back portion to the transom and the seat support to the back portion, the combined rock and recline mechanism comprising:

front and rear rocking arrangements configured to enable the seat support and back portion to together rock generally forward and rearward from a neutral position relative to the transom, wherein when the seat support moves from the neutral position to a forward rocked position, a forward portion of the seat support moves forward and downward relative to the transom, and when the seat support moves from the neutral position to a rear rocked position, the forward portion of the seat support moves rearward and upward relative to the transom; and a weight-compensated recline arrangement that is configured such that the seat support is in a first at-rest position relative to the back portion when the back portion is in an upright position, and such that reclining the back portion rearwardly from the upright position toward a reclined position moves the seat support upward and rearward from the first at-rest position to provide an upward shift in a user's centre of gravity.

2. The chair of claim 1, wherein the chair comprises a plurality of rocked positions, the back portion being reclinable rearwardly from the upright position toward the reclined position in any of the rocked positions of the chair.

3. The chair of claim 1, wherein:

the front rocking arrangement comprises a front track located on the transom and a front engagement component operatively connected to the seat support and received within the front track for movement of the front engagement component within the front track; and the rear rocking arrangement comprises a rear track located on the transom and a rear engagement component operatively connected to the back portion and received within the rear track for movement of the rear engagement component within the rear track.

4. The chair of claim 3, wherein the back portion comprises a rear axle member and the rear engagement component is rotatably mounted on the rear axle member such that the rear axle member defines a substantially horizontal transverse rear pivot axis that is movable relative to the transom upon rocking of the seat support and back portion and about which the back portion can pivot.

5. The chair of claim 4, wherein the seat support comprises a front axle member and the front engagement component is rotatably mounted on the front axle member such that the front axle member defines a substantially horizontal transverse front pivot axis that is movable relative to the transom and about which the seat support can pivot.

6. The chair of claim 5, wherein the combined rock and recline mechanism comprises a substantially horizontal transverse central pivot axis that is movable relative to the transom, the back portion and the seat support being pivotally coupled to one another at the central pivot axis.

7. The chair of claim 6, wherein in the forward rocked position, the front engagement component is located at a front edge of the front track, the front and rear rocking arrangements configured such that when the seat support moves from the neutral position to the forward rocked position, the front pivot axis moves forward and downward relative to the neutral position and the central pivot axis moves forward and upward relative to the neutral position, thereby moving the forward portion of the seat support forward and downward relative to the transom.

8. The chair of claim 7, configured such that when the seat support moves from the neutral position to the forward rocked position, the position of the central pivot axis changes such that the rear engagement component moves to a front edge of the rear track and the rear pivot axis moves forward and upward relative to the neutral position, thereby moving a rear portion of the seat support and back portion forward and upward relative to the transom.

9. The chair of claim 6, wherein in the rear rocked position, the front engagement component is located rearward from the front edge of the front track, the front and rear rocking arrangements configured such that when the seat support moves from the neutral position to the rear rocked position, the front pivot axis moves rearward and upward relative to the neutral position and the central pivot axis moves rearward and upward relative to the neutral position, thereby moving the forward portion of the seat support rearward and upward relative to the transom.

10. The chair of claim 9, configured such that when the seat support moves from the neutral position to the rear rocked position, the position of the central pivot axis changes such that the rear engagement component moves to a rear edge of the rear track, and the rear pivot axis moves rearward and downward relative to the neutral position, thereby moving a rear portion of the seat support and the back portion rearward and downward relative to the transom.

11. The chair of claim 6, wherein the recline arrangement is configured such that moving the back portion to the reclined position changes the position of the central pivot axis such that the front pivot axis moves rearward and upward and the front engagement component moves towards a rear edge of the front track, the seat support moving rearward and upward relative to the first at-rest position.

12. The chair of claim 3, wherein the front track has a curved path and the rear track has a substantially straight path.

13. The chair of claim 12, wherein a rear portion of the front track has a smaller radius of curvature than a front portion of the front track such that the curved path of the front track increases in steepness from the front portion to the rear portion.

14. The chair of claim 3, wherein the combined rock and recline mechanism comprises at least one first biasing device fixed to the transom and configured to exert a first biasing force that biases the seat support and back portion toward the neutral position.

15. The chair of claim 14, wherein the combined rock and recline mechanism comprises a substantially horizontal transverse central pivot axis that is movable relative to the transom, the back portion and the seat support being pivotally coupled to one another at the central pivot axis, wherein a rear portion of the first biasing device is connected to the rear axle member, wherein a central portion of the first biasing device is connected to the transom, and wherein a front portion of the first biasing device is connected to a front section of the back portion that is located forward of where the central portion of the first biasing device is fixed to the transom.

16. The chair of claim 15, wherein the first biasing device comprises an elastomeric device, wherein the front portion of the first biasing device receives a protrusion extending from the front section of the back portion and wherein the rear portion of the first biasing device receives a portion of the rear axle member.

17. The chair of claim 14, wherein the combined rock and recline mechanism comprises at least one second biasing device that is configured to exert a second biasing force between the back portion and the seat support to inhibit a change in an angular position of the back portion relative to an angular position of the seat support.

18. The chair of claim 17, wherein a first end of the second biasing device is engaged with the back portion, and a second end of the second biasing device is engaged with the seat support.

19. The chair of claim 18, wherein the second biasing device is fixed to the back portion at a location between the front section and the central pivot axis.

20. The chair of claim 18, wherein the second biasing device comprises a torsion spring with the first end of the second biasing device comprising a rearwardly extending arm engaged with the back portion and the second end of the second biasing device comprising a forwardly extending arm engaged with the seat support.

21. The chair of claim 1, wherein the front and rear rocking arrangements are configured to define a virtual rocking path of the seat support and back portion relative to the transom, wherein the virtual rocking path comprises a curved path and wherein a lowermost point of the curved path corresponds to the seat support and the back portion being at the neutral position, a rear portion of the virtual rocking path being located rear of the lowermost point and a front portion of the virtual rocking path being located in front of the lowermost point.

22. The chair of claim 21, wherein the virtual rocking path increases in steepness from the lowermost point to a frontmost edge of the virtual rocking path, and wherein the virtual rocking path increases in steepness from the lowermost point to a rearmost edge of the virtual rocking path.

* * * * *